US005694874A

United States Patent [19]

Nakamura et al.

[11] Patent Number: 5,694,874

[45] Date of Patent: Dec. 9, 1997

[54] UNDER THREAD SUPPLY APPARATUS AND METHOD OF SUPPLYING UNDER THREAD

[75] Inventors: Masao Nakamura; Sumio Goto; Hiroyuki Tomioka; Takayoshi Mori; Nozomi Iwasaki, all of Tokyo, Japan

[73] Assignee: Juki Corporation, Tokyo, Japan

[21] Appl. No.: 753,907

[22] Filed: Dec. 3, 1996

Related U.S. Application Data

[63] Continuation of Ser. No. 279,866, Jul. 26, 1994, abandoned.

[30] Foreign Application Priority Data

| | | | |
|---|---|---|---|
| Aug. 31, 1993 | [JP] | Japan | HEI 5-239194 |
| Dec. 28, 1993 | [JP] | Japan | HEI 5-353244 |
| Mar. 7, 1994 | [JP] | Japan | HEI 6-62066 |

[51] Int. Cl.[6] ..... D05B 19/00; D05B 59/04

[52] U.S. Cl. ..... 112/470.01; 112/180; 112/186; 112/277; 112/300; 242/20

[58] Field of Search ..... 112/279, 186, 112/168, 470.01; 242/20, 21, 22, 36, 49

[56] References Cited

U.S. PATENT DOCUMENTS

| | | | |
|---|---|---|---|
| 3,376,838 | 4/1968 | Schiffmacher et al. | 112/279 X |
| 4,002,130 | 1/1977 | Rovin et al. . | |
| 4,681,050 | 7/1987 | Kosmas . | |
| 5,143,004 | 9/1992 | Mardix et al. | 112/186 |
| 5,400,730 | 3/1995 | Moll et al. | 112/279 X |

FOREIGN PATENT DOCUMENTS

| | | | |
|---|---|---|---|
| 61-168388 | 7/1986 | Japan . | |
| 1172588 | 8/1986 | Japan | 112/279 |
| 61-172589 | 8/1986 | Japan . | |
| 61-61835 | 12/1986 | Japan . | |
| 1-91897 | 4/1989 | Japan . | |
| 1-91898 | 4/1989 | Japan . | |
| 5-3984 | 1/1993 | Japan . | |
| 5-192476 | 8/1993 | Japan . | |
| WO8403310 | 8/1984 | WIPO | 112/279 |
| WO9015894 | 12/1990 | WIPO | 112/279 |

*Primary Examiner*—Peter Nerbun

*Attorney, Agent, or Firm*—Finnegan, Henderson, Farabow, Garrett & Dunner, L.L.P.

[57] ABSTRACT

An under thread supply apparatus for a sewing machine comprises a bobbin case, a bobbin exchange device, a thread removal device and a winding device. The bobbin case is removably set to a shuttle of the sewing machine and accommodates a bobbin with the thread wound thereon. The bobbin exchange device takes the bobbin case out of the shuttle, and set the bobbin case accommodating the bobbin with the thread wound anew therearound to the shuttle. The thread removal device removes the thread from the bobbin accommodated in the bobbin case which is taken out. The winding device winds a preset amount of thread around the bobbin after the thread is removed therefrom.

9 Claims, 38 Drawing Sheets

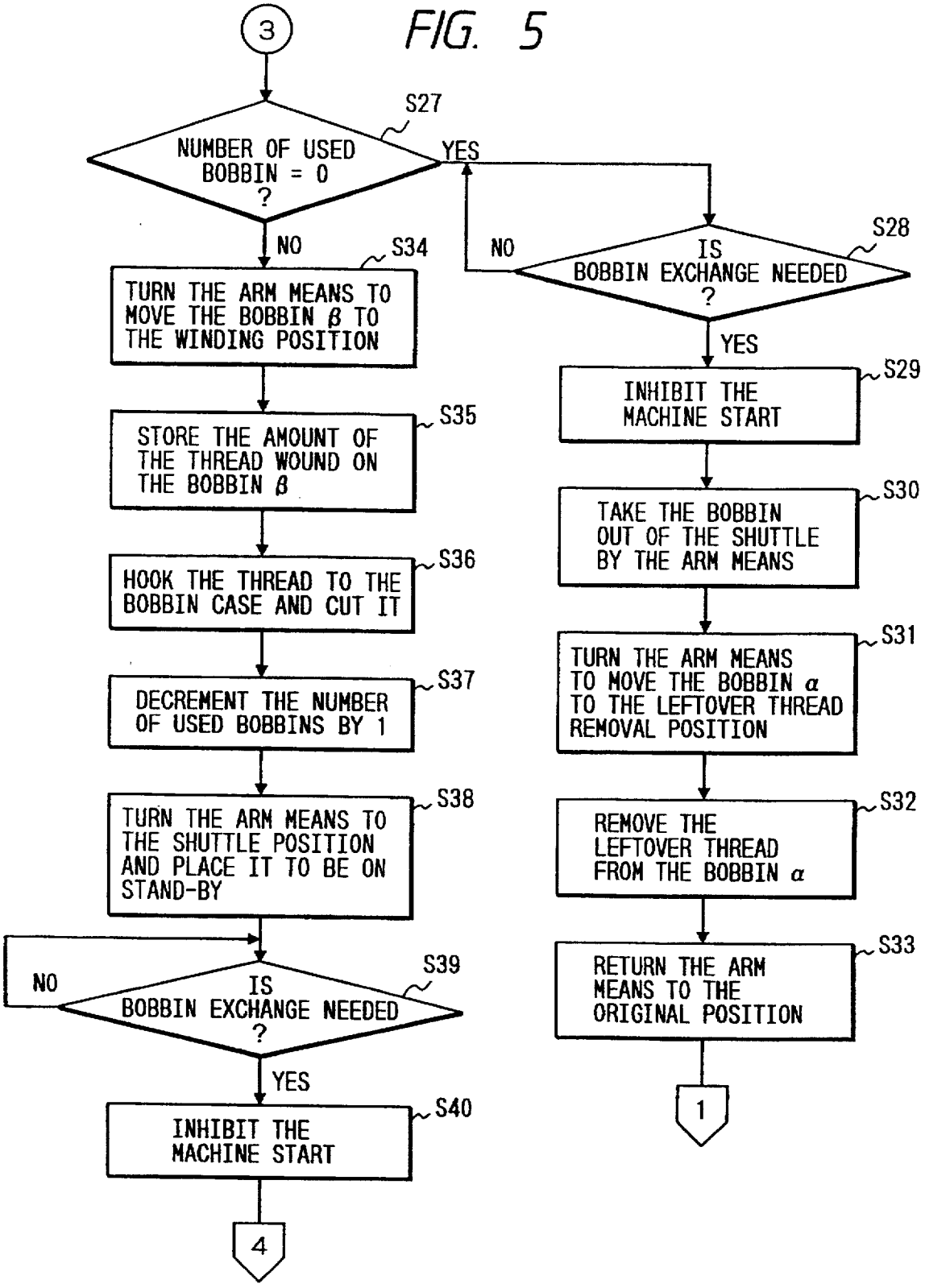
FIG. 5
3
S27
NUMBER OF USED BOBBIN = 0 ?
YES
NO
S34
TURN THE ARM MEANS TO MOVE THE BOBBIN β TO THE WINDING POSITION
S35
STORE THE AMOUNT OF THE THREAD WOUND ON THE BOBBIN β
S36
HOOK THE THREAD TO THE BOBBIN CASE AND CUT IT
S37
DECREMENT THE NUMBER OF USED BOBBINS BY 1
S38
TURN THE ARM MEANS TO THE SHUTTLE POSITION AND PLACE IT TO BE ON STAND-BY
S39
NO
IS BOBBIN EXCHANGE NEEDED ?
YES
S40
INHIBIT THE MACHINE START
4
NO
S28
IS BOBBIN EXCHANGE NEEDED ?
YES
S29
INHIBIT THE MACHINE START
S30
TAKE THE BOBBIN OUT OF THE SHUTTLE BY THE ARM MEANS
S31
TURN THE ARM MEANS TO MOVE THE BOBBIN α TO THE LEFTOVER THREAD REMOVAL POSITION
S32
REMOVE THE LEFTOVER THREAD FROM THE BOBBIN α
S33
RETURN THE ARM MEANS TO THE ORIGINAL POSITION
1

UNDER THREAD SUPPLY APPARATUS AND METHOD OF SUPPLYING UNDER THREAD

This application is a continuation of application Ser. No. 08/279,866, filed Jul. 26, 1994, now abandoned.

BACKGROUND OF THE INVENTION

The present invention relates to an under thread supply apparatus for a sewing machine and a method of automatically supplying an under thread to a sewing machine.

In a conventional lock stitch sewing machine, when an under thread (or a bobbin thread) wound on a bobbin is used up, the bobbin, together with a bobbin case, is taken out of a shuttle. After being wound with another under thread, the bobbin is set to the shuttle. This sequence of operations is manually performed. The manual work takes much time and much labor. To cope with this, various types of automatic devices for the thread winding and the bobbin exchange have been proposed. For the automatic devices, reference is made to Published Unexamined Japanese Patent Application Nos. Sho. 61-168388 and 61-172589, and Hei. 1-91897.

The device disclosed in Published Unexamined Japanese Patent Application No. Sho. 61-168388 detects the reduction of the under thread on the bobbin in the shuttle by a leftover thread detector, and automatically exchanges the bobbin with the leftover thread with a new bobbin with an under thread already wound therearound.

The device disclosed in Published Unexamined Japanese Patent Application No. Sho. 61-172589 automatically supplies the under thread to a plural number of sewing machines. Each of the sewing machines is provided with a drive device for driving a bobbin case pull-out mechanism, a bobbin case set-in mechanism, and an automatic under thread supply device (or a bobbin thread feeding device) per se. When an under thread exchange instruction is issued, the drive device is driven to move the automatic under thread supply device to a related sewing machine, a bobbin case accommodating a bobbin with a preset amount of under thread wound therearound is set in the shuttle, while a bobbin with the consumed under thread is pushed out of the shuttle.

In the device disclosed in Published Unexamined Japanese Patent Application No. Hei. 1-91897, an under thread guided by a guide shaft is nipped between it and a bobbin. It is brought into engagement with the rotation center of the bobbin. A take-up shaft is turned by a second drive device, so that the bobbin engaging the take-up shaft is turned. In this way, the under thread is wound around the bobbin automatically.

Those proposed devices have the following problems.

The amount of an under thread to be wound on a bobbin is set at a fixed value. Therefore, a considerably large amount of the thread is left not used for some types of yarn and some types of stitching patterns. Further, a detection of the remaining under thread for providing a reference for the exchange of the bobbin in the shuttle is roughly made. Because of this, the leftover thread is inevitably present.

In the device of Published Unexamined Japanese Patent Application No. Hei. 1-91897, the under thread is wound around the bobbin still in the shuttle. Accordingly, the stitching operation by the sewing machine is interrupted during this winding. The efficiency of the sewing operation is deteriorated. The remaining devices each have not such a construction that the under thread is wound around the bobbin still in the shuttle. Those devices are free from the problem of deteriorating the sewing operation efficiency. The description of the publication does not refer to timing of the bobbin exchange. Therefore, there is a danger that a mutual interference of the bobbin with the sewing machine takes place.

In the conventional bobbin exchanging devices of the under thread supply apparatus, a shuttle, a bobbin, and a bobbin case are constructed to have special shapes. Delicate interrelations among those components greatly influence the stitching quality. Accumulation of long time experiences creates a good stitching quality. Less maintenance lessens economical loss. For these reasons, a less modification is required for those three components (shuttle, bobbin, and bobbin case).

Accordingly, an object of the present invention is to provide an automatic under thread supply device which produces a reduced amount of the leftover thread and is economical, and ensures a smooth bobbin exchange without any mutual interference of the bobbin with a sewing machine.

Another, object of the present invention is to provide a leftover thread removal device for a bobbin in use with a automatic under thread supply device in which related components and members are laid out without creating any restriction, and a leftover thread can be removed with certainty.

Still another object of the present invention is to provide a bobbin exchanging device for a sewing machine which allows a shuttle, a bobbin case, and a bobbin to be used without any modification thereof, and maintains good stitching quality.

SUMMARY OF THE INVENTION

To achieve the above objects, an under thread supply apparatus for a sewing machine according to the present invention comprises a bobbin case, a bobbin exchange device, a thread removal device and a winding device. The bobbin case is removably set to a shuttle of the sewing machine and accommodates a bobbin with the thread wound thereon. The bobbin exchange device takes the bobbin case out of the shuttle, and sets the bobbin case accommodating the bobbin with the thread wound anew therearound to the shuttle. The thread removal device removes the thread from the bobbin accommodated in the bobbin case which is taken out. The winding device winds a preset amount of thread around the bobbin after the thread is removed therefrom.

According to another aspect to the invention, an under thread supply method comprising the steps of: taking a bobbin case out of a shuttle of the sewing machine, the bobbin case accommodating a bobbin with a thread wound therearound and removably set to the shuttle; removing the thread wound around the bobbin accommodated in the bobbin case taken out; winding a preset amount of thread around the bobbin after the thread is removed therefrom; and setting the bobbin case accommodating the bobbin with the thread wound anew therearound to the shuttle.

Furthermore, to achieve the above object, the invention provides a leftover thread removal device for a bobbin in use with an under thread supply device, said leftover thread removal device comprising winding means, a block member and a receiving shaft. The winding means includes a rotatable and axially movable thread removal member, and a plural number of linear resilient members, which is fastened to the thread removal member and disposed around the thread removal member, and protruded from the thread removal member. The winding means winds up a thread from a bobbin through the rotation of the thread removal member and the linear resilient members. The block member is disposed around the winding means. The block member blocks and drops the thread wound on the winding means when the winding means is retracted. The receiving shaft is movable to locations where the receiving shaft faces the winding means and where the receiving shaft leaves the winding means, wherein the receiving shaft moves to the location where the receiving shaft faces the winding means when the leftover thread is removed, wherein the receiving shaft receives the advancing winding means and wherein the receiving shaft turns together with the winding means.

Still further, to achieve the above object, the invention provides a bobbin exchanging device for a sewing machine comprising at least one bobbin case, a bobbin grasp mechanism and an operation mechanism. Each of the bobbin cases accommodates a bobbin and has a lock lever releasing the bobbin from firmly setting in the bobbin case. The bobbin grasp mechanism reciprocally moves among a shuttle position and other work positions while grasping the bobbin case accommodating the bobbin with an under thread wound therearound, so that the bobbin grasp mechanism grasps a bobbin case set in the shuttle and takes it out of the shuttle, and grasps another bobbin case prepared at another work position and sets it in the shuttle. The bobbin grasp mechanism includes a pull-up mechanism for releasing the lock lever of the bobbin case by pulling up the lock lever from a closed position, and a lock mechanism for keeping the lock lever of the bobbin case at a released position. The operation mechanism operates the lock mechanism of the bobbin grasp mechanism and the pull-up mechanism, the operation device being mounted on a body of the bobbin exchanging device.

In an under thread supply apparatus according to the present invention, the amount of the leftover thread is reduced and is economical, and ensures a smooth bobbin exchange without any mutual interference of the bobbin with a sewing machine.

In the leftover thread removal device thus constructed, the bobbin case containing a bobbin with a leftover thread reaches a preset position in the leftover thread removal zone. The receiving shaft is moved to a location where it faces the thread removal member and the linear resilient members. The thread removal member and the linear resilient members advance. The linear resilient members are expanded so as to cover the receiving shaft. The thread is nipped by the thread removal member and the receiving shaft. When the thread removal member and the linear resilient members are turned, the thread is wound around the plural number of linear resilient members. Thereafter, when the thread removal member and the linear resilient members are retracted, the linear resilient members leaves the receiving shaft, so that the spaces among them are narrowed. The wound thread is loosened. The loosened thread is blocked and squeezed by the block member of the fixed table, and drops off the linear resilient members. If a thread ball stays there, it certainly drops since the receiving shaft retracts, and the support for the thread ball is removed.

In the bobbin exchanging device thus constructed, the bobbin grasp mechanism grasps a bobbin case with a consumed thread and takes it out of the shuttle, and grasps a new bobbin case prepared at another work position and sets it in the shuttle. In the grasping process by the bobbin grasp mechanism, the bobbin grasp mechanism advances to a bobbin case contained in a shuttle. The pull-up mechanism is set at an initial position by the operation mechanism located on the fixed member and is pressed against the bobbin case while keeping its state. The operation mechanism located on the fixed member is driven, and the pull-up mechanism of the bobbin grasp mechanism which is set at the initial position is operated. In turn, the lock lever of the bobbin case is pulled up and released. The lock lever released is held at an open position by the lock mechanism. As a result, the whole bobbin case is grasped. In this way, the bobbin case is set in and taken out of the shuttle. Thus, the automatic bobbin exchange is realized without any modification of the shuttle, the bobbin, and the bobbin case.

BRIEF DESCRIPTION OF THE DRAWINGS

FIG. 5 is a flow chart showing the main program, continued from the flow chart in FIG. 4;

FIG. 16 is a plan view show a tubular groove cam and a bobbin case, and a bobbin winder plate shown in FIG. 15;

DETAILED DESCRIPTION PREFERRED EMBODIMENTS

The preferred embodiments of the present invention will be described with reference to the accompanying drawings.

Figure 12:
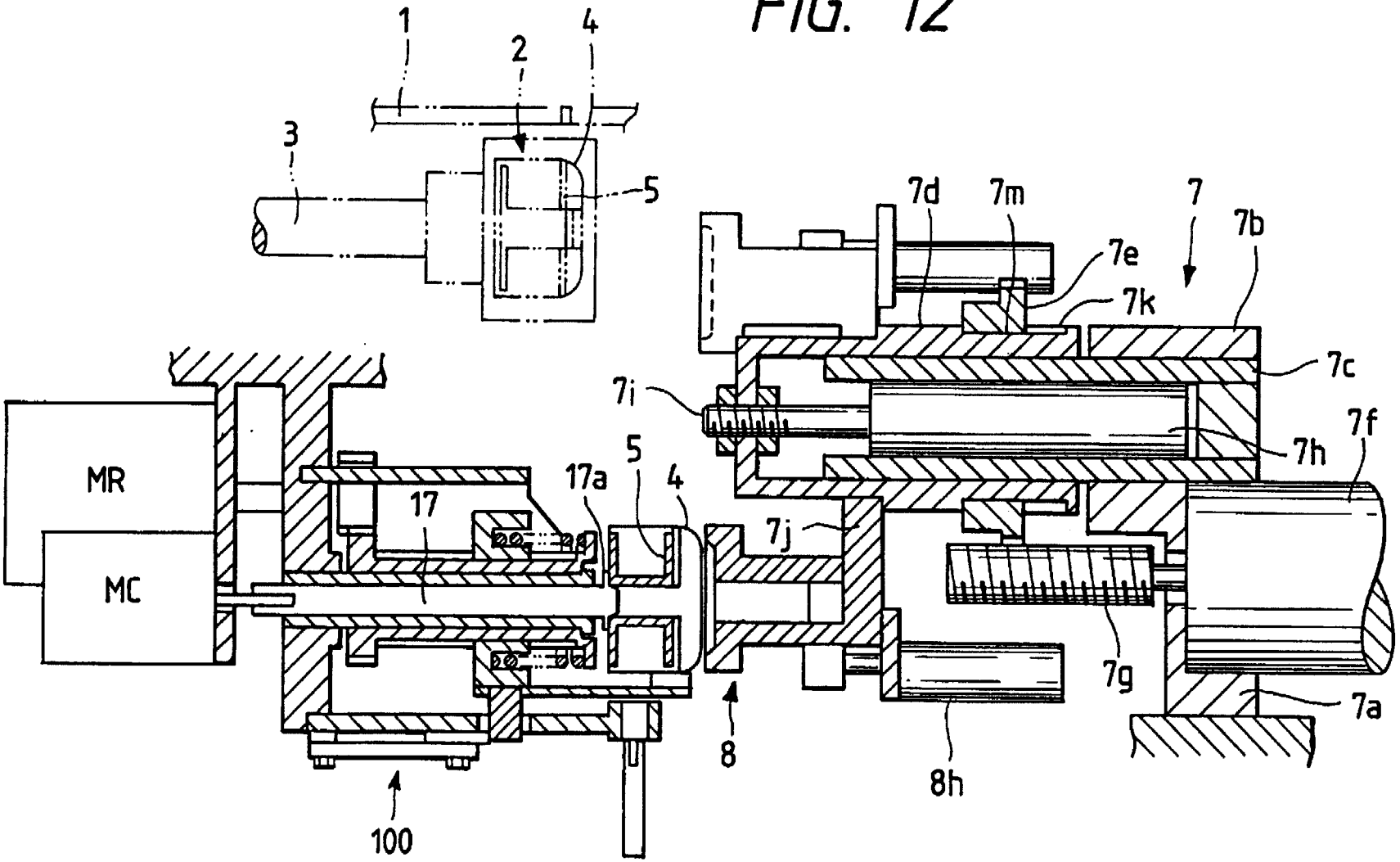
FIG. 12 is a transverse sectional view showing an automatic thread-winding/thread-retaining device and a bobbin exchange device both applied to an automatic under thread supply apparatus.

FIG. 12 is a transverse sectional view showing an automatic thread-winding/thread-hooking apparatus 100 and a bobbin exchange device 7, which are applied to an automatic under thread supply apparatus (or an automatic bobbin thread feeding apparatus.

In the figure, a lower shaft 3 is coupled with a shuttle 2 disposed right under a throat plate 1 of a sewing machine. A bobbin case 4 is accommodated in the shuttle 2. A bobbin 5 with an under thread (or a bobbin thread), which is wound therearound by the automatic thread-winding/thread-hooking device 100 to be described later, is accommodated in the bobbin case 4. The shuttle 2 and the bobbin case 4 are constructed like the conventional ones. Hence, no further description of the construction of these components will be given.

Figure 13A:
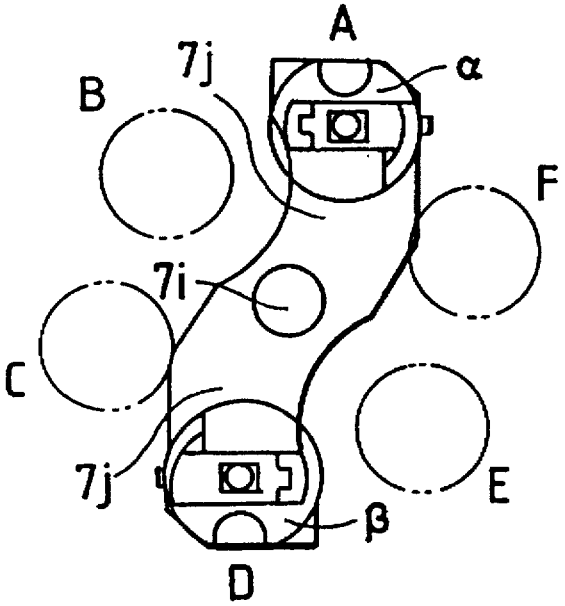
FIGS. 13(A) and 13(B) are diagrams useful in explaining positions arm means of a bobbin exchanging device may take.

The automatic thread-winding/thread-hooking device 100 for automatically winding a thread around the bobbin 5 and automatically hooking a thread to the bobbin case 4 is located under the shuttle 2 in FIG. 12. A leftover thread removing device (not shown) is located on one side of the automatic thread-winding/thread-hooking device 100 as viewed in the drawing. The leftover thread removing device according to the present invention will be described latter. The bobbin exchanging device 7 is located in the right lower portion in FIG. 12. The bobbin exchanging device 7 is provided with arms 7*j*, which are located on a circumference. The arms 7j are rotatable and retractable (movable in the horizontal direction in FIG. 12). In FIG. 13(A) showing a view depicted when seen from the left side in FIG. 12, the arms 7*j* are turned about a location denoted as 7*i*. At a position A, after a stitching process, the bobbin case 4 with a small amount of thread being left is held and the bobbin 5 is taken out. At another position C angularly separated from the position A by 120°, the leftover thread removing device is located. At yet another position E angularly separated from the position C by 120°, the automatic thread-winding/thread-hooking device 100 is located.

The automatic thread-winding/thread-hooking device 100, located at the position E in FIG. 13(A) will be described.

Figure 15:
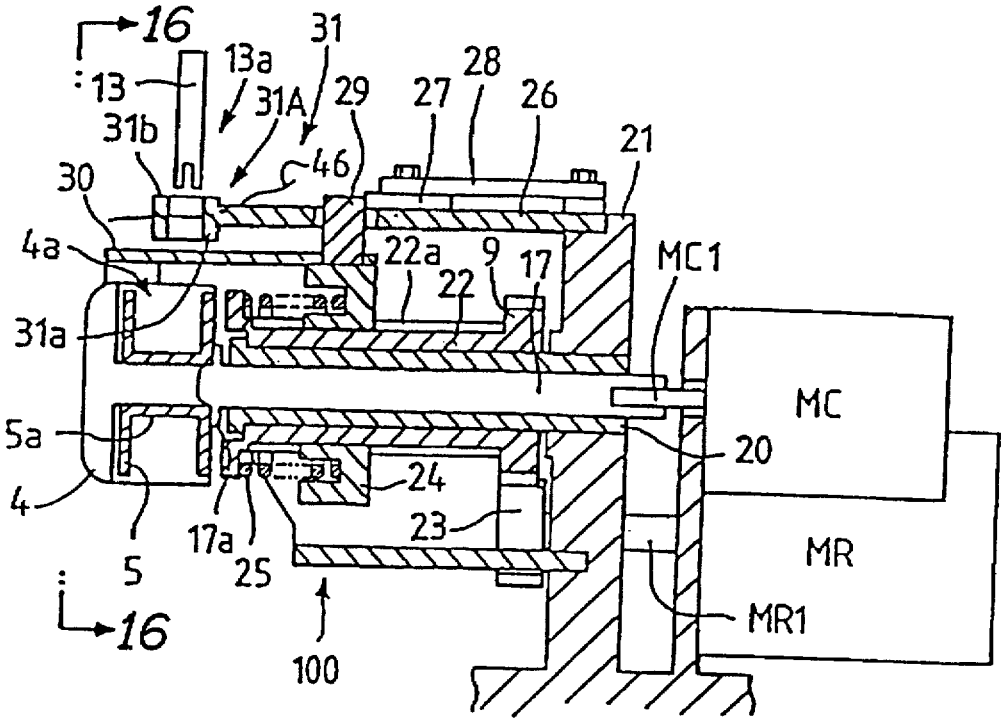
FIG. 15 is an enlarged traverse sectional view showing the automatic thread-winding/thread-hooking device 100 shown in FIG. 12.
Figure 16:
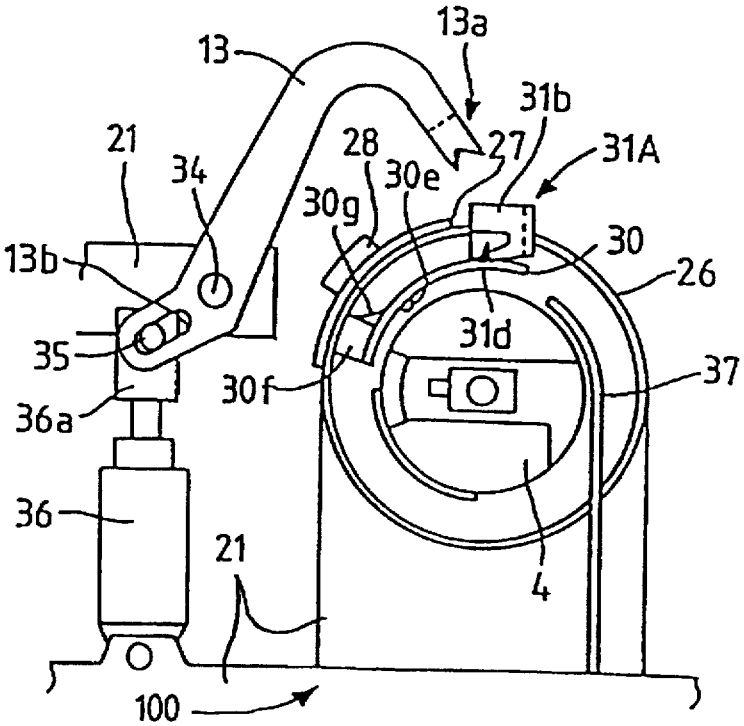
FIG. 16 is a view taken on line 16—16 in FIG. 15.

FIG. 15 is an enlarged transverse sectional view showing the automatic thread-winding/thread-hooking device 100 shown in FIG. 12. FIG. 16 is a view taken on 16—16 in FIG. 15. FIG. 16 is a plan view show a tubular groove cam and a bobbin case, and a bobbin winder plate. For ease of explanation, the illustration of FIG. 15 corresponds to the illustration of the automatic thread-winding/thread-hooking device 100 shown in FIG. 12, which is turned upside down.

In FIG. 15, reference character MC designates a take-up motor for winding a thread around a bobbin. A clutch shaft 17 is fastened to the end part of the motor shaft MC1 of the takeup motor MC. The clutch shaft 17 is rotatably inserted into a bearing 20 fastened to a base 21. A clutch disc 17*a* is removably attached to the distal end of the clutch shaft 17. A spline shaft 22 is rotatably fit to the bearing 20. Spline grooves 22*a* are formed on the outer surface of the spline shaft 22. A follower gear 9 is fixedly mounted on the end part of the spline shaft 22, which is located closer to the take-up motor MC. The follower gear 9 is in mesh with a drive gear 23. The drive gear 23 is fastened to a motor shaft MR1 of a thread guide drive motor MR as a reversible motor.

A spline nut 24 is fit to the spline shaft 22. Splines are formed on the inner surface of the spline nut 24 at the locations corresponding to the locations of the spline grooves 22*a* of the spline shaft. The spline nut 24 is able to be rotated by the thread guide drive motor MR and is movable forward and backward in the axial direction while being guided by the splines. A spring 25 is fastened at the first end to the end face of the spline shaft 22, which is located closer to the bobbin 5. The second end of the spring 25 is fastened to the end face of the spline nut 24, which is located closer to the bobbin 5. The spring 25 urges the spline nut 24 toward the take-up motor MC. A cam follower pin 29 and a thread handling plate 30 are mounted on the outer surface of the spline nut 24. The cam follower pin 29, is projected outward (upward in FIG. 15) from the outer surface of the spline nut. The thread handling plate 30 is formed by arcuately curving a flat plate as shown in FIG. 16 and extended to and above the bobbin 5, as shown in FIG. 15.

Figure 17:
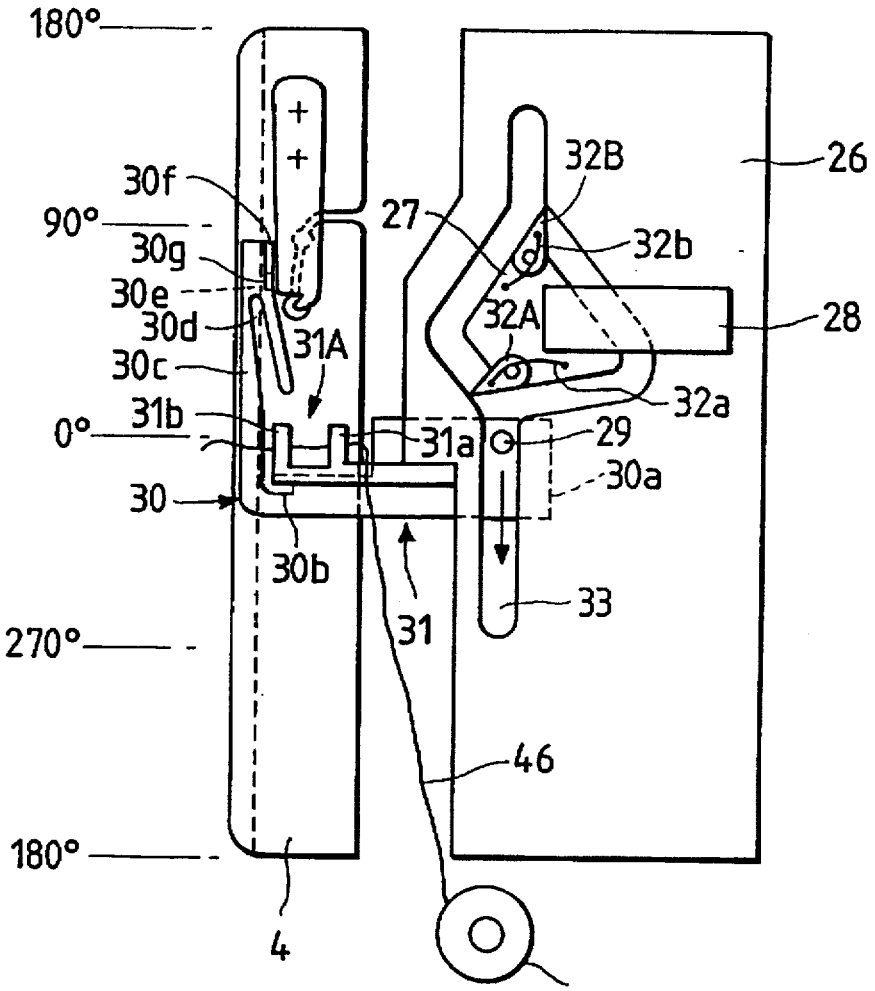
FIG. 17 is a plan view showing a tubular groove cam, a bobbin case, and a thread handling plate.
Figure 18:
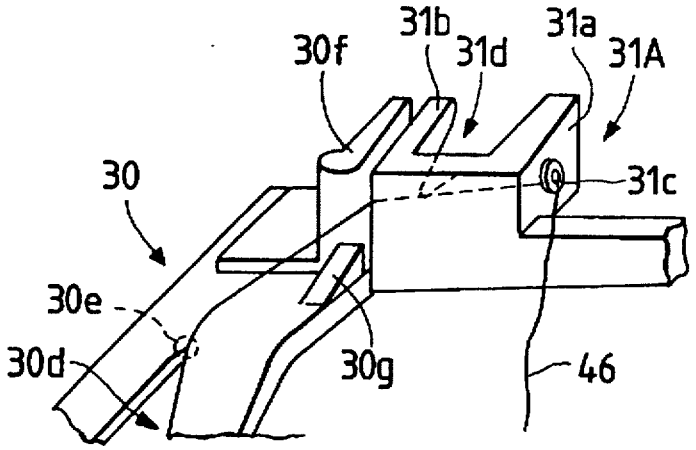
FIG. 18 is an enlarged perspective view showing a U-shaped member and a thread-end hold plate spring, the illustration showing a state of a supplied thread being held at the end thereof.

The thread handling plate 30 is substantially L-shaped when illustrated in a development fashion in FIG. 17. Almost part of the thread handling plate 30 is formed of a first extended part 30*a*, a seized-thread receiving part 30*b*, a second extended part 30*c*, a thread guide groove 30*d*, a movable cutter 30*e* as a movable blade, a thread-end hold plate spring 30*f*, and a slanted part 30*g*. The first extended part 30*a*, which constitutes one of the leg portion of the L-shaped bobbin winder plate, is fastened to the spline nut 24. The seized-thread receiving part 30*b*, shaped like a hook, is located at the corner of the L shape. The second extended part 30*c* constitutes the other leg portion of the L-shaped bobbin winder plate. The thread guide groove 30*d* is formed in the second extended part 30*c*. The movable cutter 30*e* facing the bobbin case 4, is formed at the branched portion of the thread guide groove 30*d* (FIGS. 16 and 18). The thread-end hold plate spring 30*f*, shaped like a flat plate and erected upward, is circumferentially formed at the end part of the second extended part 30*c* (FIGS. 16 and 18). The slanted part 30*g*, contiguous to the thread-end hold plate spring 30*f*, provides an easy guide of a thread in the upward direction in FIG. 18.

Figure 20:
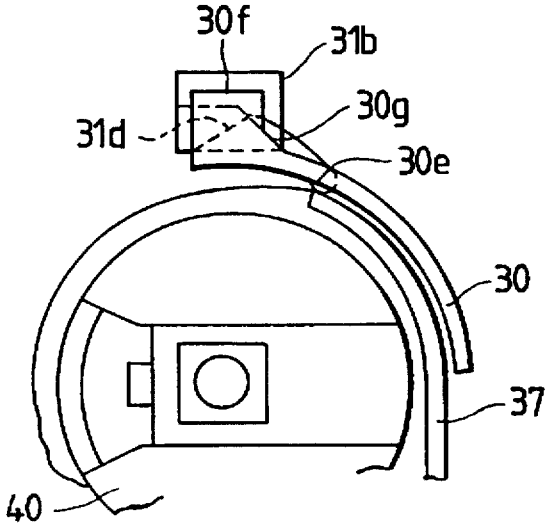
FIG. 20 is a diagram showing a key portion of the structure of FIG. 16, the illustration showing a cutting mechanism for separating a thread wound around the bobbin from the supplied thread.

A fixed cutter 37 as a fixed blade, as shown in FIGS. 16 and 20, is fastened to the base 21, while being curved in the circumferential direction of the thread handling plate 30. The tip of the fixed cutter 37 is positioned so as to confront with the movable cutter 30*e* when a thread has been hooked to the bobbin case 4 (to be described later). At this position, the fixed cutter 37 cooperates with the movable cutter 30*e* to cut the lower thread.

A tubular outer cam 26, fastened to the base 21, is disposed around the thread handling plate 30 and the spline shaft 22. The outer cam 26 has an opening, as shown in FIG. 17. An inner cam 27 is disposed within or above the opening. The inner cam 27 is fastened to the base 21 by a support plate 28. The outer cam 26 and the inner cam 27 cooperate to form a cam groove 33. The cam follower pin 29 is movably disposed with the cam groove 33. When the thread guide drive motor MR is driven, the cam follower pin 29 is moved along the cam groove 33 while being guided by the splines and the cam groove 33.

Check guide valves 32A and 32B are formed at the branched portions of the cam groove 33 and rotatably supported by the inner cam 27. Coiled springs 32*a* and 32*b* respectively attached to the check guide valves 32A and 32B define the path for the reciprocal motion of the cam follower pin 29 (The details of this will be described later.).

Figure 19:
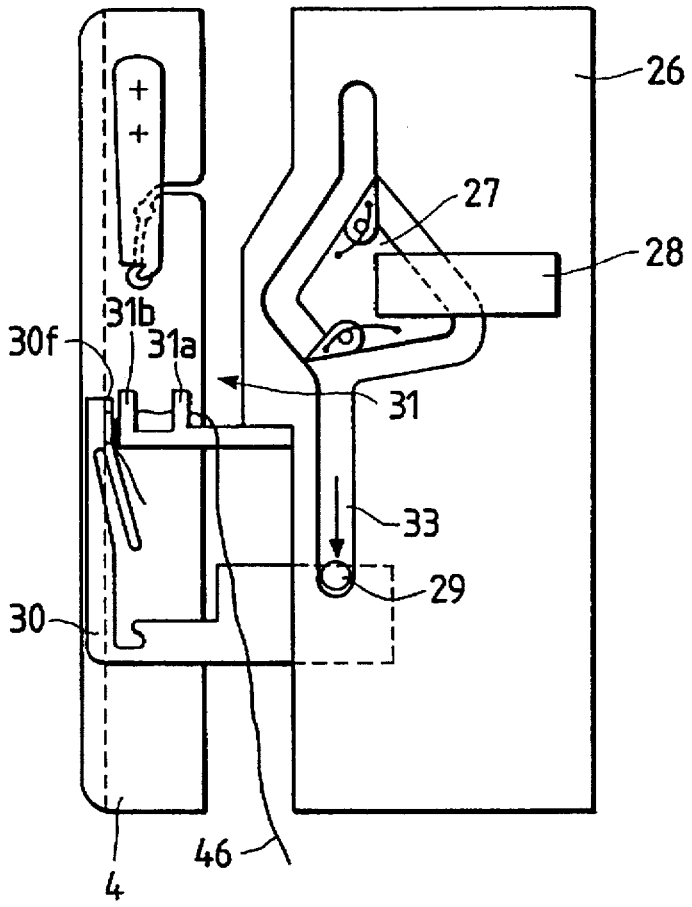
FIG. 19 is a plan view showing a tubular groove cam, a bobbin case, and a thread handling plate, the illustration showing a state of a supplied thread being held at the end thereof.

As shown in FIGS. 15, 17, and 18, a U-shaped member 31 with a U-shaped end portion is fixedly attached to the end of the outer cam 26, which is located closer to the bobbin 5, and is extended to the side of the bobbin 5. The U-shaped portion 31A of the U-shaped member 31, which serves as a lower thread stretching member, includes two parallel flat plates 31*a* and 3l*b*, which are disposed orthogonal to the spline shaft 22. The U-shaped portion 31A is shaped like U when viewed from top in FIG. 15. The U-shaped portion 31A is disposed such that when the bobbin case 4 is set, it faces an opening 4a of the bobbin case 4, as shown in FIGS. 15 and 19. A thread guide hole 31c is formed in the flat plate 31a, as shown in FIG. 18. A V-shaped cutout 31d is formed in the flat plate 3lb, as shown in FIGS. 16 and 18.

Figure 22:
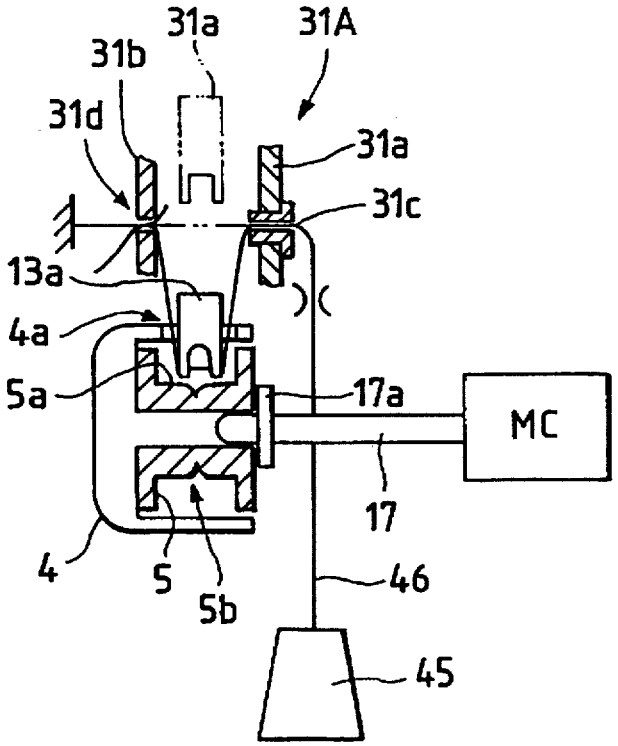
FIG. 22 is a traverse sectional view showing the structure shown in FIG. 21.

A swing lever 13 is disposed adjacent to the bobbin case 4 when it is set, as shown in FIG. 16. The swing lever 13 is rotatably supported by a pin 34 securely fixed to the base 21. The right half part of the swing lever 13 with respect to a pin 34 in FIG. 16 is curved toward the opening 4a of the bobbin case 4 that is set. The distal end 13a of the swing lever 13, as shown in FIG. 15, is bifurcated so as to allow a hook-like thread hooking member 40 of the bobbin 5 (to be given later) to pass through a space between the branches of the bifurcated distal end 13a. Each branch has a V-shaped cutout as shown in FIG. 16. An elongated hole 13b is formed in the base end part of the swing lever 13. A pin 35 is movably disposed in the elongated hole 13b. The pin 35 is fixedly attached to a cylinder head 36a of a cylinder 36, which is mounted on the base 21. With this structure, when the cylinder head 36a is moved vertically in FIG. 16, the swing lever 13 is swung about the pin 34. When the cylinder head 36a is moved to the highest point, the swing lever 13 is swung till the distal end 13a thereof reaches a location near the outer surface of the bobbin shaft 5a of the bobbin (FIG. 22). The swing lever 13 and the like form a means to be inserted to near the outer surface of the bobbin shaft 5a through the opening 4a of the bobbin case 4.

Figure 23:
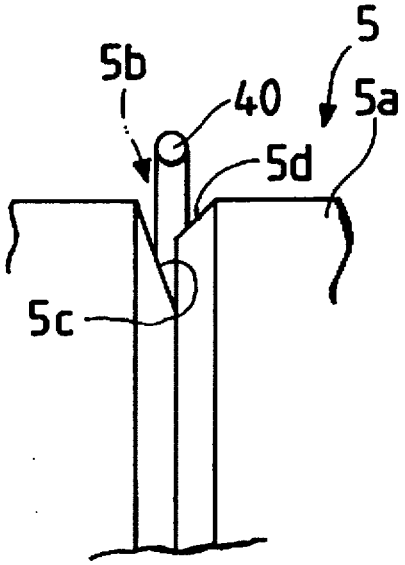
FIG. 23 is an enlarged view showing a key portion of the bobbin including a ring-like groove and a thread hooking member.
Figure 24:
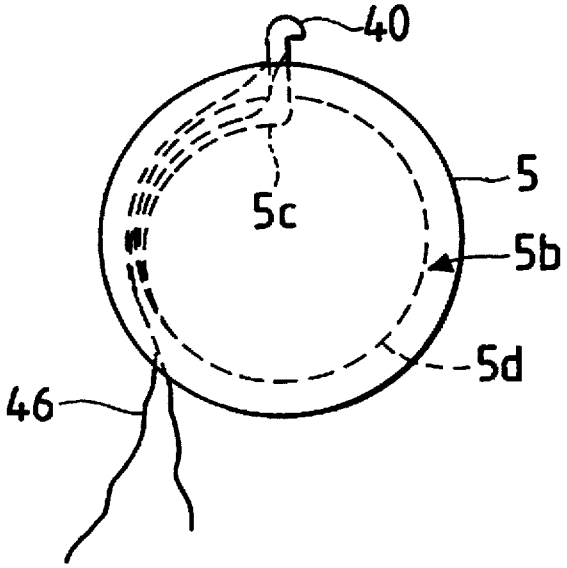
FIG. 24 is a side view showing the structure shown in FIG. 23 in which a supplied thread is hooked to the thread hooking member.

In the present embodiment, the bobbin 5 is also modified to a minimum of extent. This follows. As shown in FIGS. 22 to 24, a V-shaped groove 5b which is circular is circumferentially formed in the outer surface of the bobbin shaft 5a of the bobbin 5. The hook-like thread hooking member 40 is planted in the V-shaped groove ring 5b. At a position of the outer surface of the bobbin, which is located behind the thread hooking member 40 (viz., on the opposite side of the hook) when it is turned, a slanting surface 5c of the groove in the thread end part (on left side in FIG. 23), is deeper than a slanting surface 5d of the groove in the under thread supply part (on left side in FIG. 23). Thus, the circular V-shaped groove 5b ranging over the entire circumference of the outer surface of the bobbin is deepest at a position behind the thread hooking member 40 when it is turned, gradually shallower as a distance from the thread hooking member 40 becomes larger, and finally its depth is equal to that of the slanting surface 5d.

The automatic thread-winding/thread-hooking device 100 is provided as described above.

Figure 13B:
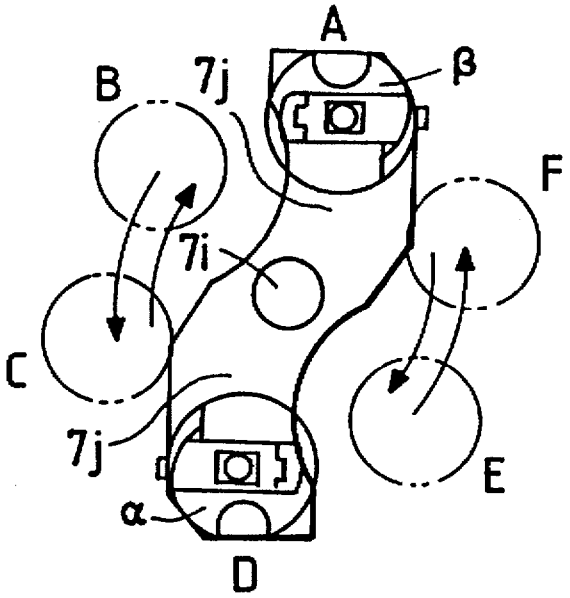

The leftover thread removing device 99 located at the position C in FIG. 13 will be described with reference to FIGS. 41 and 42.

The leftover thread removing device 99 includes a leftover thread winding motor MZ, a long shaft portion 51, a take-up fork 52, a clutch member 53, and a thread removal member 54. The leftover thread winding motor MZ is fixedly mounted on a slide board 50b, which is slidable horizontally (namely, horizontally as viewed in FIG. 41) within a slide guide 50a fastened to the base 50, by a cylinder (not shown). The shaft portion 51 is extended from a support member 55 fastened to the output shaft of the leftover thread winding motor MZ. A plural number of grooves 51a are formed in the outer surface of the shaft portion 51 while being angularly spaced. The take-up fork 52 includes a plural number of resilient members, for example, wires. The base ends (the right ends thereof in FIG. 41) of these wires are planted in the support member 55, while other ends thereof (the left ends thereof in FIG. 41) are free. Most part of each of these wires is embedded in the corresponding groove 51a. The clutch member 53 is rotatably supported by the base 50 at a location facing the end of the shaft portion 51 as viewed in the axial direction of the shaft portion 51. The end part of the clutch member 53, which faces the end of the shaft portion 51, is tapered down toward the end of the shaft portion 51. The thread removal member 54, supported by the base 50, has a hole through which the shaft portion 51 and the fork 52 are moved when the leftover thread winding motor MZ is turned forwardly and reversely.

The bobbin exchanging device 7 will next be described with reference to FIG. 12.

The bobbin exchanging device 7 grasps, with the arm means, the bobbin case 4 accommodated in the shuttle 2 (at the position A in FIG. 13(A)) and pulls it out of the shuttle, moves the bobbin case 4 to the leftover thread removing device 99 located at the position C (FIG. 13(A)) while rotating the case. After the leftover thread is removed therefrom by the leftover thread removing device 99, the bobbin exchanging device 7 moves the bobbin case 4 to the automatic thread-winding/thread-hooking device 100 located at the position E (FIG. 13(A)), while rotating the case. After the automatic thread-winding/thread-hooking device 100 winds an under thread on the bobbin accommodated in the bobbin case 4 and hooks it to the case, the bobbin exchanging device 7 set the case to the shuttle 2. In the bobbin exchanging device 7, a tubular bearing 7c is mounted on a support body 7b which is mounted on a mounting table 7a, in a state that it is horizontally extended. A tubular rotary body 7d is fit to the bearing 7c rotatably and axially movably. A spline groove 7k, which axially extends, is formed in the outer surface of the bearing 7c. A gear 7e with a spline 7m formed in the inner surface thereof is attached to the base end (right end as viewed in the figure) of the rotary body 7d. The gear 7e is in mesh with a long pinion gear 7g mounted on the output shaft of a drive motor 7f for turning the arm means. The drive motor 7f for the arm means is fixedly mounted on the mounting table 7a.

An air cylinder 7h, axially extended, is provided in the bearing 7c. The output shaft 7i of the air cylinder 7h axially engages the bottom of the rotary body 7d. At this engaging part, the output shaft 7i is rotatable with respect to the rotary body 7d.

The arms 7j, located on a circumference, are radially and oppositely extended from the outer surface of the rotary body 7d. A bobbin grasp mechanism 8 is attached to the distal end of each of the arm means 7j. The bobbin grasp mechanism 8 will be described with reference to FIGS. 38, 39, and 40.

Figure 38:
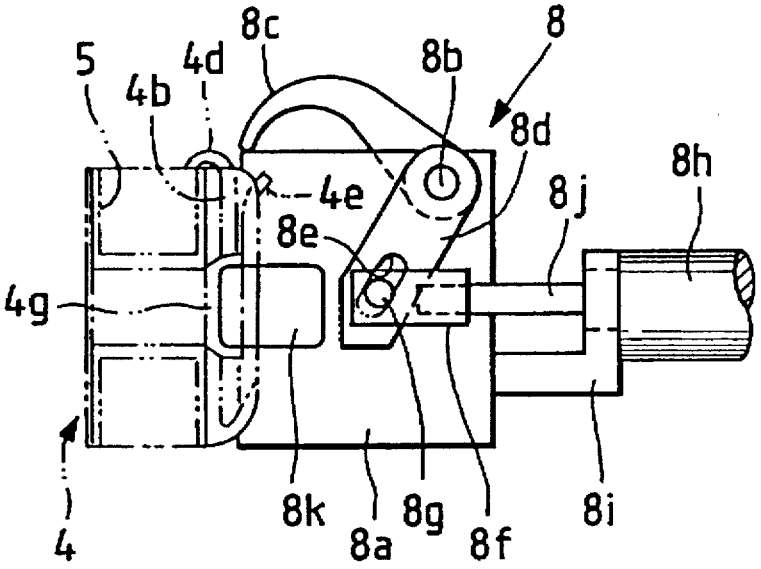
FIG. 38 is an enlarge, partial side view showing a bobbin grasp mechanism used in the bobbin exchanging device in FIG. 12.
Figure 39:
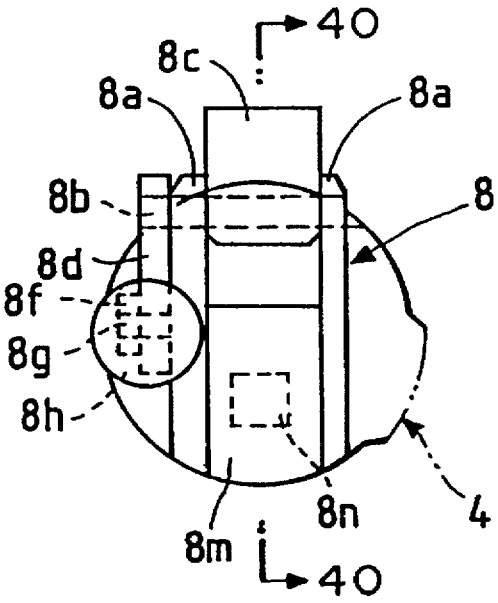
FIG. 39 is an enlarged, partial rear view showing the bobbin grasp mechanism shown in FIG. 38.
Figure 40:
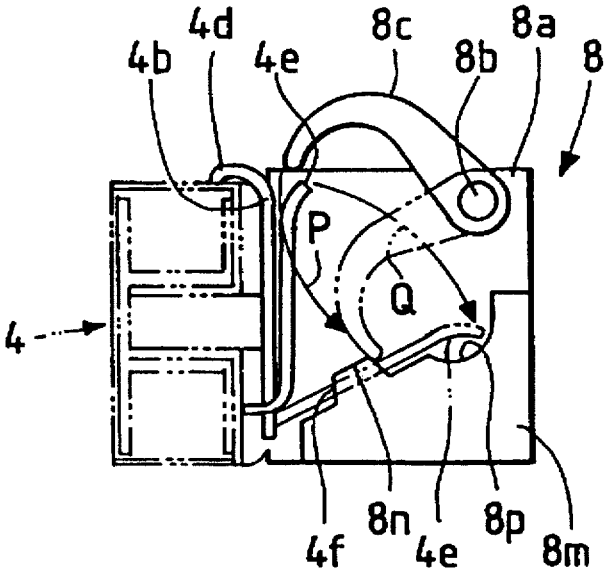
FIG. 40 is an enlarged, partial longitudinal view taken on line 40—40 in FIG. 39, the illustrating showing the operation of the bobbin grasp mechanism shown in FIG. 38.

As shown in FIGS. 38, 39, and 40, a rotary shaft 8b is rotatably supported at the ends by a pair of side plates 8a and 8a arranged substantially parallel to each other. A lever pawl 8c is fastened to the rotary shaft 8b. The lever pawl 8c releases a lock lever 4e of the bobbin case 4 by pulling up the lock lever 4e, which has been at a closed position. One end of the rotary shaft 8b is outwardly protruded from one of the side plates 8a after passing therethrough. A drive arm 8d is fastened at one end to the protruded end of the rotary shaft 8b. A cam groove 8e, longitudinally extended, is formed in the other end part of the drive arm 8d. A pin 8g of a drive die 8f is movably inserted in the elongated cam groove 8e. The drive die 8f is coupled with an output shaft (cylinder rod) 8*j* of an air cylinder 8*h* fastened to the side plate 8*a* by an arm 8*i*. With this structure, a drive force from the air cylinder 8*h* is transmitted through the drive die 8*f*, pin 8*g*, drive arm 8*d*, and rotary shaft 8*b* to the lever pawl 8*c*, so that the lever pawl 8*c* is turned.

The distal end of the lever pawl 8*c* is arcuate in shape. The arcuate distal end of the lever pawl 8*c* is disposed so as to be insertable into an overlapping part where the lock lever 4*e* of the bobbin case 4 and the bobbin locking plate 4*b* overlap. The distal end of the lever pawl 8*c* is turned tracing a locus indicated by a solid line P in FIG. 40. With this turn, the lock lever 4*e* of the bobbin case 4 is turned tracing a locus indicated by a two-dot chain line Q in FIG. 40, thereby to be released.

Each of the side plates 8*a* is rectangular in shape. The side edge of the side plate 8*a*, which is closer to the shuttle 2 (the left side edge in the drawing) is shaped in conformity with the surface configuration of the bobbin case 4. A turn stop plate 8*k* is protruded from the side plate 8*a*. The bobbin case 4 is positioned relative to the bobbin grasp mechanism 8 when the turn stop plate 8*k* is inserted into a concave part 4*g* of the bobbin case 4.

A base member 8*m* is provided between the side plates 8*a*. After released, the lock lever 4*e* rests on the base member 8*m*. At this time, the lock lever 4*e* is at an open position. The lever receiving surface of the base member 8*m*obliquely extends along the lock lever 4*e* set at the opening position (indicated by a two-dot chain line in FIG. 40). A trapezoidal protruded part 8n is formed in the middle of the lever receiving surface of the base member 8*m*. The protruded part 8*n* is to be inserted into a hole 4*f*. An arcuately incurved part 8*p* is formed in another part of the lever receiving surface of the base member, which is higher than the protruded part 8*n*. The arcuately incurved part 8*p* is for receiving the distal end of the lock lever 4*e*. When the lock lever 4*e* rests on the base member 8*m* thus constructed, it is fixedly held in an open state by a pushing force by the lever pawl 8*c*. As a result, the whole bobbin case 4 is grasped.

The bobbin grasp mechanism 8, which is rotatable and movable forward and backward, the arm means 7*j*, and the like make up the arm means.

The bobbin exchanging device 7 is thus constructed.

The automatic under-thread supply apparatus thus constructed further includes a CPU 80 which receives, through an input/output board 76 and a mother board 77, signals derived from a start switch 60 of a sewing machine, a arm-means original position detector 61 for detecting an original position (position A) of the arm means of the bobbin exchanging device 7, a arm-means stop position detector 62 for detecting the respective stop positions (positions B to F) of the arm means, a arm-means advancement detector 63 for detecting an advancement of the arm means, a arm-means retraction detector 64 for detecting a retraction of the arm means, a thread-handling-plate original position detector 65 for detecting an original position (position shown in FIG. 17) of the thread handling plate 30 (cam follower pin 29) of the automatic thread-winding/thread-hooking device 100, a thread-handling-plate reversing detector 66 for detecting the respective reversing positions (positions shown in FIGS. 19 and 31) of the thread handling plate 30, a under thread take-up quantity detector 67 for detecting a quantity of rotation of the take-up motor MC of the automatic thread-winding/thread-hooking device 100, a leftover thread winding motor rotation quantity detector 82 for detecting a quantity of rotation of the leftover thread winding motor MZ, an under-thread consumption detector 81 for detecting a quantity of rotation (number of seams) of the bobbin in the shuttle, a yarn count input switch 68, a yarn type input switch 69, a thread length input switch 70, and a number-of-stitching (number of things to be stitched) input switch 71, and an S.STATE signal indicating a state of operation of the sewing machine, a U.DET indicating that the machine stops in a state that the needle is at the up position, and a reset signal for the CPU of the sewing machine, which are derived from a sewing machine controller 79, transfers signals to a cylinder valve 72 for controlling the operation of the air cylinder 7*h* for moving forward and backward the arm means of the bobbin exchanging device 7, a cylinder valve 73 for controlling the operation of the cylinder for moving the take-up fork 52 of the leftover thread removing device 99 forward and backward, an arm-member set cylinder valve 74 for controlling the operation of the swing lever 13 for moving forward and backward the cylinder 36 of the automatic thread-winding/thread-hooking device 100, and a cylinder valve 75 for controlling the operation of the air cylinder 8*h* for opening and closing the lever pawl 8*c* of the bobbin exchanging device 7, transfers a machine start inhibit signal to the sewing machine controller 79 through the mother board 77 and the input/output board 76, and transfers, through the mother board 77 and a motor drive substrate 78, drive and stop signals to the drive motor 7*f* for turning the arm means in the bobbin exchanging device 7, the leftover thread removal (leftover thread winding) motor MZ in the leftover thread removing device 99, and the take-up motor MC and the take-up motor MC in the automatic thread-winding/thread-hooking device 100.

Figure 1:
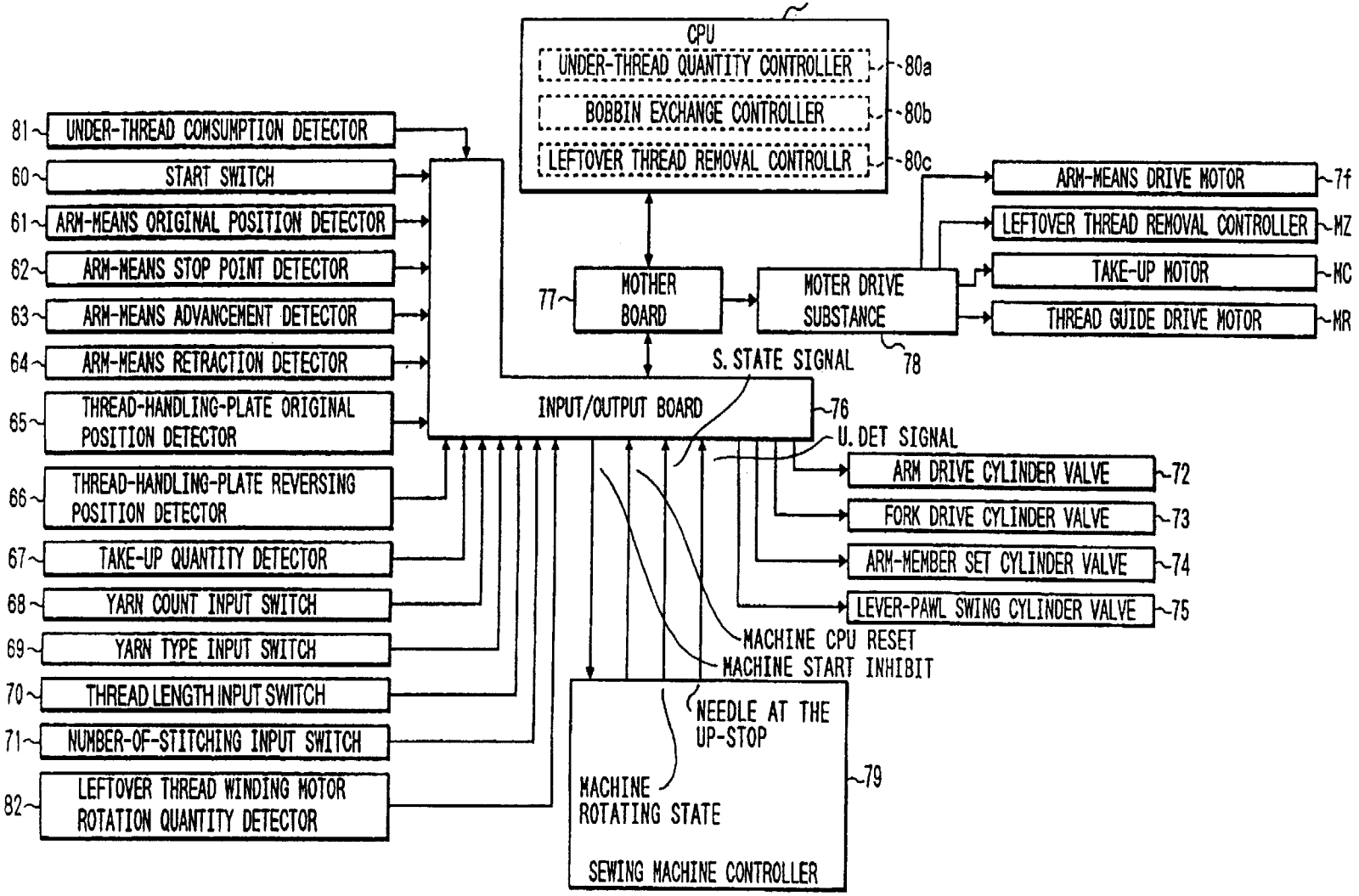
FIG. 1 is a block diagram showing a control system for controlling the operation of an automatic under-thread supply apparatus according to an embodiment of the present invention.
Figure 2:
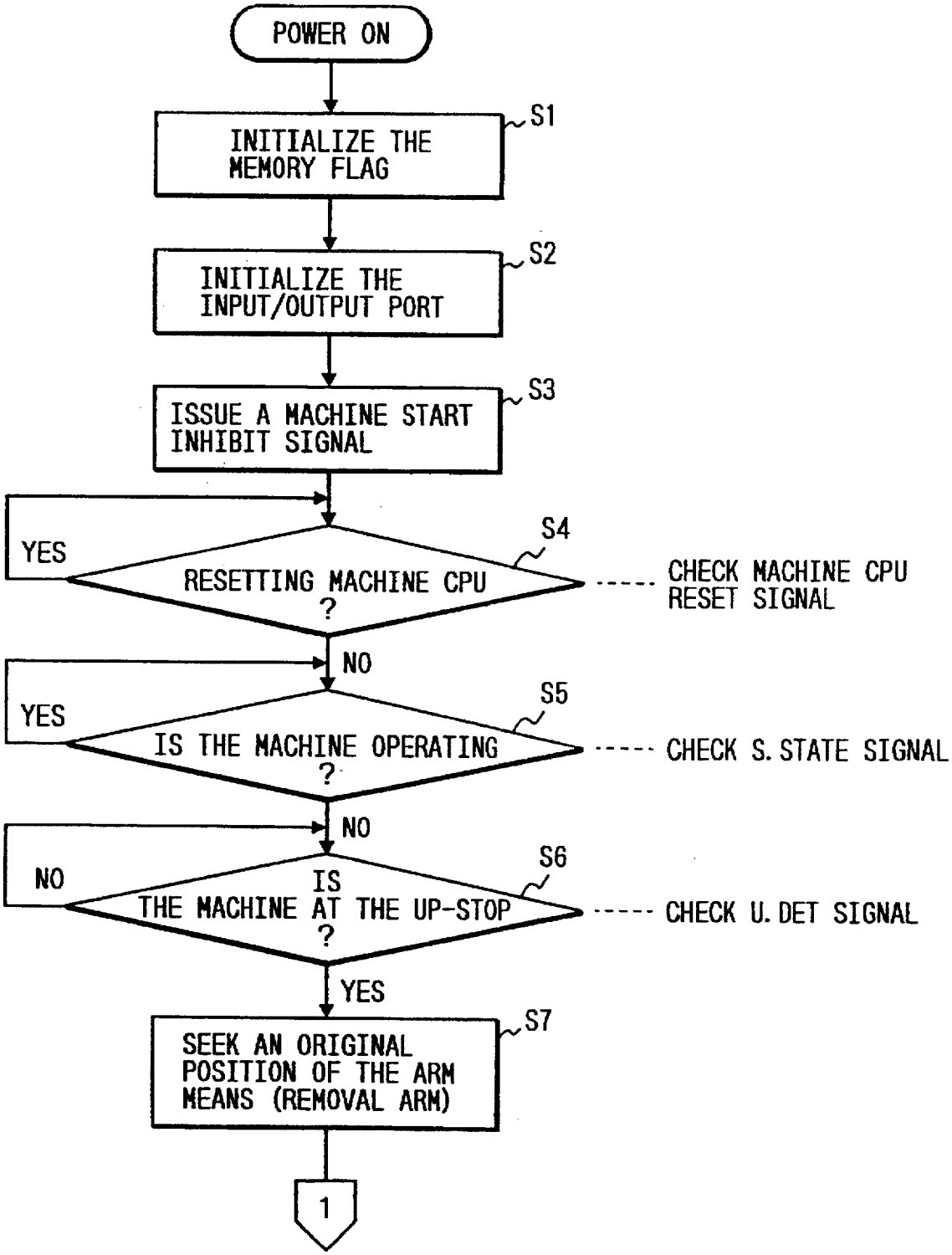
FIG. 2 is a flow chart of a main program stored in a memory of the CPU in the control system of FIG. 1.
Figure 3:
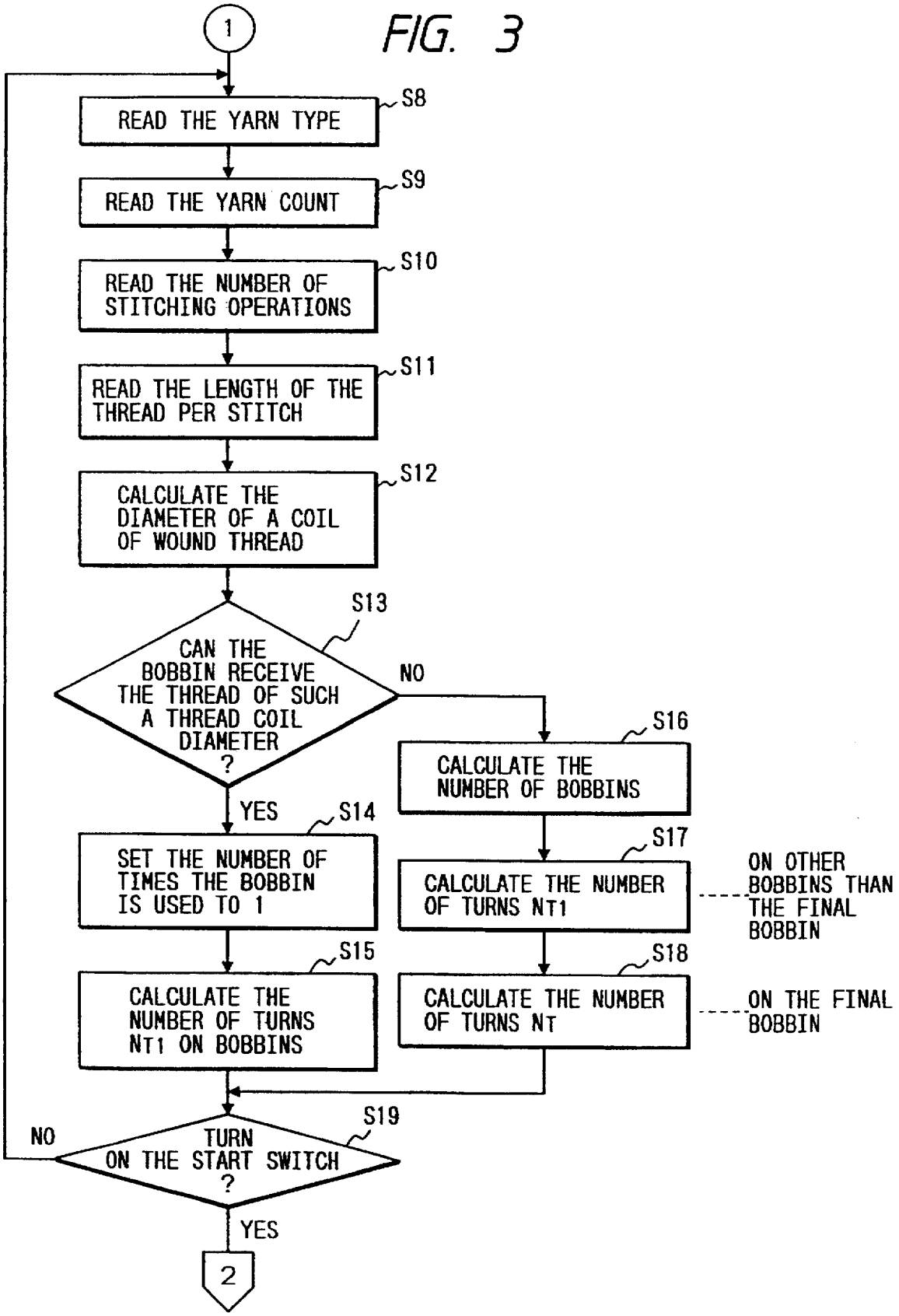
FIG. 3 is a flow chart showing the main program, continued from the flow chart in FIG. 2.

The CPU 80, as shown in FIG. 1, is part of a microcomputer arranged so as to execute the functions equivalent to those of an under-thread quantity controller 80*a* for previously calculating a quantity of winding of an under thread necessary for the bobbin in accordance with stitching conditions, and operating the take-up motor MC till a quantity of under thread actually wound on the bobbin is substantially equal to the previously calculated one, a bobbin exchange controller 80*b* operating such that the bobbin exchange controller recognizes the end of one stitching process by an end signal of the sewing machine, for example, a thread cut signal, and determines whether or not the amount of the under thread necessary for the next process is left on the bobbin in the shuttle on the basis of the amount of under thread on the bobbin or the amount of the consumed under thread, and if the amount of the under thread left on the bobbin is insufficient for the next process, the bobbin exchange controller inhibits the sewing machine from carrying out the stitching operation and causes the bobbin exchanging device to exchange the old bobbin with a new bobbin being full of under thread when the needle-up motion stops, a leftover thread removal controller 80*c* operating such that said leftover thread removal controller moves the old bobbin pulled out of the shuttle to the leftover thread removing device 99, causes the leftover thread removing device to remove the thread still left on the old bobbin from the bobbin, and moves the bobbin to the automatic thread-winding/thread-hooking device 100, and means for causing the machine to carry out other known operations. Necessary programs, set values and data tables are stored in memories in the microcomputer. The programs stored in the memory are illustrated in the form of flow charts in FIGS. 2 to 11.

The operation of the automatic under-thread supply device will be described with reference to the flow charts of the programs.

Upon power on of the sewing machine, the microcomputer on the CPU board starts to operate. In a step S1, the CPU initialize a memory flag and advances to a step S2. In this step, the CPU initialize an input/output port and advances to a step S3. In this step, the CPU outputs a machine start inhibit signal to the sewing machine controller 79, thereby inhibiting the machine to start its operation in response to the pedal down, and goes to a step S4.

In the step S4, the CPU monitors a CPU reset signal from the sewing machine controller 79, and waits till the resetting is completed. After completion of the resetting, control by the CPU goes to a step S5 where the CPU checks if the sewing machine is operating according to an S.STATE signal. After waiting till the machine operation ends, control proceeds to a step S6 where the CPU checks if the needle is at an up-stop using a U.SET signal, and waits till the machine comes to a stop where the needle is at the upper position. Thus, in the steps S5 and S6, the CPU does not advance its control during such a process that the power switch is turned on, the sewing machine stops its operation, and then the needle is at an up-stop.

In this state, viz., the needle is at the up-stop, the CPU advances its control to a step S7. In the step, the arm-means original position detector 61 is driven to seek an original position of the arm means of the bobbin exchanging device 7. The original position is the position of the shuttle (position A in FIG. 13(A)). Control by the CPU goes to a step S8 and the CPU checks the yarn type, e.g., span and filament, using a signal from the yarn type input switch 69, and advances to a step S9. In the step S9, the CPU checks the yarn count of the thread using a signal from the yarn count input switch 68. In the next step S10, the CPU checks the number of things to be stitched using a signal from the number-of-stitching ($N_J$) input switch 71, and then goes to a step S11. In this step, the CPU reads the length of the under thread required for one stitching operation by using the thread length input switch 70.

After the stitching conditions are thus input to the control system in the steps S8 to S11, control goes to a step S12. In this step, the CPU calculates the diameter of a coil of an under thread wound on the bobbin 5 in the following manner.

Figure 14:
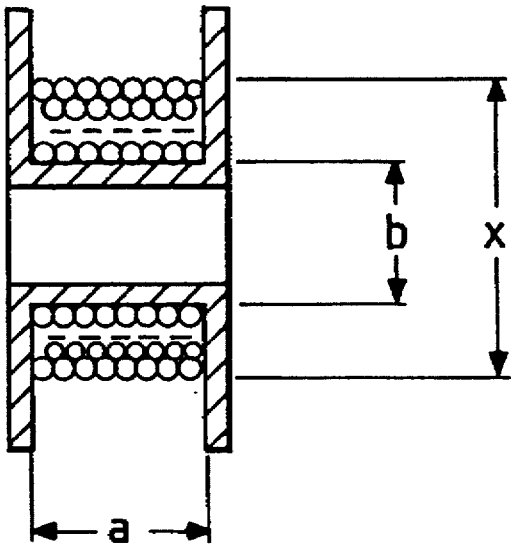
FIG. 14 is a traverse sectional view showing a bobbin with an under thread wound therearound.

The CPU picks up an equivalent cross sectional area ΔS from the related data table using the yarn type and the yarn count of the thread. The number of turns $N_T$ of thread on the bobbin is given by the following equation (1)

$$N_T = \frac{x-b}{2} \times a \times \frac{1}{\Delta S} \tag{1}$$

where x: outer diameter of the thread coil b: inner diameter of the thread coil a: width of the thread coil (see FIG. 14).

The length of the wound thread $N_J \times L$ is given by an equation (2)

$$\begin{aligned} N_J \times L &= \frac{\pi(x+b)}{2} \times N_T \\ &= \frac{\pi(x+b)}{2} \times \frac{x-b}{2} \times a \times \frac{1}{\Delta S} \\ &= \frac{\pi}{4}(x^2-b^2) \times a \times \frac{1}{\Delta S} \end{aligned} \tag{2}$$

Rearranging equation (2) for $x^2-b^2$, we have the following equation (3)

$$x^2 - b^2 = \frac{4}{\pi} \times \frac{\Delta S}{a} \times N_J \times L \tag{3}$$

Then, we have an equation (4) of the coil diameter x from the equation (3)

$$x = \sqrt{\frac{4\Delta S}{a\pi} \times N_J \times L + b^2} \tag{4}$$

After calculating the coil diameter x of the under thread wound on the bobbin 5, control steps forward to a step S13. In this step, the CPU checks if the coil diameter x is within the effective diameter C of the under thread coil. In other words, through this check, the CPU checks whether or not the bobbin is capable of receiving the thread coil of such a diameter. If the coil diameter x is within the effective diameter C, the CPU considers that the bobbin can accommodate the thread coil of the diameter x, and advances to a step S14. In this step, the CPU sets the number of times the bobbin is used to 1, and advances to a step S15 for calculating the number of turns $N_T$ on the bobbin. Substituting the equation (4) into the equation (1), we have the following equation (5) representing the number of turns $N_T$ $$N_T = \frac{a}{2\Delta S}\sqrt{\frac{4\Delta S}{a\pi} \times N_J \times L + b^2} - \frac{ab}{2\Delta S} \tag{5}$$

In the step S13, if the coil diameter x is out of the effective diameter C, the CPU considers that the bobbin cannot accommodate the thread of the coil diameter x, and jumps to a step S16. In this step, the CPU calculates the number of bobbins.

The length Lmax of the thread when it is wound on the bobbin 5 to the full is given by an equation (6)

$$L_{max} = \frac{\pi}{4}(c^2-b^2) \times a \times \frac{1}{\Delta S} \tag{6}$$

The number of stitching operations $n_J$ (natural number) for one bobbin is given by the following equation $$n_J = L_{max}/L.$$

Accordingly, the number of bobbins can be expressed as $N_J/n_J$. If $N_J/n_J$ is not a natural number, a number that is obtained by discarding the fractional part of the quotient and adding one to the result is used for the number of bobbins. Accordingly, in this case, the amount of the wound thread on the final bobbin is different from that on the remaining ones.

After the number of bobbins is calculated, control by the CPU goes to a step S17. In this step, the CPU calculates the number of turns $N_{T1}$ on the bobbins other than the final bobbin. The number of turns $N_{T1}$ is expressed by an equation (7)

$$N_{T1} = \frac{a}{2\Delta S}\sqrt{\frac{4\Delta S}{a\pi} \times n_J \times L + b^2} - \frac{ab}{2\Delta S} \tag{7}$$

A process of the next step S18 for calculating the number of turns $N_T'$ on the final bobbin is then executed by the CPU. The number of turns $N_T'$ on the final bobbin is given by the following equation (8)

$$N_T' = \frac{a}{2\Delta S}\sqrt{\frac{4\Delta S}{a\pi} \times n_J' \times L + b^2} - \frac{ab}{2\Delta S} \tag{8}$$

where $n_J'$: number of stitching operations for the final bobbin.

After calculating the number of turns on the bobbins in the steps S15 and S18, the CPU executes a process of a step S19. In this step, the CPU checks if the start switch 60 on the panel has been turned on. If it is not turned on, control returns to the step S8, and executes again the processes of the step S8 and the subsequent ones. In the step S19, if the start switch 60 has been turned on, the automatic under-thread supply apparatus starts to operate.

At the present, the arm means in the bobbin exchanging device 7 grasps the bobbin at two positions thereof (for ease of explanation, a bobbin which has undergone a stitching process and has still a small amount of the thread left thereon is denoted as α, and a new bobbin with a full coil of thread wound thereon is called as β). More exactly, the bobbin is grasped with the arm means in such a manner that the bobbin grasp mechanism 8 is pressed against the bobbin case 4, the lever pawl 8*c* is turned in the closing direction (downward in FIG. 40) by the air cylinder 8*h*, and in turn the lever pawl 8*c* releases the lock lever 4*e* of the bobbin case 4 and pushes the lock lever 4*e* against the base member 8*m*.

In a step S20, control by the CPU turns the drive motor 7*f* (at the steps of 60° ) of the arm means to turn the bobbin α to the winding position (position E). A stop point is detected by counting a preset number of pulses generated by the arm-means stop point detector 62 after arm-means original position detector 61 generates a pulse. In the step S20, when the bobbin α reaches the winding position (position E), control advances to steps S21 and 22. In the step S21, the CPU drives the related means to wind a preset amount of an under thread around the bobbin α, and stores the amount of the wound thread in the memory, and in the step S22 the CPU drives the related devices to hook the thread to the bobbin case and to cut the thread.

Figure 10:
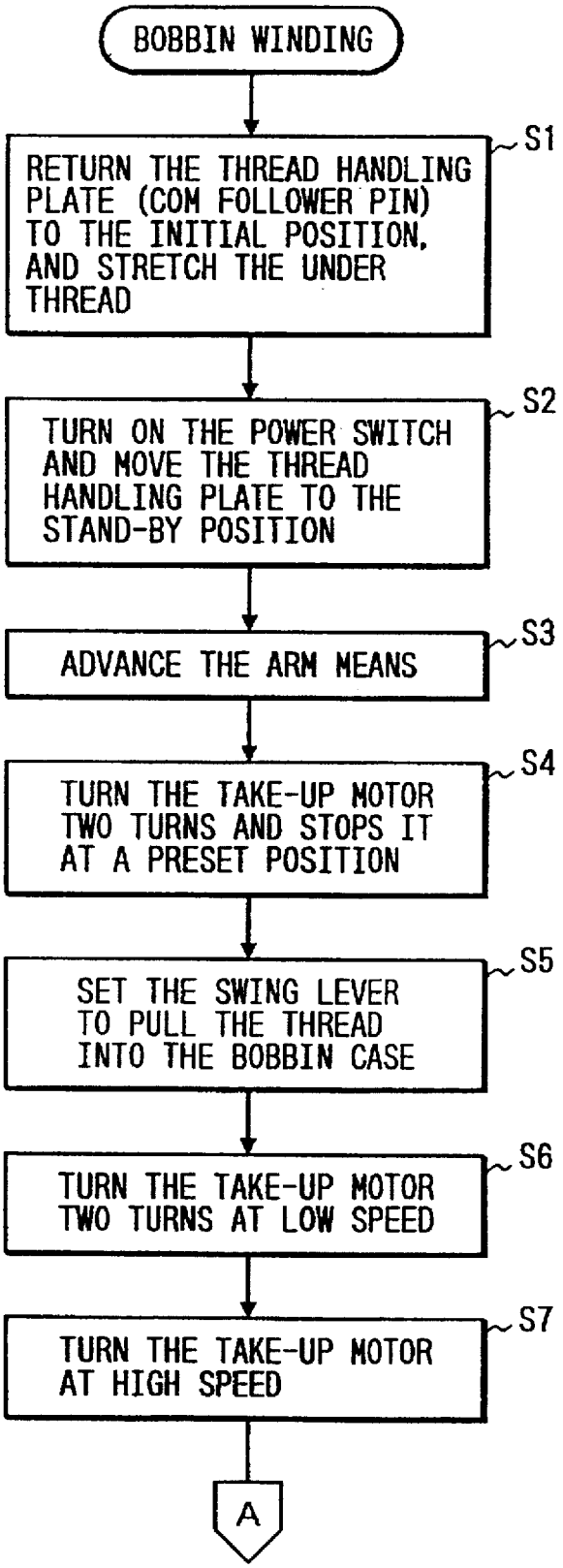
FIG. 10 is a flow chart showing a program for an automatic thread winding for the bobbin and a thread hooking, stored in the memory of the CPU in FIG. 1.
Figure 11:
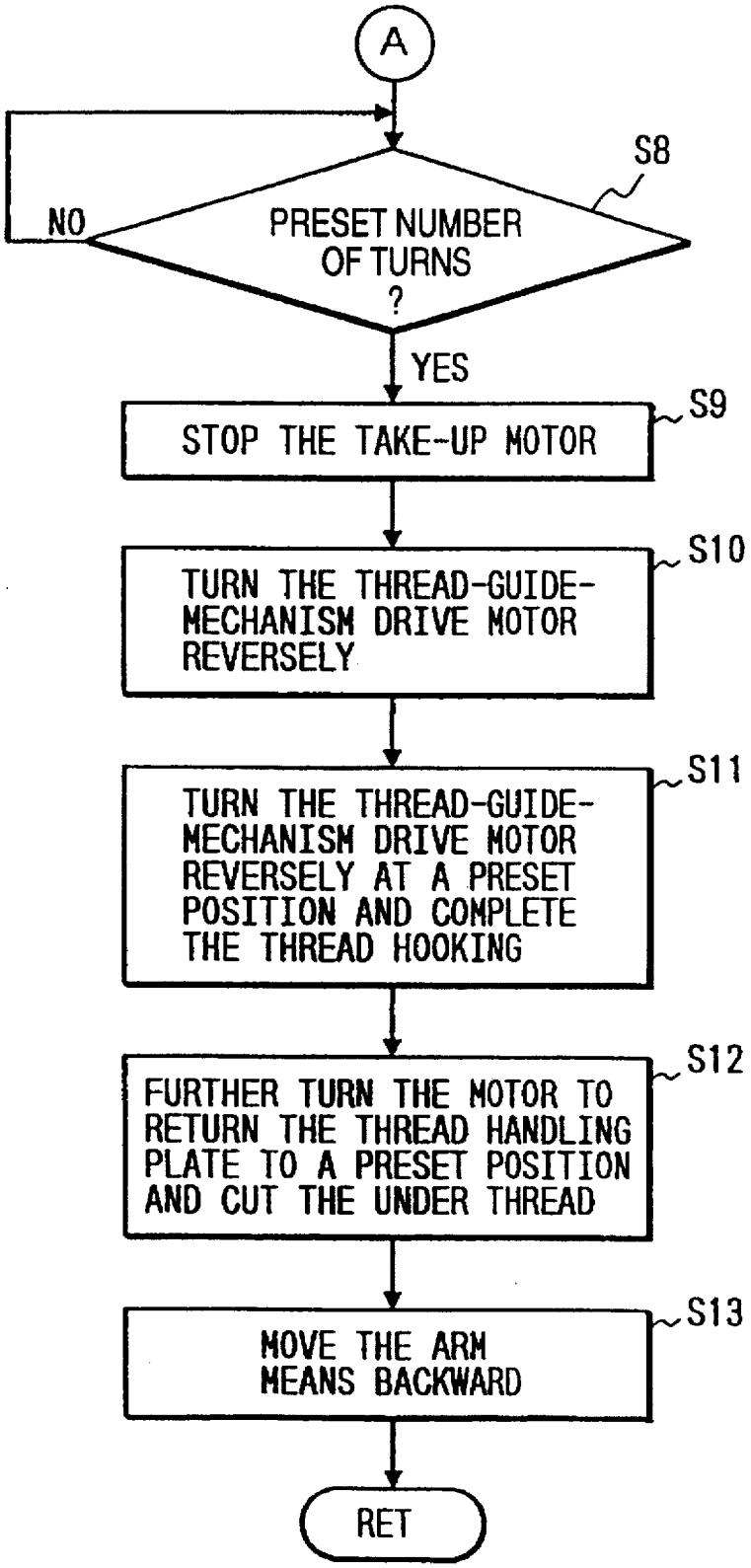
FIG. 11 is a flow chart continued from the flow chart shown in FIG. 10.

The operations of the steps S21 and S22 are flow charted as shown in FIGS. 10 and 11. The operations of these steps will be described with reference to FIGS. 10 and 11.

In a step S1, the cam follower pin 29 of the automatic thread-winding/thread-hooking device 100 is set to an initial position in the cam groove 33 (FIG. 17). An under thread 46 to be wound around the bobbin 5 is pulled out of a spool 45. The thread is guided through the thread guide hole 31*c* formed in the flat plate 31*a* and laid on the V-shaped cutout 31*d* of the flat plate 31*b* (FIGS. 17 and 18).

Control by the CPU advances to a step S2. In this step, the power source of the device is turned on. Upon power on, the thread guide drive motor MR starts to turn counterclockwise in FIG. 15, while the spline shaft 22 starts to turn clockwise. The cam follower pin 29 coupled with the spline nut 24 is moved from the position shown in FIG. 17 to the position shown in FIG. 19 while being guided by the cam groove 33. At this time, the thread-end hold plate spring 30*f* of the thread handling plate 30 has reached a location facing the flat plate 31*b* of the U-shaped portion 31A. Accordingly, the thread end of the under thread 46 is nipped by the flat plate 31*b* and the thread-end hold plate spring 30*f*. In this state, the under thread 46 is stretched between the flat plates 31*a* and 31*b* of the U-shaped portion, and placed in a stand-by state.

Control by the CPU advances to a step S3. In this step, the output shaft 7i of the air cylinder 7h in the bobbin exchanging device 7 is moved to the left in FIG. 12, and pushes the bobbin 5 against the clutch disc 17*a*. Control advances to a step S4 where the take-up motor MC is turned, a clutch pin (not shown) is inserted into a corresponding hole of the bobbin. As a result, the bobbin 5 is coupled with the clutch disc 17*a* and the motor is stopped at a preset position. The stop of the motor at a preset position may be realized by the combination of a magnet or an optical reflecting piece attached to the motor shaft MC1 of the take-up motor MC and a Hall element or a photo sensor (take-up quantity detector 67) (these elements are not illustrated).

At this time, the opening 4*a* of the bobbin case 4 is located at such a position where it allows the distal end 13*a* of the swing lever 13 to pass therethrough when the swing lever 13 is turned.

Figure 21:
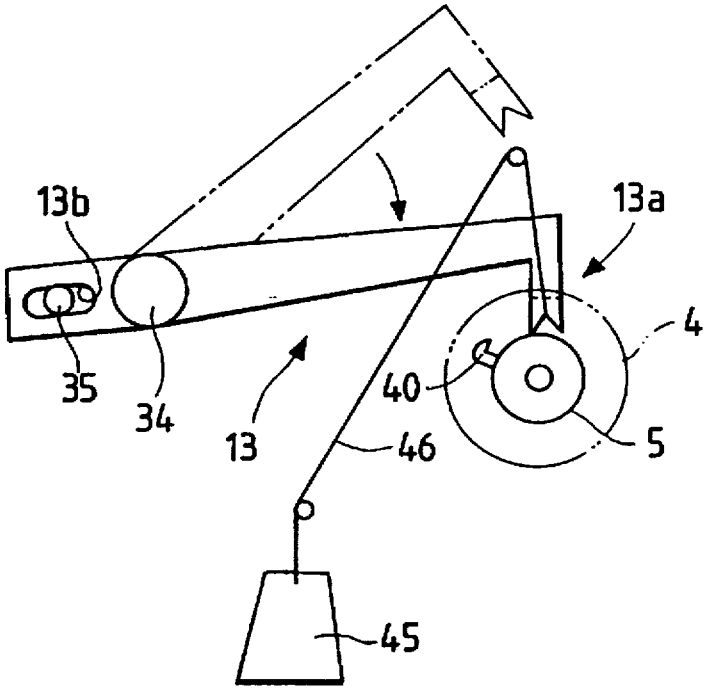
FIG. 21 is a schematic diagram showing the structure shown in FIG. 16, the illustration showing an operation of an arm member for inserting a lower thread stretched by a lower thread stretching member up to a location near the bobbin shaft.

In this state, control proceeds to a step S5 where the swing lever 13 is set to a preset position. More exactly, the cylinder head 36*a* of the cylinder 36 is moved upward in FIG. 16 to turn the swing lever 13 about the pin 34 clockwise. Then, the distal end 13*a* of the swing lever 13 catches the under thread 46 stretched between the flat plates 31*a* and 31*b* as shown in FIGS. 21 and 22. The swing lever 13 is further turned, so that the distal end 13*a* with the thread caught thereby passes through the opening 4*a* of the bobbin case 4, and reaches a location near the outer surface of the bobbin shaft 5*a* and stops thereat. At this time, with the turn of the swing lever 13, a force exerts so as to pull a part of the thread closer to the thread end to the bobbin shaft 5*a*. However, the thread end of the under thread 46 has been nipped by the flat plate 31*b* and the thread-end hold plate spring 30*f*. The nip force is larger than the pulling force to the bobbin shaft 5*a*. Therefore, the under thread 46 supplied from the under thread 46 is pulled in.

When the swing lever 13 stops, control goes to a step S6 where the take-up motor MC is turned two times at low speed, and the bobbin 5 coupled with the clutch shaft 17 is turned by the clutch disc 17*a*. In turn, the thread hooking member 40, shaped like a hook, of the bobbin 5 is turned to catch the under thread that is stretched between the side plates of the distal end 13*a* of the swing lever 13. The under thread caught by the thread hooking member 40 progressively enters the V-shaped groove 5*b* located behind the thread hooking member 40.

Figure 25:
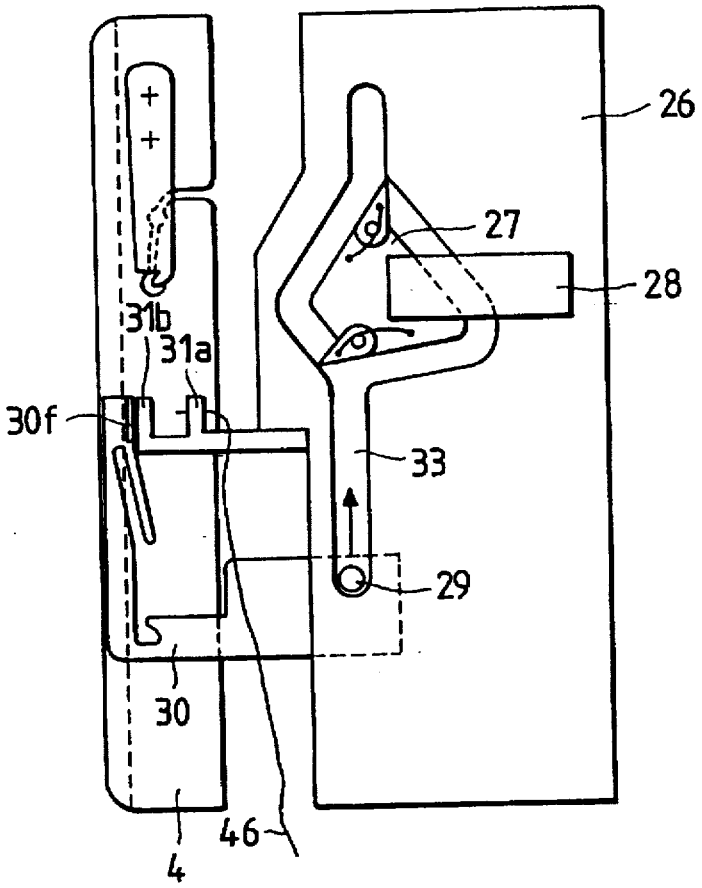
FIG. 25 is a plan view showing a tubular groove cam, a bobbin case, and a thread handling plate when the thread has been wound on a bobbin.
Figure 26:
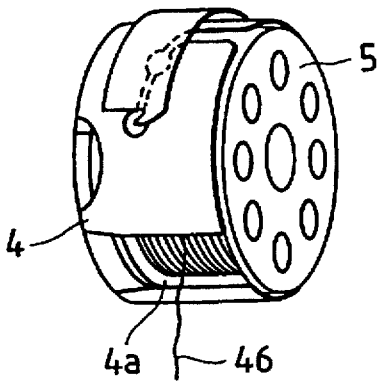
FIG. 26 is a perspective view showing the bobbin case, the illustration showing a relationship between the wound under thread and the bobbin case in the state of FIG. 25.

As already referred to, the V-shaped groove 5*b* in the thread end part is deeper than that in the thread supply part. Accordingly, as shown in FIG. 24, the thread is progressively wound in a state that the thread in the thread end part is layered under the thread in the thread supply part. A binding force developed by the under thread in the thread supply part is larger than the nip force applied to the thread in the thread end part. As a result, the thread in the thread end part is pulled into the bobbin case. Thereafter, the thread in the thread end part pulled into the bobbin case is also held by the thread in the thread supply part, with the rotation of the bobbin 5. The under thread 46 is progressively wound around the bobbin 5, in a state that the under thread in the thread end part is fixedly fixed to the bobbin shaft. This operation is substantially achieved by turning the take-up motor MC two times at low speed. Control flows to a step S7. In this step, the take-up motor MC is turned at high speed. The quantity of the motor turn is detected by the take-up quantity detector 67 (including the Hall element and the photosensor). Control advances its control step to a step S8. In this step, the CPU determines whether or not the measured quantity of motor turn is equal to that (a preset number of turns) calculated in the control step already referred to. If those quantities are not equal, the process is repeated till the quantities are equal to each other. If the quantities are equal, control advances to a step S9. In this step, the take-up motor MC is stopped (see FIGS. 25 and 26).

After a preset amount of under thread is wound around the bobbin 5, control goes to a step S10. In this step, the operation of hooking the under thread to the bobbin case 4 starts.

In the step S10, the thread guide drive motor MR is turned in the direction, which is opposite to the direction of the motor rotation before the stand-by mode. Then, the cam follower pin 29 is moved upward in the drawing, from the position shown in FIG. 25, while being guided by the cam groove 33. The cam follower pin reaches the lower (as viewed in the drawing) bifurcated part of the cam groove 33, and is turned to the upper right by the U-shaped portion 31A. The thread handling plate 30 moves with the movement of the cam follower pin 29. The under thread 46 derived from the bobbin 5 is hooked by the second extended part 30*c* of the thread handling plate and pulled to the right in the drawing, as shown in FIGS. 27 and 28.

Figure 27:
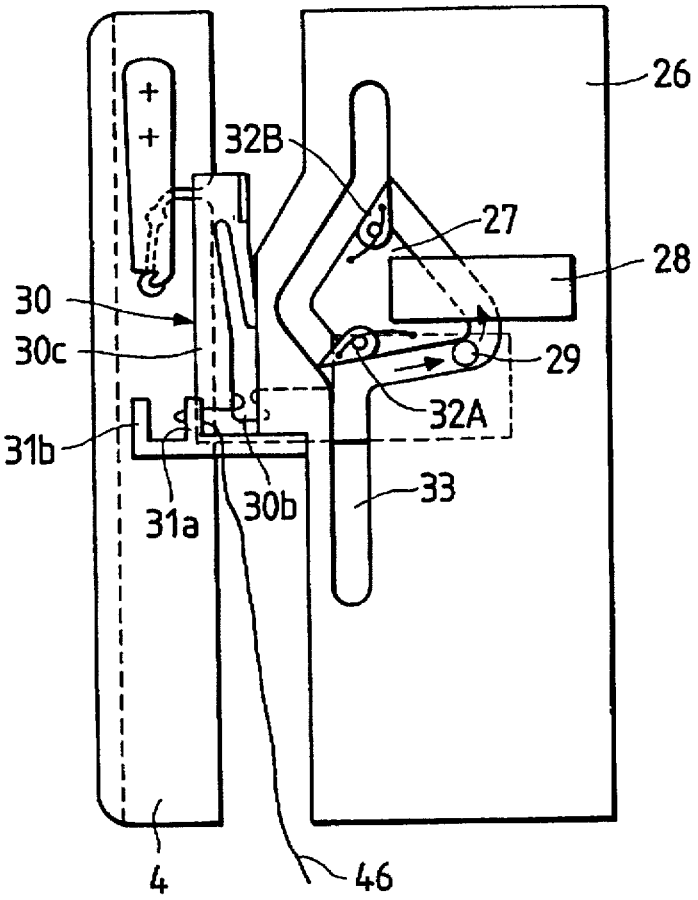
FIG. 27 is a plan view showing a tubular groove cam, a bobbin case, and a thread handling plate when the thread handling plate is moved in FIG. 25.
Figure 28:
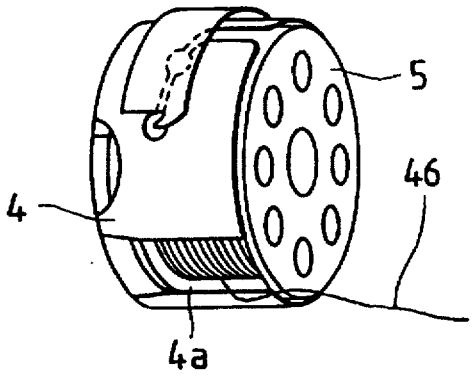
FIG. 28 is a perspective view showing the bobbin case, the illustration showing a relationship between the wound under thread and the bobbin case in the state of FIG. 26.
Figure 30:
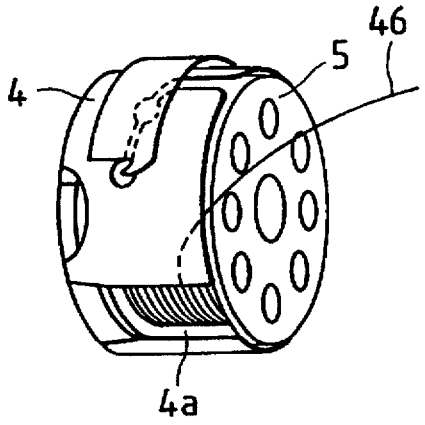
FIG. 30 is a perspective view showing the bobbin case, the illustration showing a relationship between the wound under thread and the bobbin case in the state of FIG. 29.

The cam follower pin 29 is guided to the upper left by the cam groove 33, from the position shown in FIG. 27, and reaches a point just before the upper bifurcated part of the cam groove 33 in the drawing. The thread handling plate 30 moves with the movement of the cam follower pin 29, and the under thread 46 pulled to the right out of the bobbin 5 is seized by the seized-thread receiving part 30*b*, and is further moved to the upper right. As a result, it is derived out through a gap between the bobbin case 4 and the bobbin 5, as shown in FIG. 30.

Figure 29:
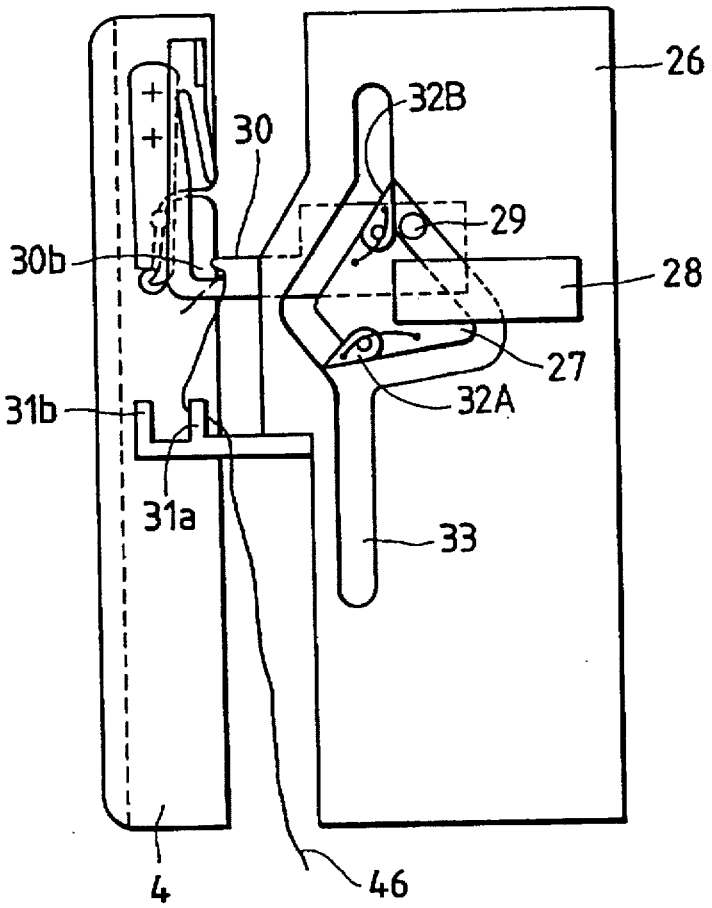
FIG. 29 is a plan view showing a tubular groove cam, a bobbin case, and a thread handling plate when the thread handling plate is further moved in FIG. 27.

The cam follower pin 29 passes the upper bifurcated part in the drawing while being guided by the cam groove 33, from the position shown in FIG. 29, and further travels upward in the drawing. The thread handling plate 30 moves with the movement of the cam follower pin 29, and the under thread 46 derived through the gap between the bobbin case 4 and the bobbin 5 is further moved upward while being seized by the seized-thread receiving part 30b, and is well inserted into a slit groove 4*b* of the bobbin case 4.

Figure 31:
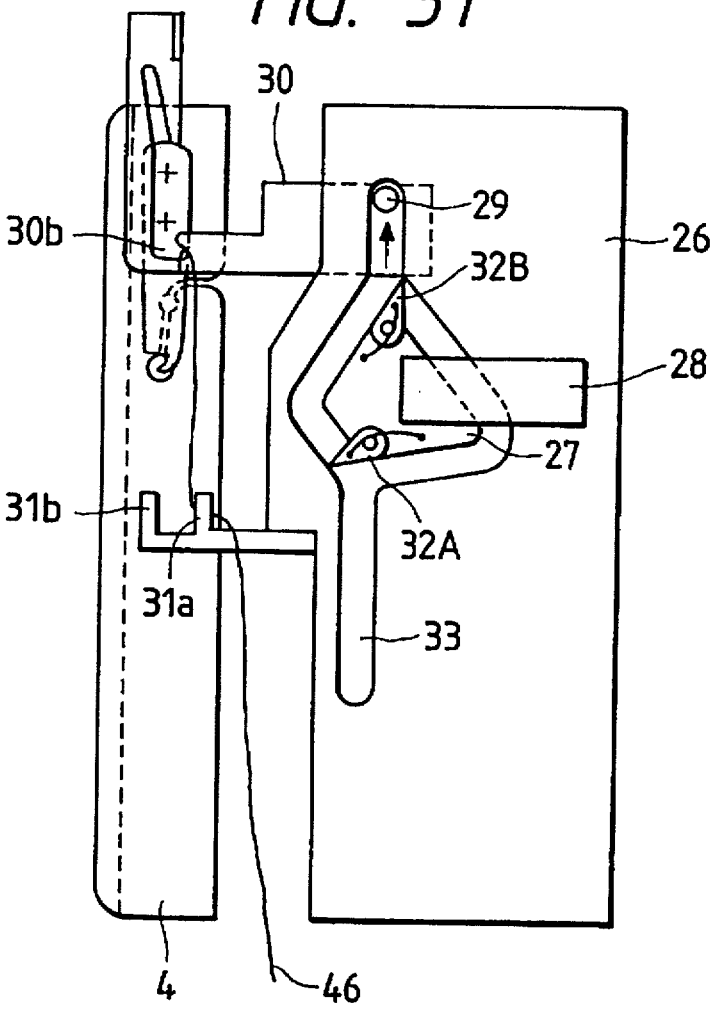
FIG. 31 is a plan view showing a tubular groove cam, a bobbin case, and a thread handling plate when the thread handling plate is further moved in FIG. 29.
Figure 32:
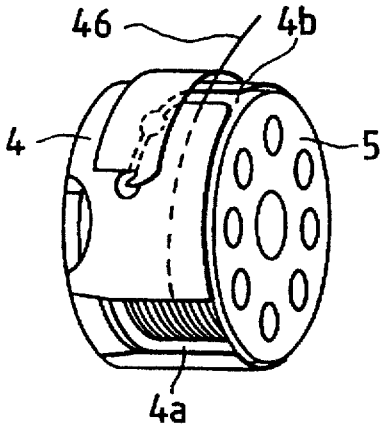
FIG. 32 is a perspective view showing the bobbin case, the illustration showing a relationship between the wound under thread and the bobbin case in the state of FIG. 31.

When the cam follower pin 29 reaches the position shown in FIG. 31, the CPU receives a signal from the thread-handling-plate reversing position detector 66, and advances its control to a step S11. In this step, the thread guide drive motor MR is reversely turned, so that the thread hooking operation terminates. This operation is carried out in the following manner.

When the thread guide drive motor MR is turned reversely, the cam follower pin 29 is moved from the position shown in FIG. 31 to the upper bifurcated part in the drawing, while being guided by the cam groove 33. At this bifurcated part, the check guide valve 32B turns the traveling cam follower pin 29 to the lower left. The thread handling plate 30 moves with the movement of the cam follower pin 29, and the under thread 46 derived through the slit groove 4*b* from the bobbin 5 is further moved to the left while being seized by the seized-thread receiving part 30b. Then, it reaches an under-thread take-out hole 4*c* of the bobbin case 4. At this point, the operation of hooking the under thread to the bobbin case 4 terminates.

Figure 33:
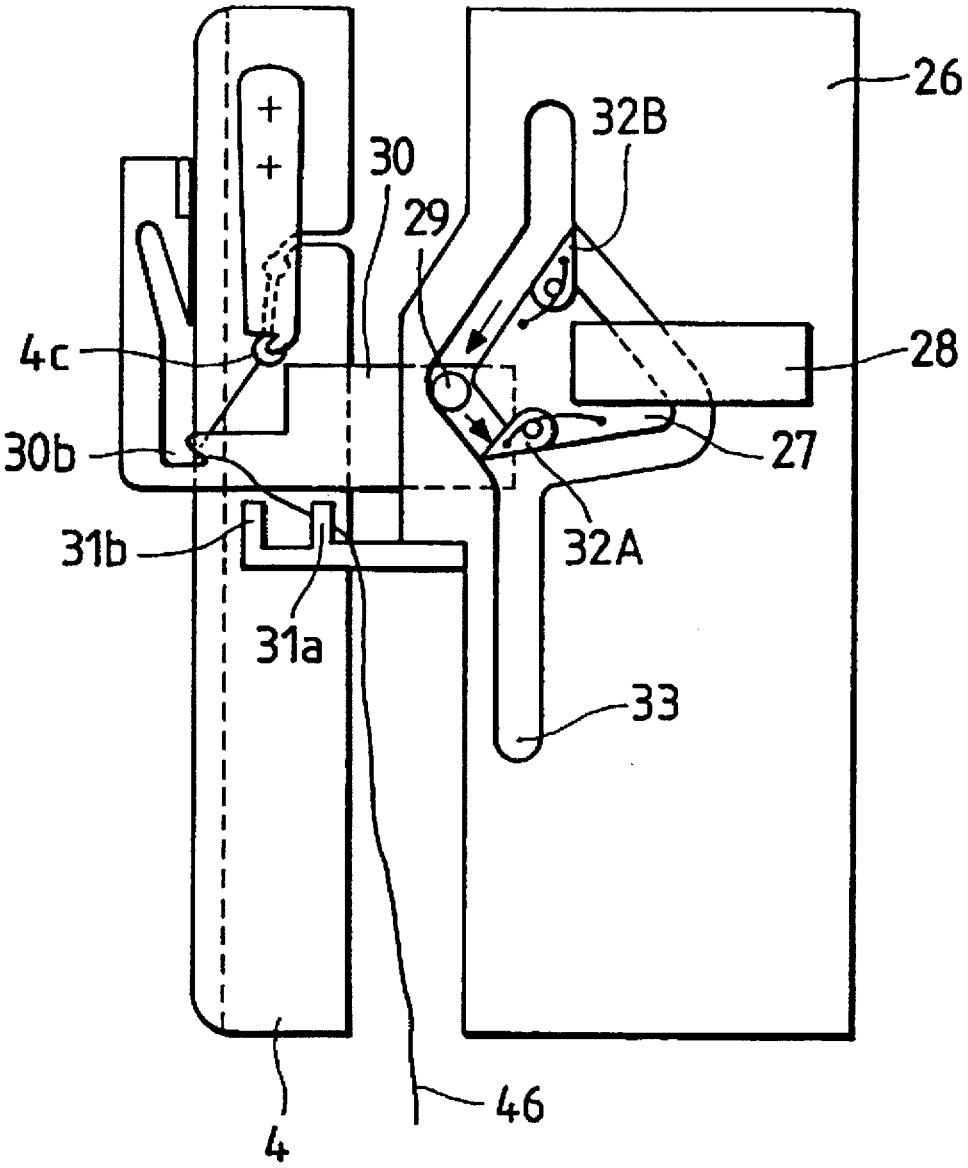
FIG. 33 is a plan view showing a tubular groove cam, a bobbin case, and a thread handling plate when the thread handling plate is further moved in FIG. 31.

Following this, control advances to a step S12. In this step, the thread guide drive motor MR is turned successively. Subsequently, control enters a thread cutting process. In this process, the cam follower pin 29 is moved from the position shown in FIG. 33 to the lower left along the path of the cam groove 33. It passes the lower bifurcated part and takes the course directed downward in the drawing. The thread handling plate 30 moves with the movement of the cam follower pin 29, and the under thread 46 derived through the under-thread take-out hole 4*c* is further moved downward while being seized by the seized-thread receiving part 30*b* (FIG. 34), and caught by the thread guide groove 30*d*.

Figure 34:
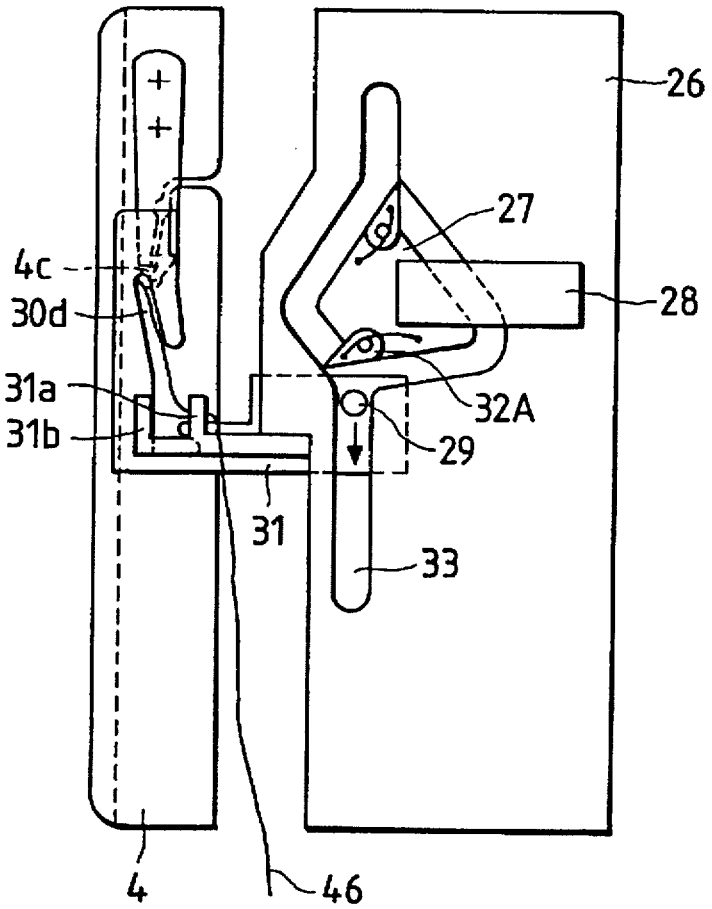
FIG. 34 is a plan view showing a tubular groove cam, a bobbin case, and a thread handling plate when the thread handling plate is further moved in FIG. 33.
Figure 35:
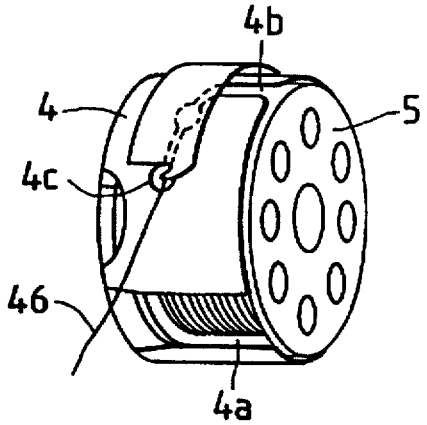
FIG. 35 is a perspective view showing the bobbin case, the illustration showing a relationship between the wound under thread and the bobbin case in the states of FIGS. 33 and 34.
Figure 36:
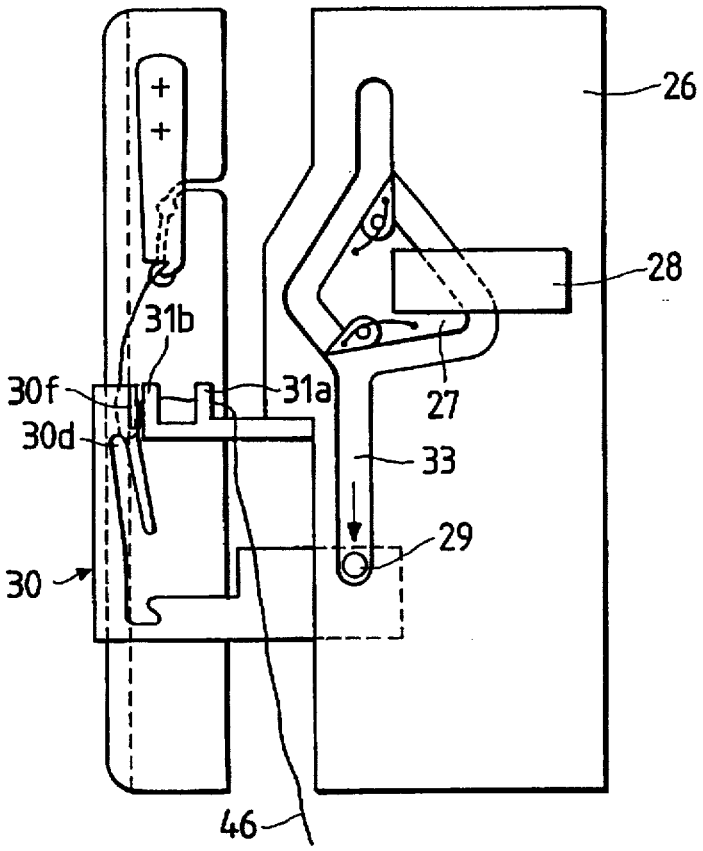
FIG. 36 is a plan view showing a tubular groove cam, a bobbin case, and a thread handling plate when the thread handling plate is further moved in FIG. 34.
Figure 37:
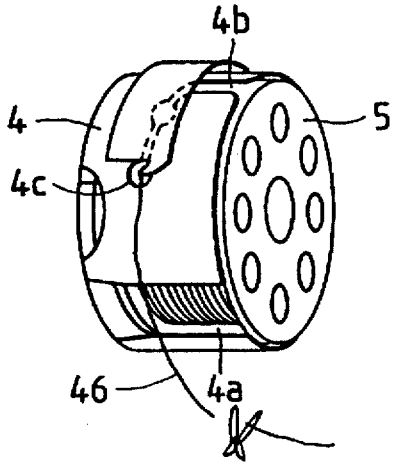
FIG. 37 is a perspective view showing the bobbin case, the illustration showing a relationship between the wound under thread and the bobbin case in the state of FIG. 36.

The cam follower pin 29 advances downward in the drawing along the path of the cam groove 33, from the position shown in FIG. 34, and returns to the stand-by position shown in FIG. 19. The thread handling plate 30 moves with the movement of the cam follower pin 29, and the thread-end hold plate spring 30*f* of the thread handling plate 30 moves to the location facing the flat plate 31*b* of the U-shaped portion 31A, and stops there. Accordingly, the under thread 46 taken out through the under-thread take-out hole 4*c* of the bobbin case 4, as shown in FIG. 36, is moved downward while being seized by the thread guide groove 30*d*, and caught by he V-shaped cutout 31*d* formed in the flat plate 31*b*. As a result, the under thread 46 is stretched between the flat plates 31*a* and 31*b* (FIG. 18).

At this time, the under thread 46 take out through the under-thread take-out hole 4*c* of the bobbin case 4, as shown in FIG. 18, is laid out such that it passes right under (in the drawing) the movable cutter 30*e* formed in the inner side of the thread guide groove 30*d*, is turned back at the bifurcated part of the thread guide groove 30*d*, and derived to outside the outer surface of the thread handling plate 30. Further, the movable cutter 30*e* reaches a position facing the tip of the fixed cutter 37, as shown in FIG. 20. Accordingly, the supplied thread is cut by the cooperation of the tip of the fixed cutter 37 with the movable cutter 30*e*.

After the under thread is thus cut, control proceeds to a step S13. In this step, the arm means is moved backward to remove the coupling of the clutch disc 17*a* and the bobbin.

In the automatic thread-winding/thread-hooking device 100, during the drive of the thread guide drive motor MR, viz., the hooking operation to the bobbin case 4, a low power is supplied to the take-up motor MC, the power being lower than in the mode to wind the thread on the bobbin 5. Because of this, the motor will turn at low speed, so that a force to take up the thread is generated. Accordingly, a tension of the under thread 46 is kept constant.

Figure 4:
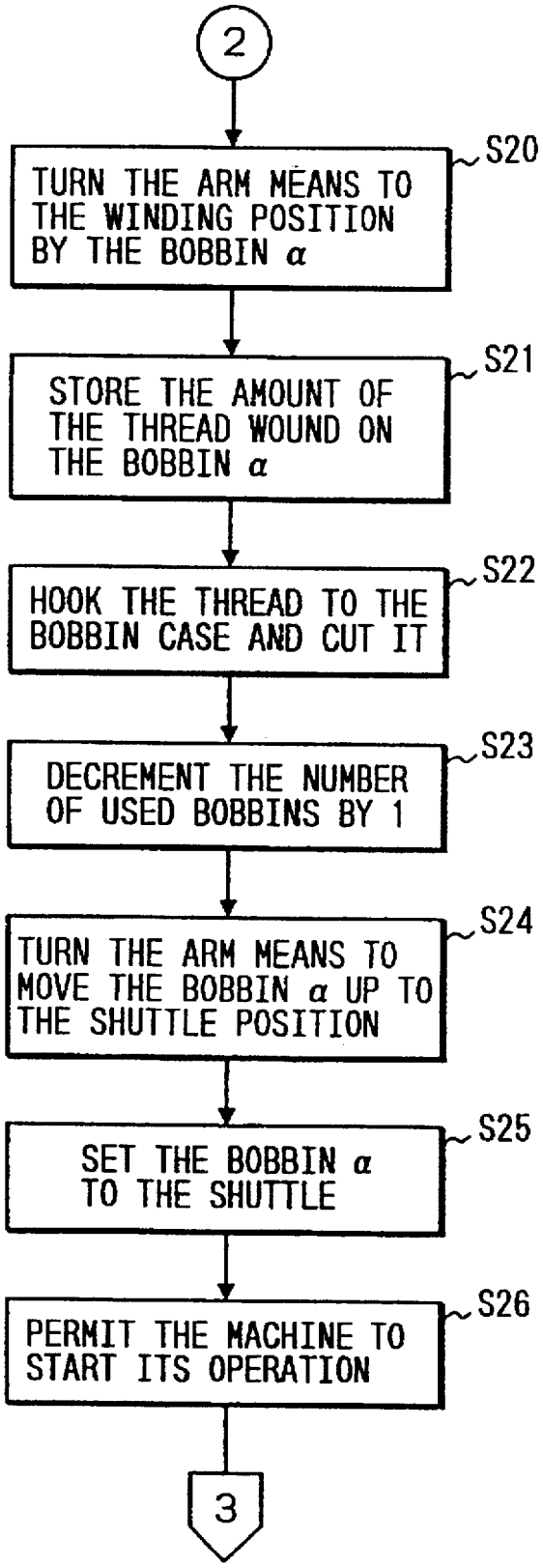
FIG. 4 is a flow chart showing the main program, continued from the flow chart in FIG. 3.
Figure 6:
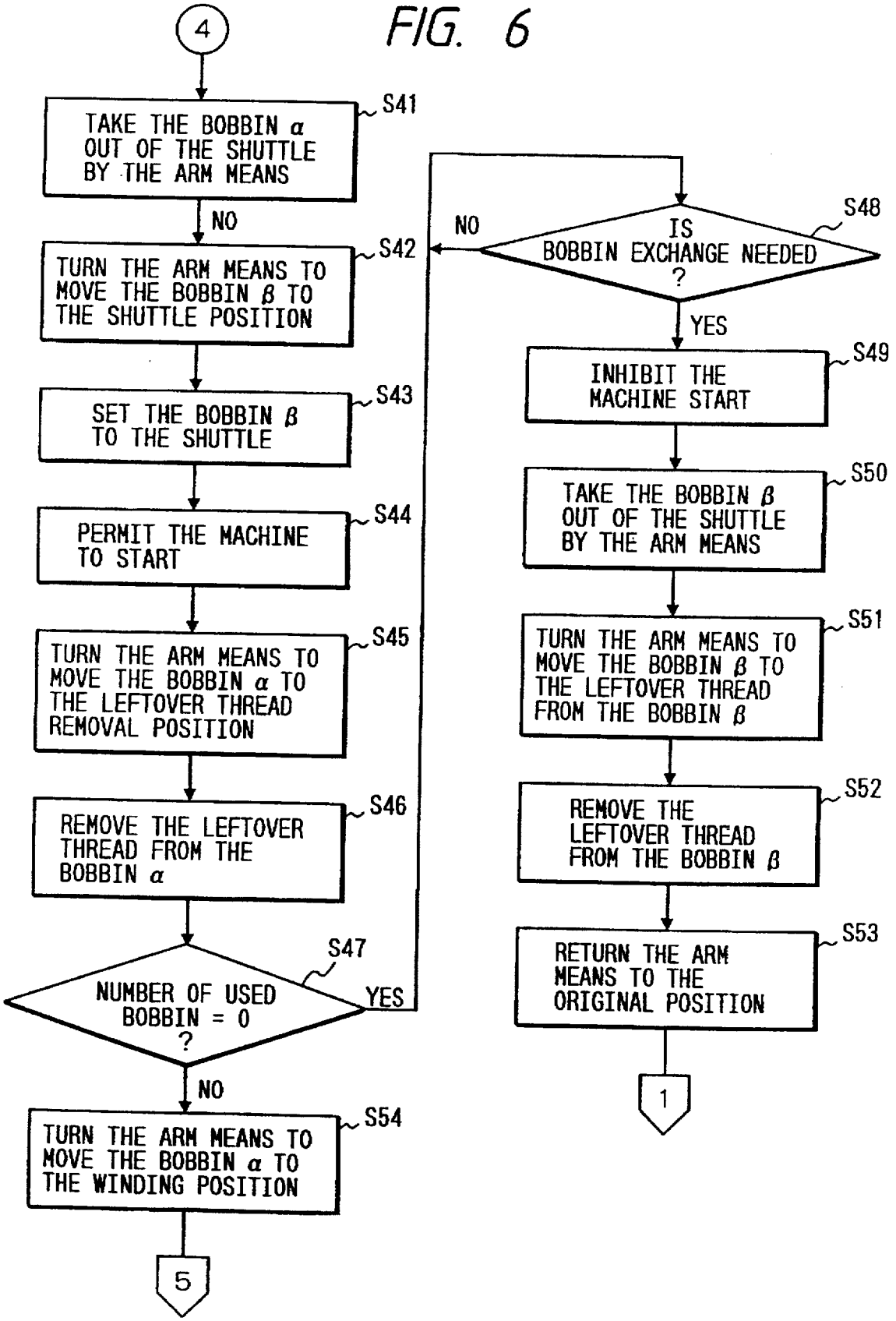
FIG. 6 is a flow chart showing the main program, continued from the flow chart in FIG. 5.
Figure 7:
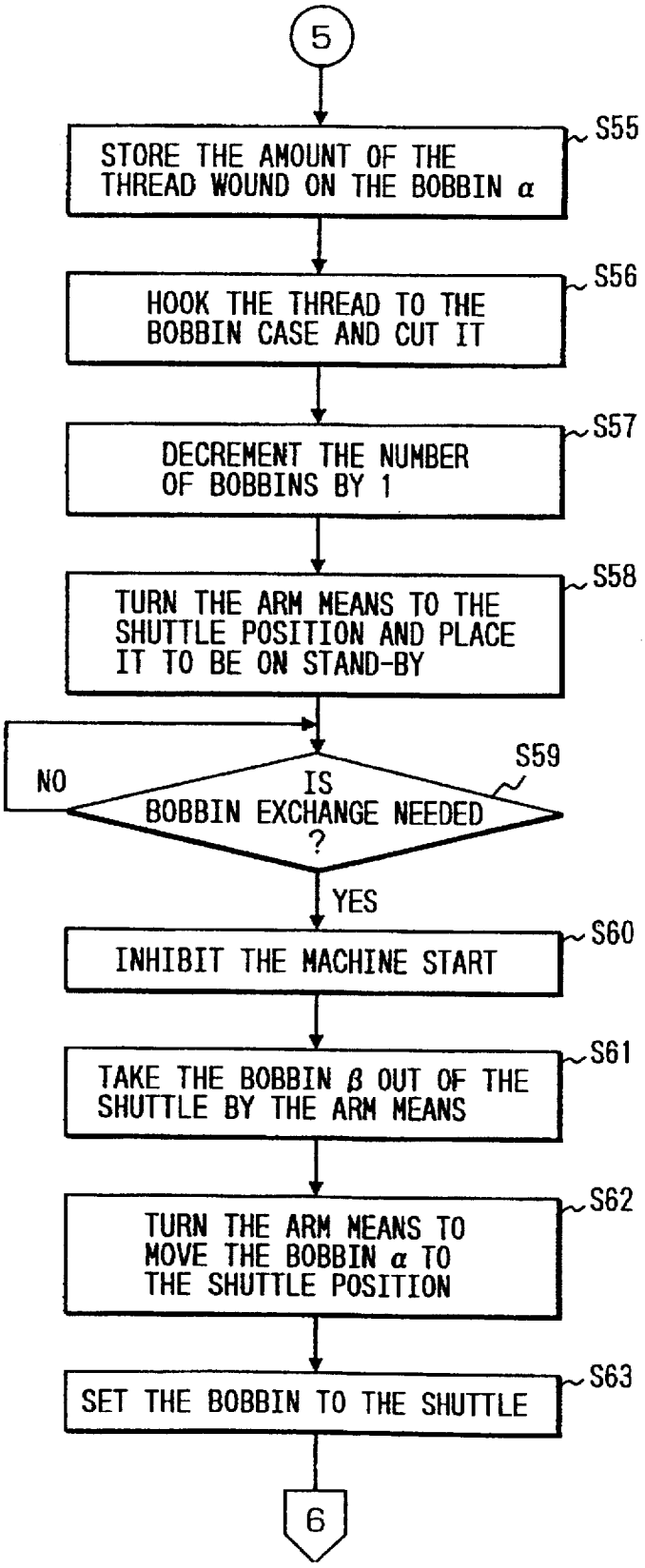
FIG. 7 is a flow chart showing the main program, continued from the flow chart in FIG. 6.
Figure 8:
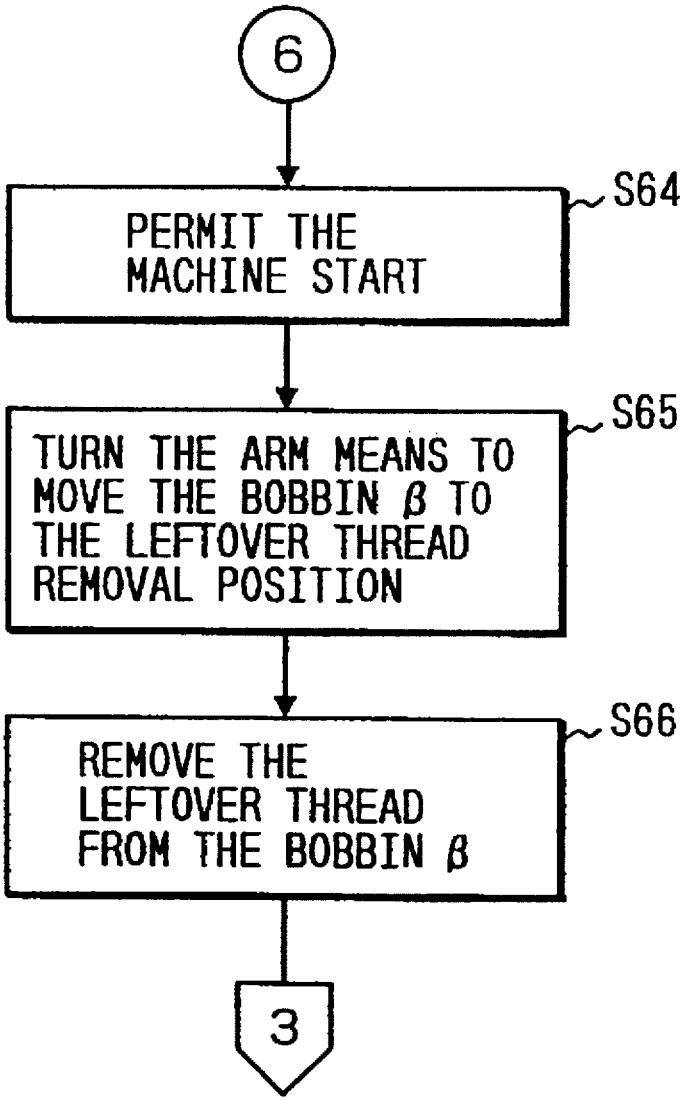
FIG. 8 is a flow chart showing the main program, continued from the flow chart in FIG. 7.

After the process of the step S13 is completed, control returns to a step S23 in the main flow shown in FIG. 4. In this step, the CPU considers that the process of the thread winding/hooking to one bobbin is completed, and calculates "number of used bobbins −1", and advances its control to a step S24. In this step, the bobbin α shown in FIG. 13(A) is turned by 120° reversely from the position E to the position A (FIG. 13(A)). This may be achieved by turning the drive motor 7*f* of the arm means while checking pulses from the arm-means stop point detector 62, thereby moving the bobbin α to the shuttle position.

Control advances to a step S25 where the bobbin α is set to the shuttle. This operation follows.

The bobbin grasp mechanism 8 positioned so as to face the shuttle 2 is pushed toward the shuttle 2 by the air cylinder 7*h* of the bobbin exchanging device 7, in a state that its grasping state is kept. When the bobbin case 4 is inserted into the shuttle 2, the lever pawl 8*c* of the bobbin grasp mechanism 8 is released and the bobbin case 4 with the under thread wound thereon is set into the shuttle 2. After the bobbin α is loaded into the shuttle, the arm means is moved backward, and control advances to a step S26. In this step, the CPU removes the machine start inhibit signal to allow the machine to start its operation.

Control proceeds to a step S27. In this step, the CPU determines whether or not "number of used bobbins"=0. If "number of used bobbins"=0, the CPU waits till a bobbin exchange flag is set, since the amount of the under thread sufficient for the preset number of stitching operations is already stored in the shuttle.

Figure 9:
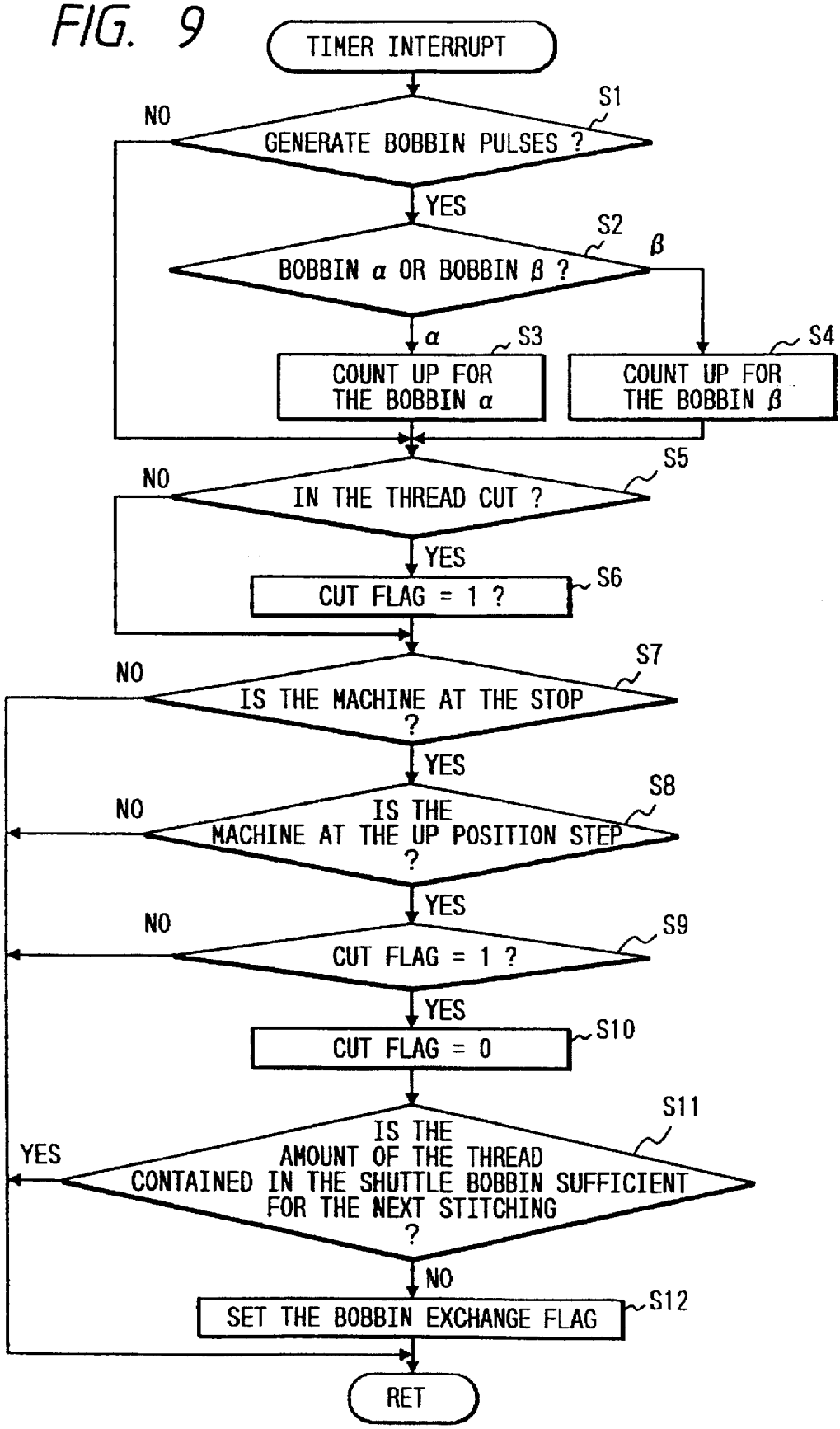
FIG. 9 is a flow chart showing a program for requesting the bobbin exchange, stored in the memory of the CPU in FIG. 1.

The bobbin exchange flag is set in the following manner in accordance with a subroutine for a timer interrupt shown in FIG. 9.

A timer interrupt is generated for each fixed time interval. In a step S1, the CPU determines whether or not a bobbin pulse is generated. If it is generated, control proceeds to a step S2. In this step, the CPU determines whether or not the bobbin in the shuttle is a bobbin α or a bobbin β. If it is a bobbin α, control advances to a step S3. In the step, the CPU counts up by a signal from the under-thread consumption detector 81 (having the same construction as that of the take-up quantity detector 67). If it is a bobbin β, control goes to a step S4. In the step, the CPU also counts up by a signal from the under-thread consumption detecting detector 81.

When the counting of the amount of the consumed under thread, which corresponds to the number of revolutions of the bobbin in the shuttle, starts in the step 3 or 4, control advances to a step S5. In this step, the CPU checks whether or not a thread cut signal indicating one stitching process is received. If the thread is not yet cut, control skips to a step S7. If it is cut, control flows to a step S6. In this step, the CPU sets the thread-cut flag (CF) to 1 (CF=1), and stores it. Then, control advances to a step S7. In this step, control checks whether or not the machine is at a stop. If it is not at a stop, control returns to the main program. If it is at a stop, control goes to a step S8. In this step, the CPU checks whether or not the machine is at an up position stop. If it is not at an up position stop, control returns to the main program. If it is at an up position stop, control advances to a step S9. In this step, the CPU checks whether or not the thread is cut, using the thread-cut flag. If it is not cut, control returns to the main program. If it is cut, control advances to a step S10. In this step, the CPU sets the thread-cut flag to 0 (CF=0). Control steps forward to a step S11. In this step, the CPU checks whether or not the bobbin in the shuttle contains the amount of thread necessary for the next stitching.

To this check, the CPU compares the amount of the thread first wound on the bobbin with that of the consumed thread. If the amount of the thread is sufficient for the next stitching, control returns to the main program. If it is insufficient, control steps forward to a step S12. In this step, the CPU sets the bobbin exchange flag. This flow is used since the control is timed such that the machine comes to an up position stop after a machine end signal (e.g., a thread cut signal) is issued.

After the stitching operation is carried out plural number of times, the amount of the under thread is reduced and the bobbin exchange flag is set.

Returning to the step S28 in the main program shown in FIG. 5, if the bobbin exchange flag is set, control proceeds to a step S29. In this step, the CPU inhibits the sewing machine to start its operation, and control goes to a step S30. In this step, the bobbin α is taken out of the shuttle in the following manner.

In the step S30, the bobbin α is taken out of the shuttle with the arm means in a similar manner to the already described one. The arm means with the lever pawl 8c, which was open when the shuttle was left in the bobbin case, is moved forward. Afterwards, the lever pawl 8c is closed to catch the lock lever 4e of the bobbin case 4, the bobbin is fixedly fixed to the arm means, and the arm means is moved backward. After the bobbin α is pulled out of the shuttle, control goes to a step S31. In this step, the CPU turns the arm means from the position shown in FIG. 13(A) counterclockwise in the steps of 60°, while checking pulses from the arm-means stop point detector 62, and moves the bobbin α to the position C where the leftover thread removing device 99 is located.

After the bobbin α is moved to the position C, control advances to a step S32 where a process of removing the leftover thread is carried out. The removal process of the leftover thread follows.

Figure 41:
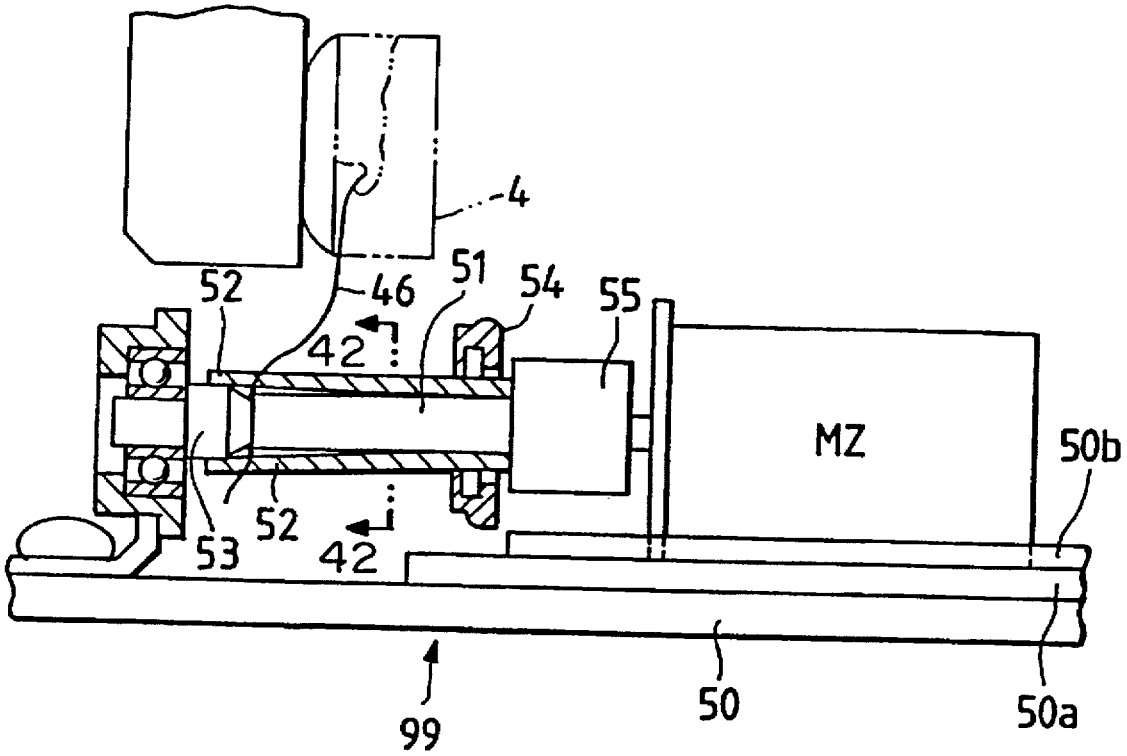
FIG. 41 is a traverse sectional view showing a leftover thread removing device applied to the automatic under-thread supply apparatus.
Figure 42:
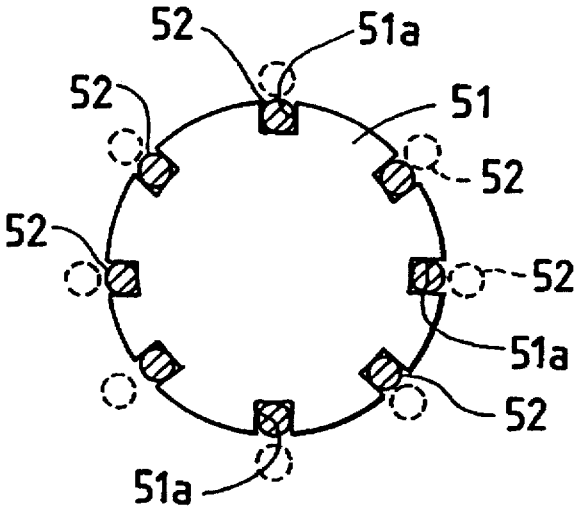
FIG. 42 is an enlarged cross sectional view taken on line 42—42 in FIG. 41.

As shown in FIG. 41, the leftover thread removing device 99, together with the leftover thread winding motor MZ, is moved to the left in the drawing by controlling an air cylinder, not shown, through the fork drive cylinder valve 73, to dash the fore end of the shaft portion 51 against the clutch member 53. Then, the resilient members of the take-up fork 52 are moved forward while being radially outwardly moved along the tapered part of the clutch member 53 as indicated by dotted lines in FIG. 42, and fit into the tapered part. At this time, the under thread 46 derived from the bobbin case 4 enters the take-up fork 52, and is nipped between the fore end of the shaft portion 51 and the clutch member 53. In this state, the leftover thread winding motor MZ is turned. The under thread 46 is entwined and picked up by the take-up fork 52. The CPU checks if the motor is turned a preset quantity of turn using a signal from the leftover thread winding motor rotation quantity detector 82. If it is turned by a preset quantity of turn, the CPU controls the fork drive cylinder valve 73 to move the leftover thread removing device, together with the leftover thread winding motor MZ, to the right in the drawing. Then, the leftover thread entwined and picked up by the take-up fork 52 is removed by the thread removal member 54 and drops downward.

After removal of the leftover thread, control steps forward to a step S33. In this step, the arm means is turned clockwise by 120° to the original position, as shown in FIG. 13(A). Thereafter, control returns to the process for inputting stitching conditions.

In the step S27, If "number of used bobbins"≠0, the CPU considers that the number of turns of the thread on the bobbin is not sufficient for a preset number of stitching operations, and advances its control to a step S34. In this step, the CPU turns the drive motor 7f of the arm means from the position shown in FIG. 13(A) counterclockwise by 60°, while checking pulses from the arm-means stop point detector 62, and moves the bobbin β to the position E. In the subsequent steps S35 and S36, the bobbin β is moved as the bobbin α was done, a preset amount of the thread is wound, and stored in the memory, the thread is hooked to the bobbin case, and the thread is cut. Then, control proceeds to a step S37. In a step S37, the number of bobbins is decrement by 1, and the CPU executes a process of the next step S38. In this step, the arm means is moved backward, the bobbin is disconnected from the motor shaft MC1, and the drive motor 7f of the arm means is turned from the position E clockwise by 60°, while checking pulses from the arm-means stop point detector 62, and moves the bobbin β to the position D. And control goes to a step S39.

In the step S39, control checks if the bobbin is exchanged with a new one. During the operation of wounding the under thread on the bobbin β, the machine starts to operate for sewing, and the stitching operation is carried out a plural number of times. The amount of the under thread is reduced to be insufficient for the next stitching and the bobbin exchange flag is set. Then, control shifts to a step S40. In this step, the CPU inhibits the machine from starting its operation, and advances its control to a step S41. In this step, the CPU takes the bobbin α out of the shuttle with the arm means and moves backward the arm means, and advances its control to a step S42. In this step, the CPU turns the drive motor 7f of the arm means from the position D shown in FIG. 13(A) counterclockwise in the steps of 60°, while checking pulses from the arm-means stop point detector 62, and moves the bobbin β to the shuttle position. In the next step S43, the arm means is moved forward, the bobbin β is loaded into the shuttle, and control shifts to a step S44. In this step, the CPU permits the machine to start its operation.

In this state, control shifts to a step S45. The CPU turns the drive motor 7f of the arm means counterclockwise by 120°, while checking pulses from the arm-means stop point detector 62, and moves the bobbin α to the position C for the leftover thread removal, and causes its control to step forward to a step S46. In this step, the CPU removes the leftover thread from the bobbin α, and causes its control to step forward to a step S47. In this step, control checks if "number of used bobbins"=0. If "number of used bobbins"= 0, control shifts to a step S48. If "number of used bobbins"≠0, control shifts to a step S54.

The operation ranging from a step S48 to a step S53 is substantially equal to the already described operation from the steps S28 to S33 if the bobbin α is substituted by the bobbin β. The operation from steps S54 to 66 is for the bobbins β and α while the already described operation from the steps 34 to 46 is for the bobbins β and α. The operation of the steps S54 to S56 is substantially equal to that of the steps S34 to 46. Hence, no further description of those operation of the steps S48 to S53, and the steps S54 to S66 will be given.

In the present embodiment, the quantity of the thread necessary for the bobbin is previously calculated on the basis of the stitching conditions, such as the number of stitching operations, the amount of consumed thread for each stitching, yarn type, and yarn count. The take-up motor MC is operated till an actual amount of under thread is equal to the calculated one. Therefore, the amount of under thread to actually be wound on the bobbin is only the amount of the under thread necessary for the stitching. The present embodiment of the invention succeeds in minimizing the amount of under thread left not used and wasted.

Furthermore, in the construction of the embodiment, the amount of the thread that is wound on the bobbin by the take-up quantity detector 67 is detected by the take-up quantity detector 67. The amount of the under thread wound on the bobbin in the shuttle is detected by the under-thread consumption detecting mens 81. The detection is based on the number of the stitching operations. With this construction, the amount of the leftover thread on the bobbin in the shuttle can be detected accurately. This also leads to the reduction of the leftover thread.

Still further, the automatic thread-winding/thread-hooking device of the present invention recognizes the end of one stitching process using a thread cut signal received, checks if the amount of the under thread necessary for the next process is left on the bobbin in the shuttle on the basis of the amount of the under thread that is left on the bobbin in the shuttle at the time of receiving the thread cut signal, and the amount of the under thread that has been consumed when the thread cut signal is received. If the answer is NO, the device inhibits the sewing machine from operating, and drives the bobbin exchanging device 7 to exchange the bobbin currently set in the shuttle with a new bobbin with a sufficient amount of under thread already wound thereon. The bobbin exchange is carried out when the needle stops at the up position. Therefore, the bobbin exchange can smoothly be carried out without any mutual interference with the sewing machine operation.

Still further, in the construction of the automatic thread-winding/thread-hooking device, the motor MC basis operations, such as the winding of the under thread around a bobbin, hooking the under thread to the bobbin case, and the cutting of the under thread, are carried out when the stitching operation progresses. In other words, the winding of the under thread around a bobbin, hooking the under thread to the bobbin case, and the cutting of the under thread, progress concurrently with the stitching operation.

When the necessary amount of the under thread to be wound on the bobbin is calculated on the basis of the stitching conditions, such a case that the necessary amount of under thread exceeds the capacity of one bobbin for receiving the under thread frequently occurs. In this case, the take-up motor MC is driven so as to wind the amount of the under thread substantially equal to the necessary one around each of the bobbins other than the final bobbin, and to wind the amount of the remaining under thread on the final bobbin. Thus, when the necessary amount of the under thread exceeds the thread winding capacity of one bobbin, the necessary amount of the under thread are properly assigned to the plural number of bobbins. As a result, the respective bobbins used suffer from the minimum amount of the leftover thread.

In the embodiment, the arm means is designed so as to grasp two bobbins. It may be modified so as to have three bobbins. In the modification, the operation of removing the leftover thread from the bobbin taken out of the shuttle may be performed currently with the operation of winding the under thread around a bobbin. The bobbin exchanging work is improved to be more efficient.

In the automatic thread-winding/thread-hooking device, the under thread is wound around a bobbin during the stitching operation. This eliminates the use of the bobbin stock mechanism for stocking the bobbin, which is indispensably used for the conventional device. This leads to reduction of the device size and the cost to manufacture.

Another leftover thread removing device of a under thread supplying apparatus according to the present invention will now be described.

Figure 43:
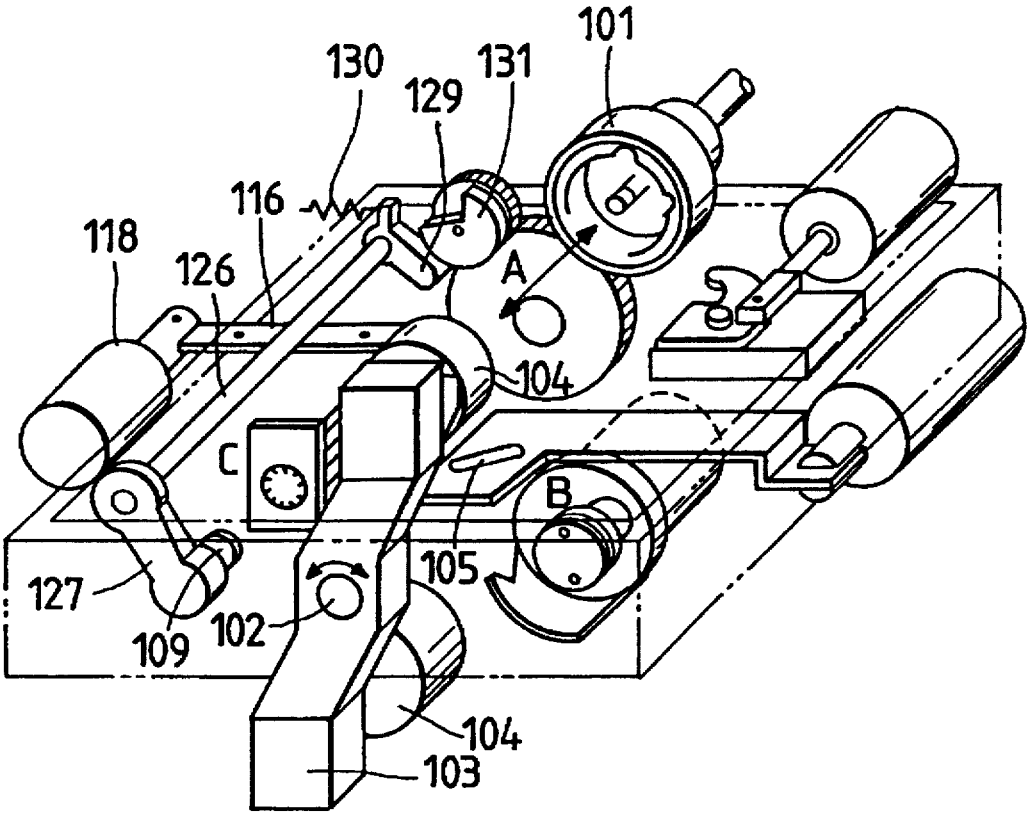
FIG. 43 is a perspective view showing another under thread supply apparatus.
Figure 44:
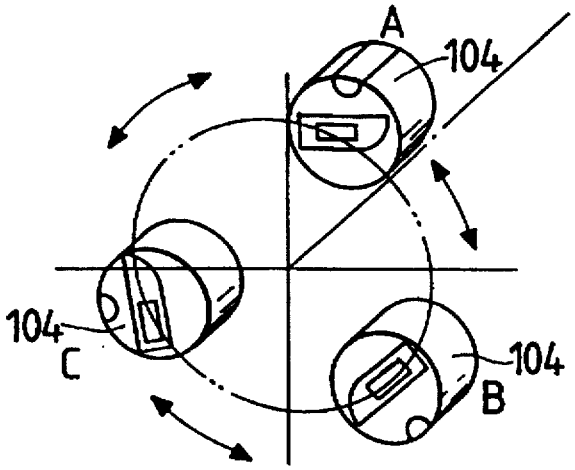
FIG. 44 is a perspective view showing postures of a bobbin case at the respective work zones in the under thread supply apparatus.

Referring to FIGS. 43 and 44, an outline of an under thread supply apparatus into which a leftover thread removal device according to the present invention is incorporated, will first be described.

In the under thread supply apparatus, a bobbin case set-in/take-out zone (stitching position) A, an under thread winding zone B, and a leftover thread removal zone C are disposed at the pitches of 120° around a transporting shaft 102 in a space around a shuttle 101 under a machine bed. A moving body 103 fastened to the transporting shaft 102 is provided with two bobbin cases 104. The moving body 103 transports, for the necessary work, the bobbin cases to those work zones, the set-in/take-out zone A, the under thread winding zone B, and the leftover thread removal zone C while circulating along a path including those work zones.

The moving body 103 of the automatic under thread supply device is reversibly turned every 120° by a pulse motor 135 to be described later. In the set-in/take-out zone A, the bobbin case 104 is set in and taken out of the shuttle 101 by a bobbin exchanging device. The bobbin case 104 is moved from the shuttle 101 to the moving body 103 and vice versa. In the under thread winding zone B, an under thread is wound around a bobbin in the bobbin case 104 after leftover thread is removed, by an under thread winding device. In the leftover thread removal zone C, a leftover thread in the bobbin case 104, which is pulled out of the shuttle by the work in the set-in/take-out zone A, and is now held by the moving body 103, is removed by the leftover thread removal device of the invention.

The leftover thread removal device of the invention will be described with reference to FIGS. 43 to 48.

The leftover thread removal device for a bobbin includes an air nozzle 105 for blowing a thread T suspending from a bobbin case 104, which is located in the set-in/take-out zone A, toward a work position, a guide 106 for holding the thread blown to the work position, a thread removal shaft 107 movable to and from a thread T extended between the bobbin case 104 and the guide 106, a plural number of relatively long linear resilient members 108 which are fastened at their base to the base of the thread removal member 107 and radially directed, and a receiving shaft 109 which is moved to a position where it faces the thread removal member 107 when the leftover thread is removed, and receives the advancing linear resilient members 108 and turns together with the linear resilient members 108.

The guide 106 is bent to be shaped like V. The guide 106 is located at such a position as to guide a thread Y into a space between the receiving shaft 109 and a block member 110*a* formed on a fixed table 110, which supports the thread removal member 107 and the linear resilient members 108.

Figure 45:
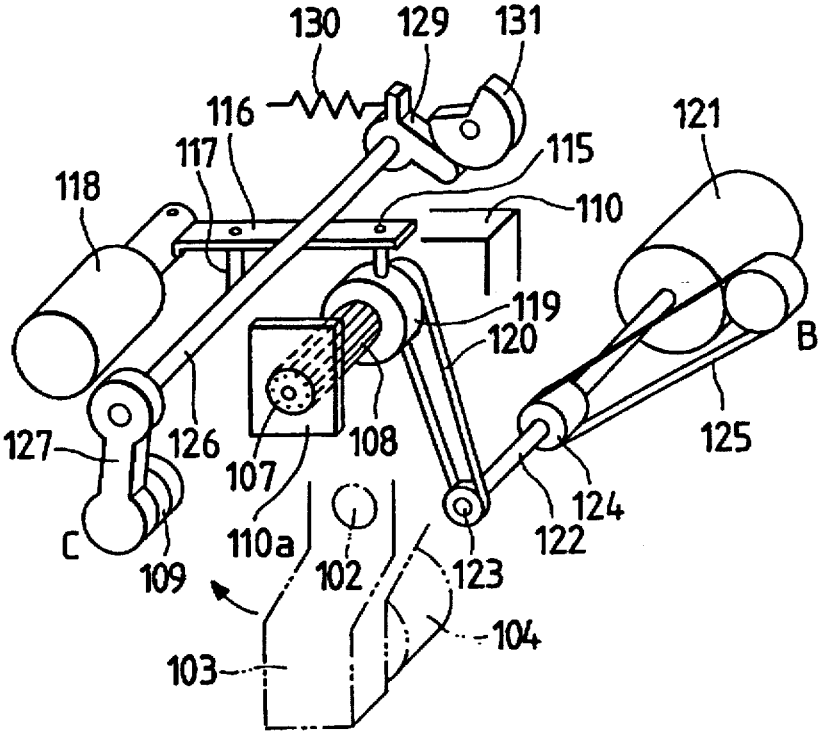
FIG. 45 is a perspective view showing another leftover thread removal device according to the present invention.
Figure 46:
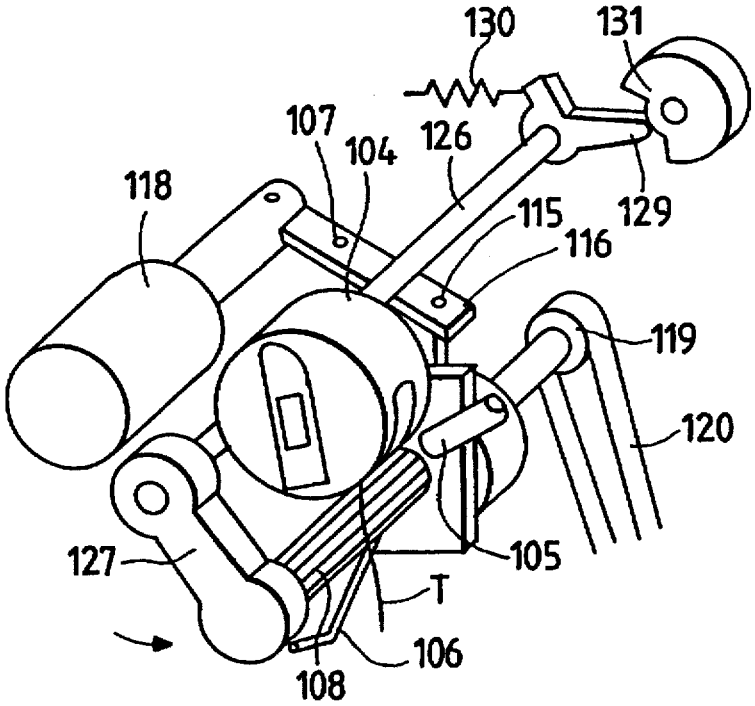
FIG. 46 is a perspective view showing the leftover thread removal device when it is operating for removing a leftover thread.
Figure 47:
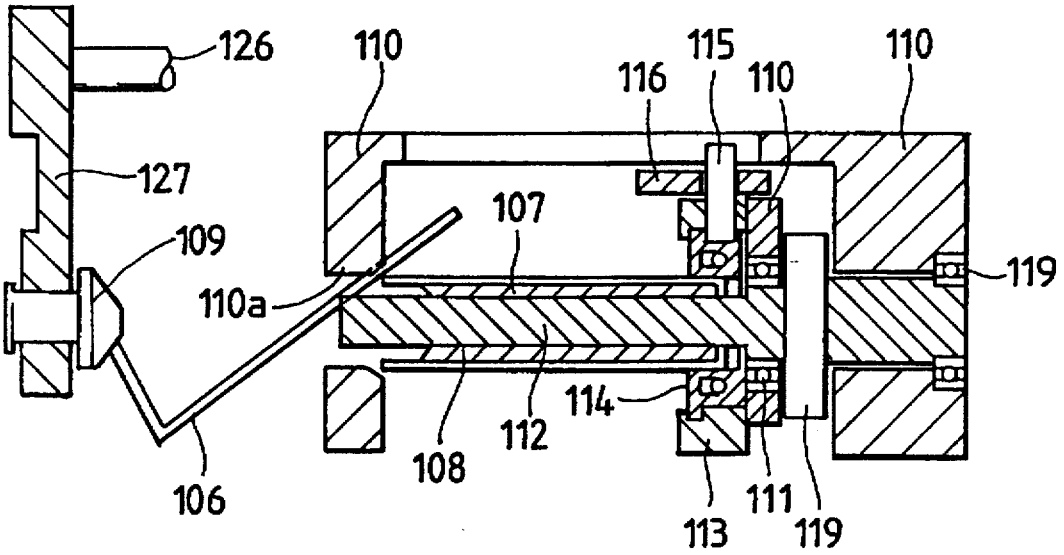
FIG. 47 is a cross sectional view showing a thread removal shaft and a forward mechanism of a linear resilient member in the leftover thread removal device.

The thread removal member 107, as shown in FIG. 47, is tubular in shape. A rotary shaft 112 is rotatably supported by the fixed table 110, through a bearing 111. The thread removal member 107, which is supported by the rotary shaft 112, is axially movable but radially immovable. The axially extending, linear resilient members 108 are disposed around the thread removal member 107. The base parts of the thread removal member 107 and the linear resilient members 108 are fit into a bearing 114, which is also fit to a housing 113 within the fixed table 110. A slide pin 115 is held in the upper part of the housing 113. The slide pin 115 is coupled with one end of a link 116, as shown in FIG. 45. The link 116 is rotatably supported by a support shaft 117. The other end of the link 116 is coupled with an electromagnet or an air cylinder 118. With this structure, when the electromagnet or the air cylinder 118 is driven the thread removal member 107 and the linear resilient members 108 are slid in the axial direction of the rotary shaft 112. A timing pulley 119 is fastened to the middle of the rotary shaft 112. As shown in FIG. 45, a motor 121 is disposed in the vicinity thereof. A timing belt 120 is wound around the timing pulley 19 and a timing pulley 23 fastened to a motor shaft 122 thereof.

A timing pulley 124 is further fastened to the motor shaft 122. A timing belt 125 wound thereon transmits a dynamic power also to the under thread winding device in the under thread winding zone B. The motor 121 may be used for the leftover thread removal or the under thread winding by selecting the turn direction thereof.

The receiving shaft 109 is rotatably supported by a shaft arm 127 fastened to one end of the shaft 126. The distal end thereof is tapered. With the tapered end, the advancing linear resilient members 108 is expanded. The receiving shaft 109 is moved to a location where it faces the thread removal member 107 and the linear resilient members 108 when the leftover thread is removed. That is, it is turned counterclockwise about the shaft 126 after the moving body 103 transports the bobbin case 104 to a preset position in the leftover thread removal zone C, and after the leftover thread removal, it is turned clockwise with the rotation of the moving body 103 to retract from the circulating path of the moving body 103. When the bobbin case 104, together with the moving body 103, is moved in the direction of an arrow in FIG. 45, the receiving shaft 109 is out of the circulating path of the moving body 103. Therefore, no interference of them takes place. The moving (turning) mechanism of the receiving shaft 109 follows.

Figure 48:
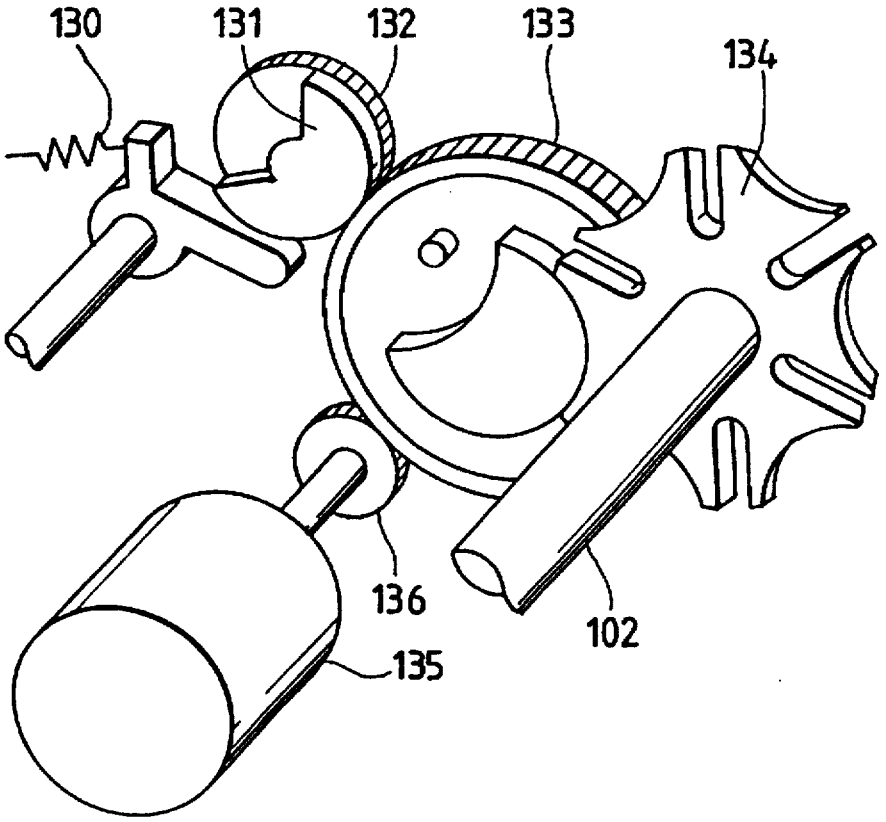
FIG. 48 is a perspective view showing a drive mechanism for retracting a receiving shaft.

As shown in FIG. 48, a cam follower 129, which is urged by a spring 130 so as to come in contact with a cam 131, is fastened to the second end of the shaft 126. The cam 131 is fastened to a gear 132. The gear 132 is in mesh with a drive gear 133 of a Geneva gear including the drive gear 133 and a follower gear 134 at the gear ratio of 1:6. A gear 136, fastened to the shaft of the pulse motor 135, is in mesh with the drive gear 133. The follower gear 134 is fastened to the transporting shaft 102 to which the moving body 103 is fixedly attached. With rotation of the pulse motor 135, the gear 136 and in turn the drive gear 133 are turned. The rotating speed is reduced to ⅙ and transmitted to the follower gear 134. In other words, when the drive gear 133 of the Geneva gear is turned one turn, the transporting shaft 102 is turned by ⅙ turn.

A positional relationship between the rotation of the transporting shaft 102 and the cam 131 is selected such that immediately after the moving body 103, fastened to the transporting shaft 102, brings the bobbin case 104 to a preset position in the leftover thread removal zone C, the cam follower 129 is turned counterclockwise and the receiving shaft 109 lies on an extension of the axis of the rotary shaft 112.

In the leftover thread removal device thus constructed, the moving body 103 is turned, and the bobbin case 104 accommodating a bobbin with a leftover thread, which is held by the moving body 103, reaches a preset position in the leftover thread removal zone C. Immediately thereafter, the receiving shaft 109 is moved to a location where it faces the thread removal member 107 and the linear resilient members 108. The air nozzle 105 emits an air stream. By the air stream, the leftover thread suspending from the bobbin case 104 is hooked to the guide 106. The thread removal member 107 and the linear resilient members 108 advance. The linear resilient members 108 are expanded so as to cover the receiving shaft 109. The thread T is nipped by the thread removal member 107 and the receiving shaft 109. When it is nipped, the motor 121 is turned, and the thread removal member 107 and the linear resilient members 108 are also turned to wind the thread therearound. Thereafter, when the thread removal member 107 and the linear resilient members 108 are retracted, the linear resilient members 108 leaves the receiving shaft 109, so that the spaces among them are narrowed. The wound thread is loosened. The loosened thread is blocked and squeezed by the block member 110*a* of the fixed table 110, and drops off the linear resilient members 108. If a thread ball stays there, it certainly drops since the receiving shaft 109 retracts with the rotation of the moving body 103, and the support for the thread ball is removed.

Another bobbin exchanging device of a under thread supplying apparatus according to the present invention will now be described.

Figure 49:
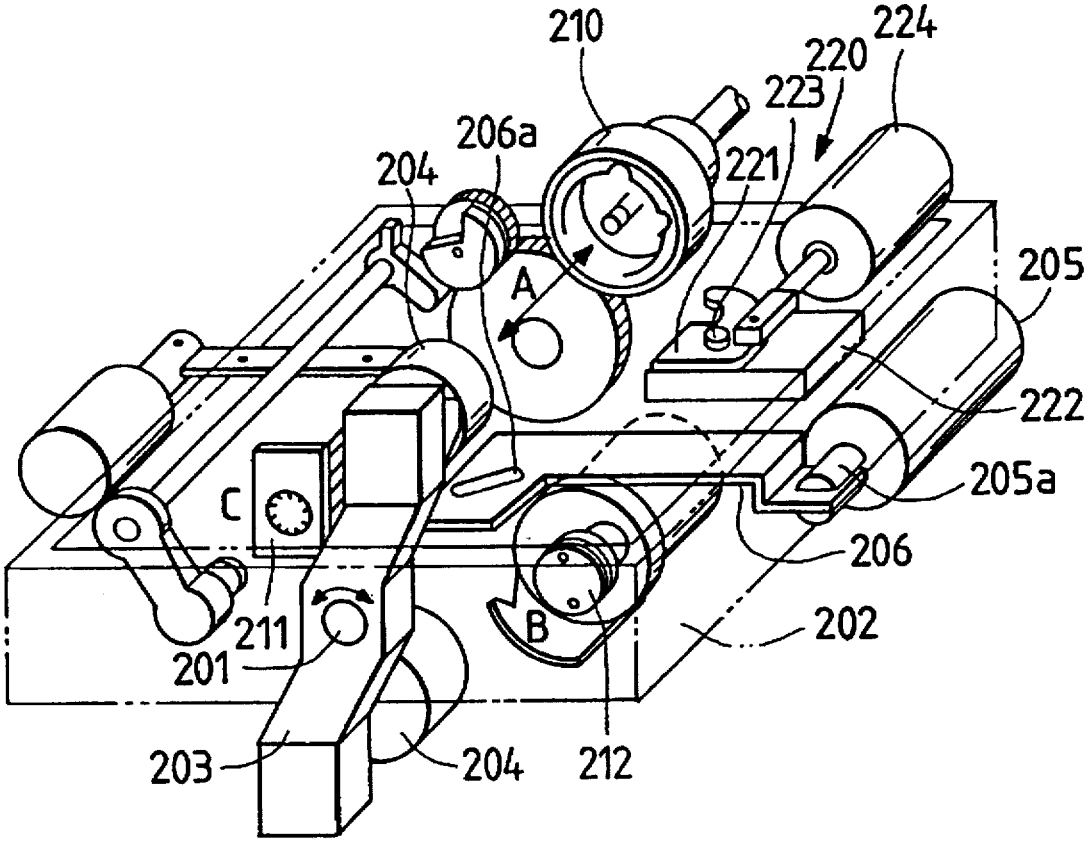
FIG. 49 is perspective view showing an under thread supply device with another bobbin exchanging device according to the present invention.
Figure 50:
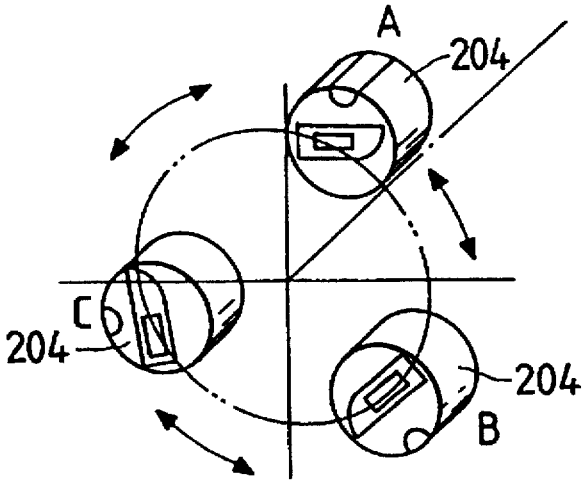
FIG. 50 is perspective view showing the movement of a bobbin case in the bobbin exchanging device shown in FIG. 49.

The bobbin exchanging device of the invention forms a part of an under thread supply apparatus shown in FIG. 49. The bobbin exchanging device is disposed in a space of an oil reservoir under a bed (not shown) of a sewing machine. The under thread supply apparatus is constructed such that a bobbin case 204 is moved successively to reach three work positions disposed at the pitches of 120° around a base shaft 201. As also illustrated in FIG. 50, these three work positions are a shuttle position (bobbin case set/take-out position) A, an under thread winding position B, and a leftover thread removal position C. The shuttle position A is axially displaced by a given distance from the remaining work positions B and C.

In the construction of the under thread supply apparatus, a main base 202 as a fixed member is located in the lower space of the machine bed. The base shaft 201 is rotatably attached to the main base 202. A rotary arm 203 as a moving member is coupled at the center boss with the base shaft 201, slidably but not rotatably. A rotary drive device (not shown) with a pulse motor, for example, is attached to the base shaft 201. The rotary drive device reversibly turns the base shaft 201 together with the rotary arm 203 every 120°.

Figure 51:
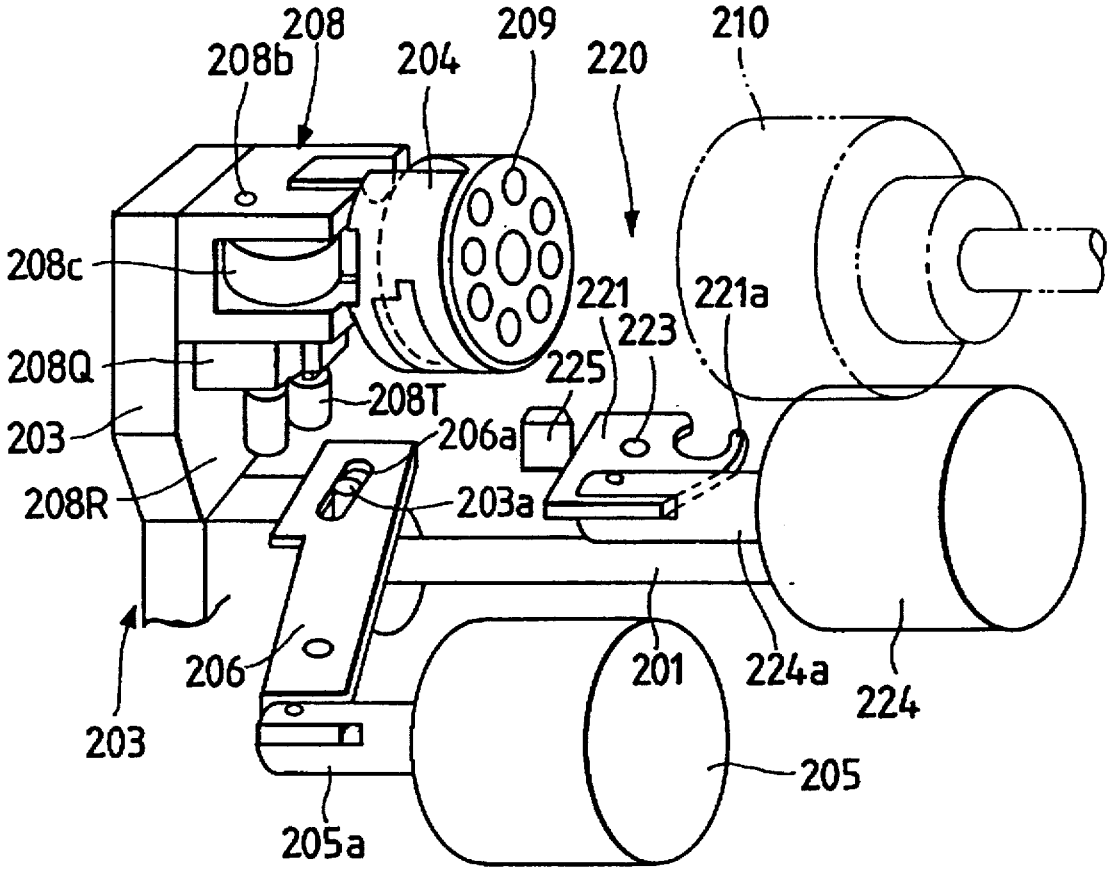
FIG. 51 is a longitudinal sectional view showing the overall structure of the bobbin exchanging device according to the present invention.

As also shown in FIG. 51, a linear output drive source 205, such as an air cylinder or an electromagnet, is mounted on one side of the main base 202. One end of a linear motion lever 206 is rotatably coupled with one end of the output rod 205*a* of the linear output drive source 205 by means of a pin. The linear motion lever 206 is extended up to a location above the base shaft 201, and coupled at the middle with the main base 202 by means of a pin. An elongated hole 206*a*, obliquely extended, is formed in the free end part of the linear motion lever 206. A pin 203*a* projected from the center boss of the rotary arm 203 is movably located in the elongated hole 206*a*. A dynamic power output from the linear output drive source 205 is transmitted through the linear motion lever 6 to the rotary arm 3. As a consequence, the rotary arm 203 is reciprocally moved along the base shaft 201 to and from the shuttle position A and the remaining work positions B and C. A coiled spring 205*b* (FIG. 54(A)) is mounted on the output rod 205*a* of the linear output drive source 205. The coiled spring 205*b* urges the rotary arm 203 toward the shuttle 210.

Bobbin grasp mechanism 208, as moving members forming the bobbin exchanging device, are mounted on both ends of the rotary arm 203. The bobbin case 204, which contains a bobbin 209 (FIG. 51) with an under thread wound therearound, is grasped by the bobbin grasp mechanism 208 and reversibly turned every 120° with the turn of the rotary arm 203. With the turn, the bobbin case 204 is set facing a shuttle 10 at the bobbin case set/take-out position A, facing a leftover thread removal device 211 at the leftover thread removal position C, and facing an under thread winding device 212 at the under thread winding position B.

The embodiment of the bobbin exchanging device will be described. In the bobbin exchanging device, the bobbin case 204, the bobbin 209, and the shuttle 210 are conventional ones without any modification of the structures. Hence, details of the structures of those components will not be described in the specification. However, the structure of the bobbin case 204 will briefly be described with reference to FIG. 52, for the better understanding of the invention.

Figure 52:
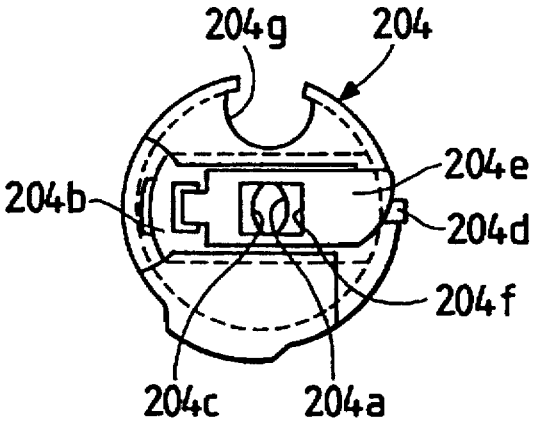
FIG. 52 is front view schematically showing the structure of the bobbin case.

As shown in FIG. 52, a through-hole 204*a* to be fit to the support shaft of the shuttle 210 is formed in the front face of the bobbin case 204. A bobbin locking plate 204*b* is mounted so as to cover the upper side of the through-hole 204*a* in a manner that it is slidable in the direction orthogonal to the axis. A hole 204*c* is formed in the bobbin locking plate 204*b* at the location thereof corresponding to the through-hole 204*a*. A pawl 204*d* is projected from the top of the bobbin locking plate 204*b*. The bobbin locking plate 204*b* reciprocally slides between a position where the arcuate inner edge of the hole 204*c* covers a part of the through-hole 204*a* and another position where the hole 204*c* allows the through-hole 204*a* to open to the full. At this time, the pawl 204*d* is also reciprocally moved between a position where it is out of the case and disengages from the bobbin 209, and a position where enters the case and comes in engagement with the bobbin 209. A coiled spring, not shown, constantly urges the bobbin locking plate 204*b* to a position in the illustration, viz., a position where the arcuate inner edge of the hole 204*c* partially covers the through-hole 4*a* and the pawl 204*d* is out of the case and disengages from the bobbin 209. When the arcuate inner edge of the hole 204*c* partially covers the through-hole 204*a*, the bobbin case 204 is firmly held by the shuttle 210. When the through-hole 204*a* is fully opened without any cover by the arcuate inner edge of the lock lever 204*e*, the bobbin case 204 is placed to a free state where it is separable from the shuttle 210.

The lock lever 204*e* is laid over the bobbin locking plate 204*b* in a manner that it may be turned apart from the hold plate for opening and laid down on the hold plate for closing. One end of the lock lever 204*e* is hinged to the front surface of the bobbin case 204. The lock lever 204*e* is extended from the hinged end toward the upper surface of the bobbin locking plate 204*b*. When the lock lever 204*e* is released, the bobbin locking plate 204*b* is slid backward while resisting a spring force of the coiled spring. The arcuate inner edge of the lock lever 204*e* comes off the through-hole 204*a*, so that the bobbin case 204 is placed to a free state where it is separable from the shuttle 210. At this time, the pawl 204*d* engages the bobbin 209 so as not to prevent the bobbin 209 from dropping out of the bobbin case 204. A hole 204*f* formed in the lock lever 204*e* is a rectangular, elongated hole allowing the holes 204*a* and 204*c* to open at all times.

As shown in FIGS. 51 to 53(C), in the bobbin grasping means 208, a rotary shaft 208*b* is rotatably supported by a pair of side plates 208*a* disposed substantially parallel to each other. A lever pawl 208*c* is attached to the rotary shaft 208*b*. The lever pawl 208*c* forms a mechanism for releasing the lock lever 204*e* of the bobbin case 204 by pulling up the lock lever from its closed position. The rotary shaft 208*b* is projected outward passing through the side plate 208*a*. An operation die 208Q forming a lock mechanism is fastened to the protruded part of the rotary shaft 208*b*.

The distal end of the lever pawl 208*c* is arcuate in shape. The arcuate distal end of the lever pawl 208*c* is disposed so as to be insertable into an overlapping part where the lock lever 204*e* of the bobbin case 204 and the bobbin locking plate 204*b* overlap. The distal end of the lever pawl 208*c* is turned tracing a path indicated by a solid line P in FIG. 53(A). With this turn, the lock lever 204*e* of the bobbin case 204 is turned tracing a path indicated by a two-dot chain line Q in FIG. 53(A), thereby to be released.

Each of the side plates 208*a* is rectangular in shape. The side edge of the side plate 208*a*, which is closer to the shuttle 210 (the left side edge in the drawing), is shaped in conformity with the surface configuration of the bobbin case 204. A turn stop plate is protruded from the side plate 208*a*. The bobbin case 204 is positioned relative to the bobbin grasp mechanism 208 when the turn stop plate 208*k* is inserted into a concave part of the bobbin case 204.

Figure 53A:
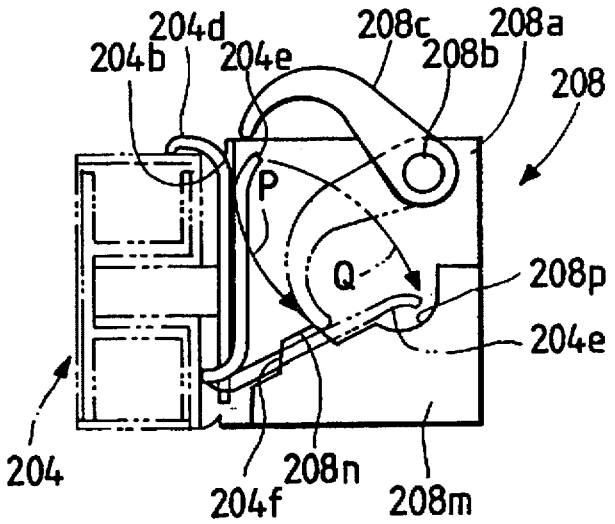
FIGS. 53(A) to 53(C) are explanatory diagrams of a bobbin grasping mechanism of the present invention, FIG. 53(A) showing a plan view of the bobbin grasping mechanism, FIG. 53(B) showing a front view of the same, and FIG. 53(C) showing a bottom view of the same.

Particularly as shown in FIG. 53(A), a base member 208*m* is provided between the side plates 208*a*. After released, the lock lever 204*e* rests on the base member 208*m*. At this time, the lock lever 204*e* is at an open position. The lever receiving surface of the base member 208*m* obliquely extends along the lock lever 204*e* set at the opening position (indicated by a two-dot chain line in FIG. 53(A). A protruded part 208*n*, trapezoidal shaped in cross section, is formed in the middle of the lever receiving surface of the base member 208*m*. The protruded part 208*n* is to be inserted into a hole 204*f*. An arcuately incurved part 208*p* is formed in another part of the lever receiving surface of the base member, which is higher than the protruded part 208*n*. The arcuately incurved part 208*p* is for receiving the distal end of the lock lever 204*e*. When the lock lever 204*e* rests on the base member 208*m* thus constructed, it is firmly held in an open state by a pushing force by the lever pawl 208*c*. As a result, the whole bobbin case 204 is grasped.

Figure 53B:
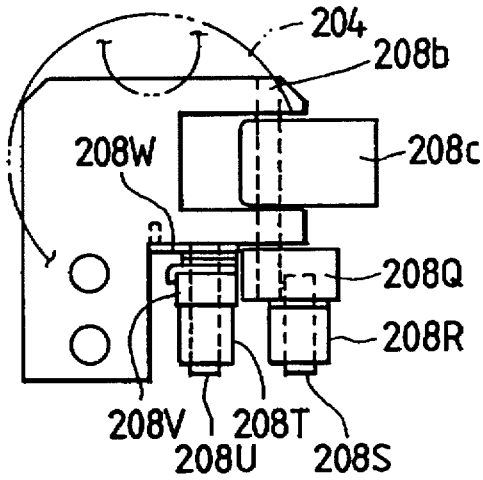
Figure 53C:
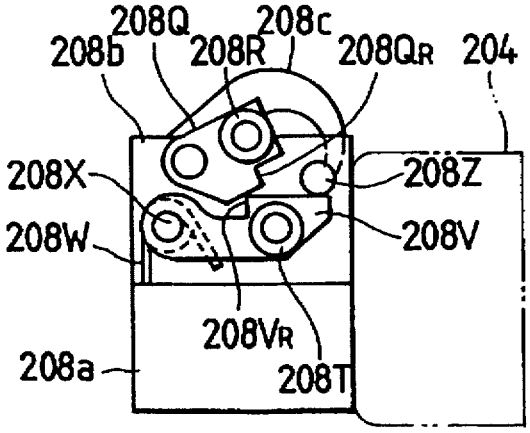

As shown in FIGS. 53(B) and 53(C), and 51, in the lock mechanism, the operation die 208Q is disposed adjacent to a lock plate 208V. The operation die 208Q forms a first operation member interlocking with the lever pawl 208*c* as the pull-up mechanism. The lock plate 208V comes in contact with the operation die 208Q or disengages from the operation die 208Q, thereby locking or releasing the operation die 208Q. The operation die 208Q is fastened to the rotary shaft 208*b* of the lever pawl 208*c*. A roller 208R is rotatably attached to the swing side end of the operation die 208Q by a pin 208S. A stepped part $208Q_R$ is formed in the side of the operation die 208Q, which faces the lock plate 208V. The stepped part $208Q_R$ engages or disengages from a stepped part $208V_R$ formed in the side of the lock plate 208V.

The lock plate 208V is rotatably supported by an axis 208X erected on the side plate 208a. A roller 208T is mounted on the swing end of the lock plate 208V. A coiled spring 208W is attached to the shaft 208X. The coiled spring 208W urges the lock plate 208V toward the operation die 208Q. A stopper pin 208Z for controlling a quantity of turn of the lock plate 208V toward the operation die 208Q is erected on the side plate 208a on the swing side of the operation die 208Q. In a state that any force is not applied to the lock mechanism, the urging force by the coiled spring 208W causes the stepped part $208V_R$ of the lock plate 208V to interlock with the stepped part $208Q_R$ of the operation die 208Q, so that the operation die 208Q is locked at that position. When the lock plate 208V is turned in the separation direction, the interlocking of those stepped parts is removed, so that the operation die 208Q is released.

In a locked state that the operation die 208Q interlocks with the lock plate 208V, the lever pawl 208c is stopped at a position (indicated by a two-dot chain line in FIG. 53(A)) where the lock lever 204e of the bobbin case 204 is released and held thereby. In a state that the operation die 208Q is separated from the lock plate 208V, the lever pawl 208c is located at an initial position (indicated by a solid line in FIG. 53(A)) where it is separated from the lock lever 204e of the bobbin case 204.

The bobbin grasping means 208 as a moving member is constructed so as to operate for grasping by an operation mechanism 220 mounted on the main base 202 as a fixed member. In the bobbin grasping means 208, the roller 208R of the operation die 208Q and the roller 208T of the lock plate 208V are spaced a preset gap apart from each other even when those are interlocked with each other and in a closed state. The gap between the roller 208R and the roller 208T receives the operating plate 221 forming the operation mechanism 220.

The operating plate 221 of the operation mechanism 220 is rotatably attached to a fixed frame 222 mounted on the main base 202 as the fixed member by means of a pin 223. An output rod 224a of a linear output drive source 224, such as an air cylinder or an electromagnet, is rotatably mounted on the base part of the operating plate 221. By the drive force output from the linear output drive source 224, the operating plate 221 is swung between an initial position shown in FIGS. 54(A) and 54(B) and a lock position shown in FIG. 54(C).

As best illustrated in FIGS. 54(A) to 54(C) and 51, the swing part of the operating plate 221 is shaped into a pawl part 221a. The pawl part 221a is protruded toward the gap between the roller 208R of the operation die 208Q and the roller 208T of the lock plate 208V, created when those are in an interlocked state. The roller 208T of the lock plate 208V is located closer to the operating plate 221 than the roller 208R of the operation die 208Q. The tip 221b of the pawl part 221a of the operating plate 221 has a guide slanted face. The slanted face 221b of the pawl part 221a of the operating plate 221 is located at a position where it is allowed to be in contact with the roller 208T of the lock plate 208V.

The inner edge of the pawl part 221a of the operating plate 221 is curved so as to receive, for guide, the roller 208R of the operation die 208Q. This curved inner edge of the pawl part 221a includes a curved part 221c for guiding the operation die 208Q to an initial position (FIG. 54(B)) and a curved part 221d for guiding and pushing the operation die 208Q to a lock position (FIG. 54(C)). A coiled spring 224a is mounted on the output rod 224a of the linear output drive source 224. The coiled spring 224a urges the operating plate 221 to turn toward the initial position shown in FIGS. 54(A) and 54(B). In FIG. 51, reference numeral 225 designates a guide plate for guiding the roller 208R of the operation die 208Q in the bobbin grasp mechanism 208 in the closing direction.

In the bobbin exchanging device thus constructed, a bobbin case 204 of which an under thread is consumed and is reduced in its amount is taken out of the shuttle 210 by the bobbin grasp mechanism 208. A new bobbin case 204, prepared at the work position B or C, is grasped with the bobbin grasp mechanism 208 and set in the shuttle 210 thereby.

Figure 54A:
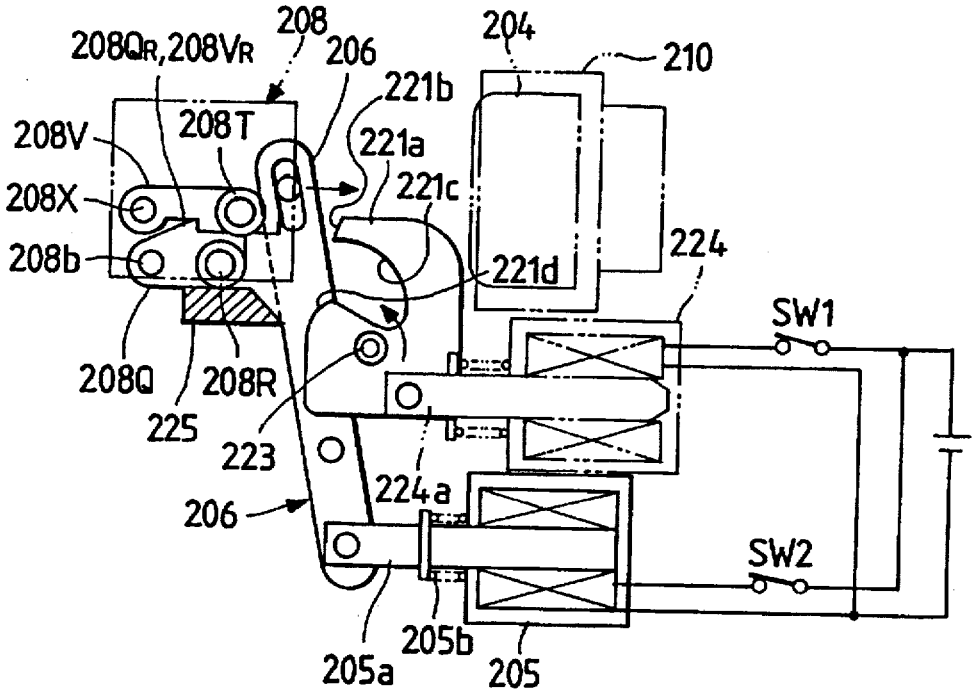
FIGS. 54(A) to 54(C) are plan views for explaining the operation of the bobbin grasping mechanism shown in FIGS. 53(A) to 53(C)

In the grasping process by the bobbin grasp mechanism 208, as shown in FIG. 54(A), a switch SW2 of the linear output drive source 205 is first turned off. In turn, the bobbin grasp mechanism 208, which is in a locked state, advances to the right in the drawing toward the bobbin case 204 set in the shuttle 210, with the aid of the linear motion lever 206. At this time, a switch SW1 of the linear output drive source 224 in the operation mechanism 220 is kept in an on state, and the operating plate 221 is set at the initial position.

With the advancement of the bobbin grasp mechanism 208, the roller 208T of the lock plate 208V comes in contact with the slanted face 221b of the pawl part 221a of the operating plate 221 in the operation mechanism 220. In turn, the roller 208T of the lock plate 208V is guided along the slanted face 221b of the operating plate 221 to be turned in an opening direction (upward in the drawing). When the bobbin grasp mechanism 208 further advances, the pawl part 221a of the operating plate 221 penetrates into the gap between the lock plate 208V and the operation die 208Q in the bobbin grasp mechanism 208. The roller 208R of the operation die 208Q is guided along the incurved side 221c of the pawl part 221a of the operating plate 221 in the operation mechanism 220, and is turned in an opening direction (downward in the drawing).

Figure 54B:
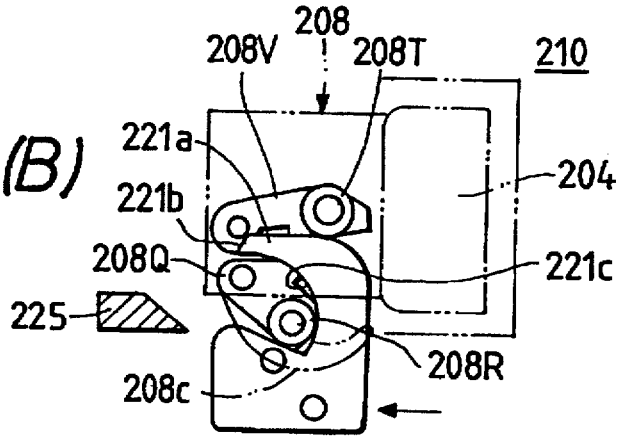

In this way, the stepped part $208V_R$ of the lock plate 208V of the bobbin grasp mechanism 208 disengages from the stepped part $208Q_R$ o the operation die 208Q, and the operation die 208Q is released as shown in FIG. 54(B). The lever pawl 208c is set at the initial position and pressed against the bobbin case 204 while keeping its state.

Figure 54C:
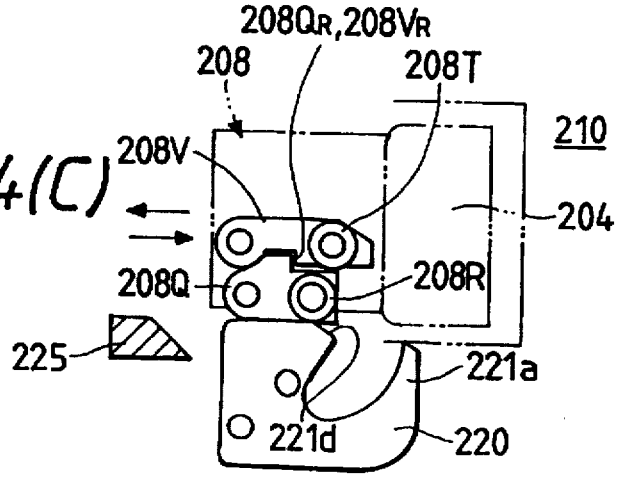

The switch SW1 of the linear output drive source 224 in the operation mechanism 220 is turned off, and the operating plate 221 is moved to the lock position as shown in FIG. 54(C). At this time, the curved side 221d of the operating plate 221 is turned while being in contact with the roller 208R of the operation die 208Q. The operation die 208Q is pushed upward in the drawing, and the lever pawl 208c is turned tracing the path indicated by the solid line P in FIG. 53(A). As a result, the lock lever 204e of the bobbin case 204 is turned tracing the path indicated by the two-dot chain line Q in FIG. 53(A), released, and held. The stepped part $208V_R$ of the lock plate 208V is interlocked with the stepped part $208Q_R$ of the operation die 208Q, and the lock lever 204e of the bobbin case 204 is grasped.

In this state, the switch SW2 of the linear output drive source 205 is turned on. In turn, the bobbin grasp mechanism 208, which is in a locked state, is separated from the shuttle 210 while grasping the bobbin case 204 in the shuttle 210, with the aid of the linear motion lever 206. In this way, a bobbin case 204 with the consumed under thread is taken out of the shuttle 210 by the bobbin grasp mechanism.

To set the bobbin grasp mechanism 208 sets a new bobbin case 204 prepared at the work position B or C into the shuttle 210 by the bobbin grasp mechanism 208, the switch SW2 of the linear output drive source 205 is first turned off, and the bobbin grasp mechanism 208, which is in the locked state, advances to the shuttle 210 (to the right in the drawing), with the aid of the linear motion lever 206 (FIG. 54(A)). At this time, the switch SW1 of the linear output drive source 224 is turned off, and the operating plate 221 is set at the lock position shown in FIG. 54(C).

When the bobbin case 204 grasped with the bobbin grasp mechanism 208 is set in the shuttle 210, the switch SW1 of the linear output drive source 224 in the operation mechanism 220 is turned on. The operating plate 21 in the operation mechanism 220 is turned as shown in FIG. 54(B). When the slanted face 221*b* of the pawl part 221*a* of the operating plate 221 is brought into contact with the roller 208T of the lock plate 208V in the bobbin grasp mechanism 208. Then, the roller 208T of the lock plate 208V is guided along the slanted face 221*b* of the operating plate 221, so that it is turned in the opening direction (upward in the drawing). The pawl part 221*a* of the operating plate 221 is further turned. The pawl part 221*a* of the operating plate 221 penetrates into the gap between the lock plate 208V of the bobbin grasp mechanism 208 and the operation die 208Q. The roller 208R of the operation die 208Q is guided along the incurved side 221*c* of the pawl part 221*a* of the operating plate 221, thereby to turn in the opening direction (downward in the drawing).

In this way, the stepped part $208V_R$ of the lock plate 208V of the bobbin grasp mechanism 208 disengages from the stepped part $208Q_R$ of the operation die 208Q, and the operation die 208Q is released as shown in FIG. 54(B). The lever pawl 208*c* is set at the initial position and the bobbin case 204 is released from being grasped.

Then, the switch SW2 of the linear output drive source 205 is turned on. In turn, the bobbin grasping means 208, which is in a released state, is separated from the shuttle. At this time, the roller 208R of the operation die 208Q in the bobbin grasp mechanism 208 is brought into contact with the guide plate 225 to be locked (FIG. 54(B)).

In the present embodiment, the bobbin case 204 is automatically taken out of and set in the shuttle without any modification of the shuttle 210, the bobbin 209, and the bobbin case 204.

While a specific embodiment of the present invention has been described, it should be understood that the present invention may variously be modified, changed, and altered within the scope and spirits of the invention.

In the embodiment described above, the latch mechanism is used for locking the operation die. It may be locked by a magnetic attraction means. In this case, a permanent magnet is attached to the operation die, and an attraction piece is attached to the side plate.

A rectilinear mechanism may be used for the operating die, in place of the rotation mechanism.

An automatic sequential control based on a computer may be employed for the control of the operation control switches.

A more reliable control for the related portions is secured if the operations of the related portions are constantly monitored by sensor means and data gathered from the sensor means are used for the control.

Another under thread winding device which applies to a thread supply apparatus of the present invention will now be described with referring to FIGS. 55(A) to 58(B).

The under thread winding device shows schematically in FIG. 55(A), and the same elements as the other embodiments described above are omitted in FIG. 55(A).

Figure 55A:
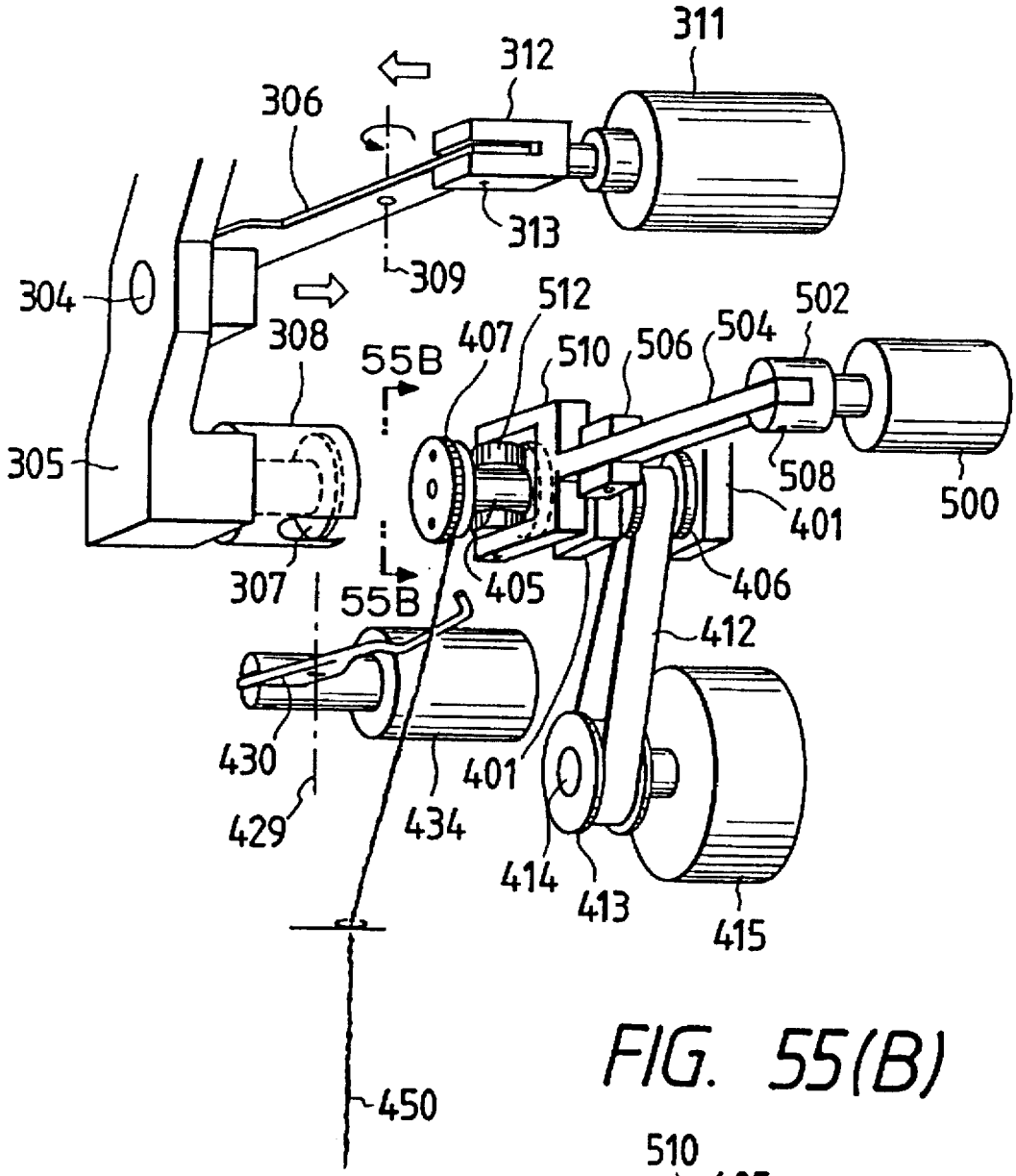
FIG. 55(A) is a perspective view schematically showing the structure of another under thread winding device.

The rotary arm 305 of the under thread supply apparatus extends with symmetrically bending around the center (only in part shown in FIG. 55(A)), and a bobbin case 308 accommodating a bobbin 307 is detachably held in each end portion of the rotary arm 305.

The liner motion lever 306 is rotatably supported on a shaft (not shown) which stands on the main base (not shown) at axis 309. One end portion of the liner motion lever 306 is rotatably mounted on a shaft 313 which is fixed in a knuckle 312 provided at the rod tip of the air cylinder 311. The liner motion lever 306 reversibly turns around the axis 309 in accordance with expansion and contraction of the rod of an air cylinder 311. Accordingly, the rotary arm 305 moves forwardly and backwardly along the guide shaft 304 by the liner motion lever 306. In other words, the rotary arm 305 is able to move along the guide shaft 304 form the bobbin case set/take-out position A as a sewing position where a shuttle is provided to the opposite position (that is, the under thread winding position B and the leftover thread removal position shown in FIG. 50.)

A winding shaft 407 is rotatably supported on a subframe 401 (in part shown in FIG. 55(A)) at the one end. The other end of the winding shaft 407 has a flange portion serving as a clutch plate and a plurality of pins 407*a* to transmit rotations of the winding shaft 407 to the bobbin 307.

A pulley 406 is fixedly mounted between the sub-frame on the winding shaft 406. A rotary drive mechanism includes a motor 415, an output shaft 414 of motor, a pulley 413 fixedly mounted on the output shaft 414 and a timing belt 412 passed between the pulleys 406 and 413.

A thread clamping shaft 405 is slidably supported on the winding shaft 407 in the axial direction, and the thread clamping shaft 405 as thread clamping means has a flange portion at the flange side of the winding shaft 407. The clamping shaft 407 is caught in a forked potion 510 of a clamping lever 504 through a cam 512. The clamping lever 504 is rotatably mounted on a shaft 506. A knuckle 502 of a air cylinder 500 rotatably holds the opposite end to the forked portion 510 of the clamping lever 504 by a shaft 508. In accordance with a reciprocation of the air cylinder 500, the clamping lever 504 is turned forward and backward around the shaft 506 by the knuckle 502 of the air cylinder 500, and the forked portion 510 of the clamping lever 504 turns the reverse direction. Accordingly, the thread clamping shaft 405 is slid linearly along the winding shaft 407 in the axial direction in accordance with turning the forked portion 510 through the cam 512.

A wiper 430 is provided below the winding shaft 407 and rotatably supported around a shaft 429. The wiper 430 has a U-shaped portion at one end for hooking the under thread 450. An opening of the U-shaped portion of the wiper 430 faces toward the rotary arm 305 (toward left side of FIG. 55(A)). The wiper 430 is rotatably held by a shaft of an air cylinder 434 at the other end of the wiper 430. Accordingly, when the shaft of the air cylinder 434 reciprocates, the wiper 430 is turned around the shaft 429 by the shaft of the air cylinder 434, and the U-shaped portion of the wiper 430 is turned the reverse direction against the reciprocation of the shaft of the air cylinder 434.

The operation of the under thread winding device thus constructed will now be described with referring to FIGS. 55(A) to 58(B).

First, the rotary arm 305 of the under thread supply apparatus turns, and the bobbin case 308 accommodating the empty bobbin 307 removed the leftover under thread is positioned at the under thread winding position as shown in FIG. 55(A).

Figure 55B:
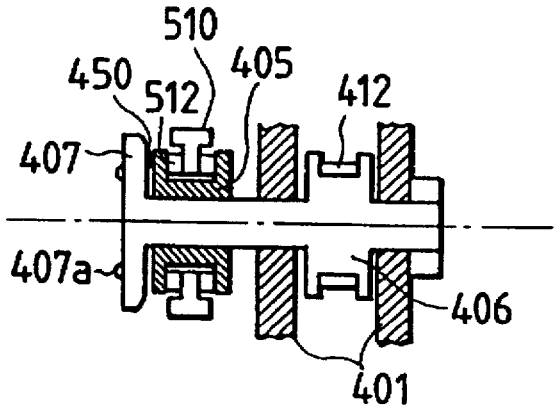
FIG. 55(B) is a cross sectional view at 55B—55B of FIG. 55(A)

At the present time, the under thread winding device is in the initial state as shown in FIG. 55(A). The under thread 450 from a thread supply bobbin (not shown) is clamped between the flange portion of the winding shaft 407 and the flange portion of the thread clamping shaft 405, as shown in FIG. 55(B). And the wiper 430 is positioned at the thread clamping shaft side against the flange portion of the winding shaft 407.

Figure 56A:
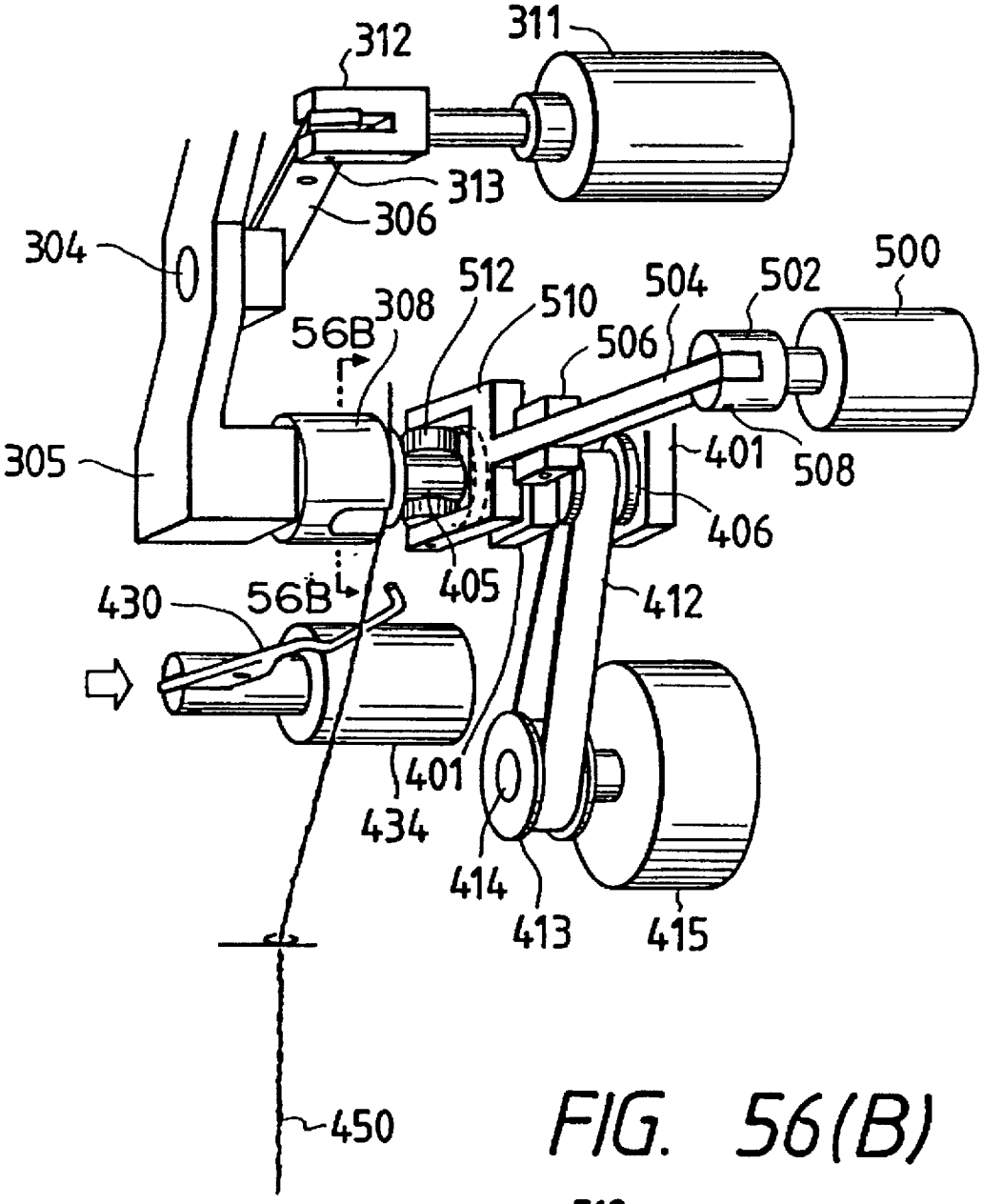
FIG. 56 shows the operation that the winding shaft is engaged with a bobbin in the under thread winding device of FIG. 55(A)
FIG. 56(B) is a cross sectional view on 56B—56B of FIG. 56(A)
Figure 56B:
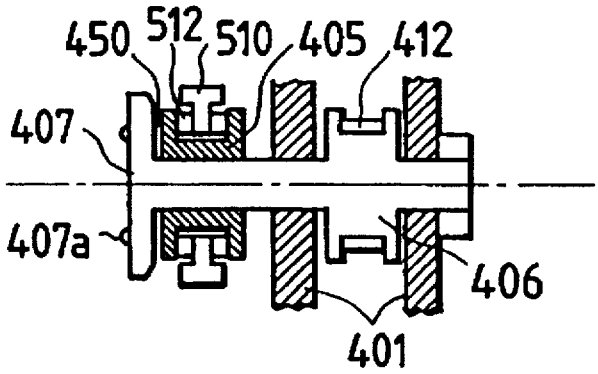

Next, the rotary arm 405 is moved forward (toward to right in FIG. 55(A)), and the pins 407a of the winding shaft 407 are engaged into an existing holes of the bobbin 7 in order for the winding shaft to clutch the bobbin 7 as shown in FIG. 56(A). At this time, the under thread 450 is still clamped between the winding shaft 407 and the thread clamping shaft 405, as shown in FIG. 56(B).

Figure 57A:
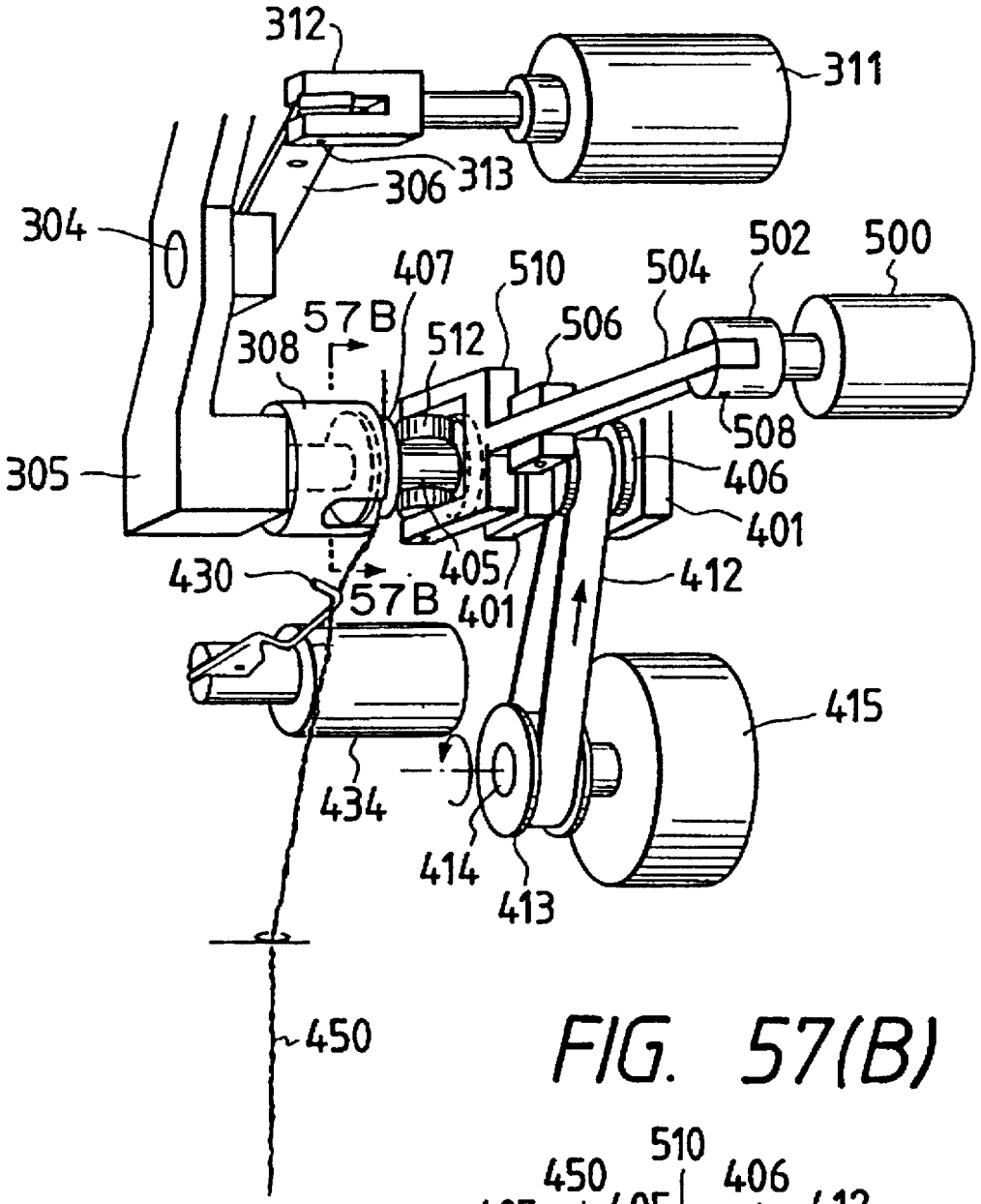
FIG. 57(A) shows the operation that a motor drives to rotate the bobbin a few times in the under thread winding device of FIG. 55(A)

And then, the U-shaped portion of the wiper 430 is moved toward the bobbin case side, with hooking the under thread 450, as shown in FIG. 57(A). Accordingly, the under thread 450 is brought to the opening of the bobbin case 308 by the wiper 430.

Figure 57B:
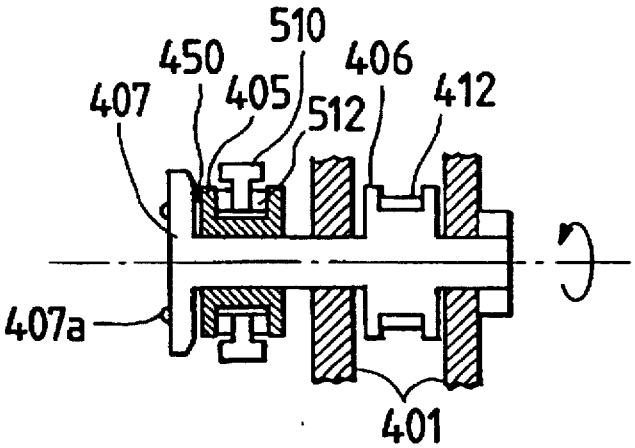
FIG. 57(B) is a cross sectional view on 57B—57B of FIG. 57(A)

Under these conditions, the winding shaft 407 is to be turned at a few times by driving the motor 415, so that the under thread 450 is wound on the bobbin 307. At this time, the under thread 450 is still clamped between the winding shaft 407 and the thread clamping shaft 405, as shown in FIG. 57(B).

Figure 58A:
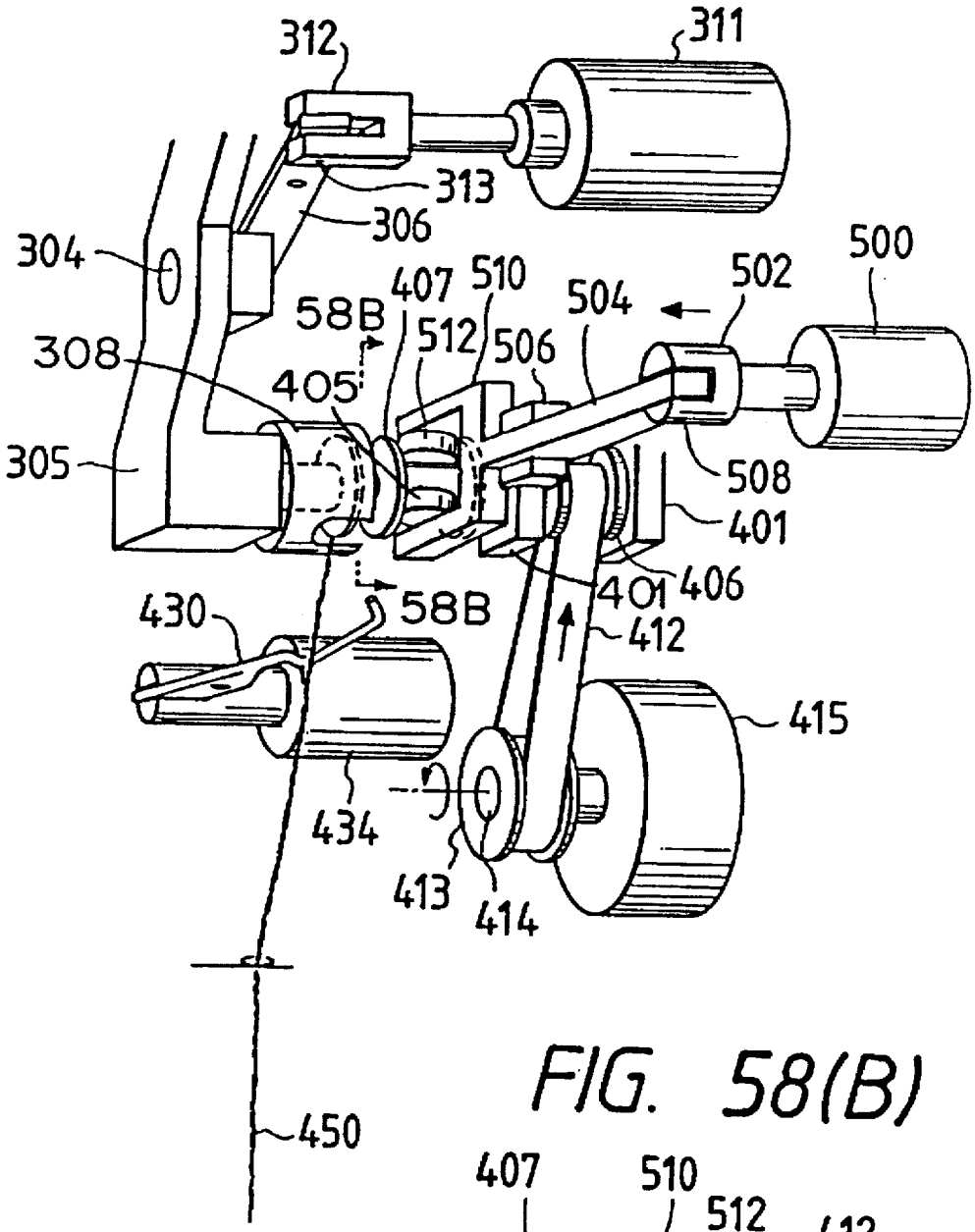
FIG. 58(A) shows the operation that a thread clamping shaft releases the under thread and the motor drives to rotate the bobbin in the under thread winding device of FIG. 55(A)
Figure 58B:
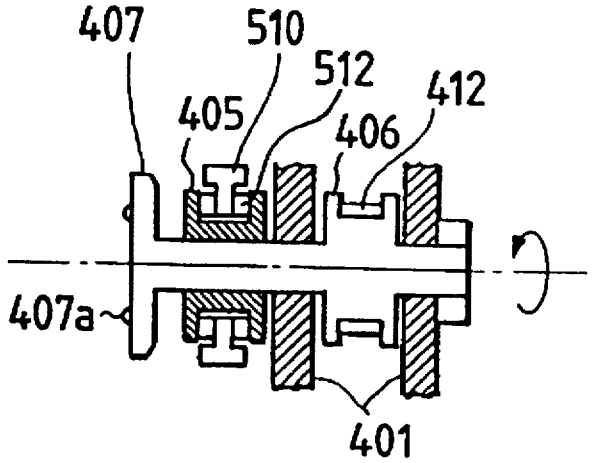
FIG. 58(B) is a cross sectional view on 58B—58B of FIG. 58(A).

After the under thread 450 is wound at a few times on the bobbin 307, the air cylinder 500 is moved backwardly (to right in FIG. 58(A)), and the motor 415 is driven again, as shown in FIGS. 58(A) and 58(B). Therefore, the thread end which is clamped between the flange of the winding shaft 407 and the flange of the thread clamping shaft 405 is automatically accommodated into the bobbin case 308. After going on driving the motor 415 at a predetermined times in order to wind the under thread 450 on the bobbin 307 at the desirable amount, the motor 415 is stopped.

After the winding operation described above, the under thread 450 is cut by a cutter (not shown) and the end of the under thread 450 connecting to the under thread supply bobbin is clamped between the flange of the winding shaft 407 and the flange of the thread clamping shaft 405.

The rotary arm 305 is moved backwardly, and turned to the bobbin case set/take-out position, then being moved forwardly. And the bobbin case 308 which is held the rotary arm 305 and accommodates the bobbin 7 finished to wind the under thread is mounted in the shuttle 16 at the bobbin case set/take-out position.

At this time, the under thread winding device is in the initial state. And the winding operation is completed.

While the present invention has been described in detail using specific embodiments, it should be understood that the invention may variously be modified, altered, changed within the scope and spirits of the invention.

In the embodiments described above, the amount of the consumed under thread on the bobbin in the shuttle is detected on the basis of the number of stitches. The amount of the consumed under thread per one needle stroke may be used in place of the number of stitches. In this case, the number of needle strokes is counted. A number-of-stitching counter may be used for the same purpose.

In the above-mentioned embodiments, the amount of an under thread to be wound on a bobbin is detected in the automatic thread-winding/thread-hooking device 100. A thread-amount measuring wheel with an encoder may be used for the same purpose.

An upper thread draw-out mechanism for drawing out a preset amount of the upper thread may be incorporated into the automatic thread-winding/thread-hooking device. The amount of the consumed under thread on the bobbin in the shuttle to be detected by the under-thread consumption detecting mens 81 may be detected in the form of the amount of the consumption of the upper thread, which has a proportional relation with the under thread.

The automatic under thread supply apparatus of the invention includes the wound-thread amount controller for previously calculating an amount of an under thread necessary for a bobbin on the basis of the stitching conditions, such as the number of stitching operations, the amount of consumption for each stitching operation, yarn type, and yarn count, and for operating the thread winding means till the calculated amount of the under thread is substantially reached. Accordingly, the amount of the under thread to be wound on a bobbin by the thread winding means is only the amount of the under thread necessary for the stitching operation. The amount of under thread left not used and wasted is minimized.

Furthermore, the automatic under thread supply apparatus includes detector for detecting the amount of the under thread that is wound around the bobbin by the thread winding means, thereby producing a wound thread amount signal indicating the detected amount of the wound under thread; and thread consumption detector for detecting the amount of consumption of the under thread on the bobbin in the shuttle on the basis of the number of stitches, thereby producing a thread consumption signal indicating the detected amount of consumption of the under thread. Accordingly, the amount of the remaining under thread on the bobbin in the shuttle is detected accurately. The amount of the under thread left not used is further reduced when comparing with that by the first invention.

The automatic under thread supply apparatus includes bobbin exchange controller operating such that when receiving a machine end signal (e.g., a thread cut signal) indicating the completion of one stitching process, the bobbin exchange controller checks whether or not an amount of the under thread necessary for the next stitching process is left on the bobbin in the shuttle using a wound thread amount signal and a thread consumption signal, and if the amount of the under thread left on the bobbin is smaller than the necessary amount of the under thread, the bobbin exchange controller prohibits the stitching operation by the sewing machine and exchanges the bobbin in the shuttle with a new bobbin with an under thread already wound therearound by the bobbin exchanging device when the needle stops at the up position. Therefore, the bobbin exchange may be carried out without any mutual interference of the bobbin with the sewing machine.

In the automatic under thread supply apparatus, the wound-thread amount controller causes the thread winding means to operate during the stitching operation. Accordingly, the thread winding means is operated concurrently with the stitching operation under control of the wound-thread amount controller. The stitching operation can be performed without any interruption by the winding of an under thread around a bobbin.

The automatic under thread supply apparatus includes the wound-thread amount controller operating such that when a necessary amount of the under thread to be wound is calculated in accordance with the stitching conditions, if the necessary amount of the under thread exceeds the capacity of one bobbin for receiving the under thread, the wound-thread amount controller causes the thread winding means to operate for the bobbins other than the final bobbin till the amount of the under thread, which is substantially equal to the thread amount one bobbin can receive, is wound, and for the final bobbin till the amount of the under thread, which is substantially equal to the amount of the remaining under thread, is wound. When the necessary amount of the under thread exceeds the capacity of one bobbin for receiving the under thread, the necessary amount of the under thread is properly assigned to a plural number of bobbins. Therefore, the leftover under thread can be reduced on any of the bobbins. The automatic under thread supply apparatus of the seventh invention includes leftover thread removing device for removing the leftover thread, and the leftover thread removal controller operating such that the controller moves a used bobbin, which is pulled out of the shuttle by the bobbin exchanging device, to the leftover thread removing device and then to the thread winding means. Therefore, the leftover thread may be removed from the used bobbin taken out of the shuttle, concurrently with the winding of an under thread around a bobbin. The bobbin exchange operation is more efficient.

Furthermore, in the present invention, it is noted that the bobbin grasp mechanism as a moving member is operated by the operation mechanism located on the fixed member. In other words, the operation mechanism is not carried on the moving member. With this unique feature, power supply lines or pipes to the operation mechanism may easily be laid out without using rotary joints, such as a slipping mechanism.

Still further, in the leftover thread removal device for the under thread supply apparatus of the invention, it has the following useful effects. As seen from the foregoing description, when the leftover thread is removed, the receiving shaft is moved to a location where it faces the thread removal member and the linear resilient members. Therefore, the thread, which is pulled out of the bobbin accommodated in the bobbin case and wound around the thread removal member and the linear resilient members, can be made to drop reliably. The related components and members are laid out without creating any restriction. The leftover thread removal function of the device is improved. The movement of the receiving shaft is correlated with the movement of the bobbin case to the leftover thread removal zone. Therefore, the related mechanism is simplified. It is preferable to use a single drive source common to the thread removal member and the linear resilient members, and the under thread winding device, from the economical viewpoint.

Still further, in the bobbin exchanging device for the under thread supply apparatus of the invention, the bobbin grasping means grasps a bobbin case with a consumed thread and takes it out of the shuttle, and grasps a new bobbin case prepared at another work position and sets it in the shuttle. The exchange of an old bobbin case with a new one can be carried out automatically, without any modification of the shuttle, the bobbin case, and the bobbin. Thus, the bobbin exchanging device of the invention can carry out a bobbin exchange without deteriorating the conventional stitching quality. This contributes to the improvement of the sewing machine.

Still further, the under thread winding device for the under thread supply apparatus of the invention includes the bobbin rotatably supported, the thread clamping shaft as the thread clamping means for clamping and releasing the under thread, the wiper for bringing the under thread clamped the thread clamping means near the opening of the bobbin case accommodating the bobbin, and the winding shaft for turning the bobbin case and winding the under thread brought near the opening by the wiper on the bobbin. In the under thread winding device, the thread clamping shaft releases the under thread when the under thread is wound on the bobbin. Accordingly, the end of the under thread is automatically accommodated into the bobbin case by releasing operation of the thread clamping shaft according to the invention, in contrast to leaving the end of the under thread outside of the bobbin case in the conventional one. Therefore, the under thread winding device enables to form good seams and to prevent from discontinuing the under thread. Furthermore, because the bobbin and the bobbin case is modified little or not at all, the thread winding device can keep the quality of seams, reduce its cost, and operate to wind the under thread on the bobbin uniformly.

What is claimed is:

1. An under thread supply apparatus for a sewing machine having a shuttle, comprising:

a bobbin case adapted to be removably set to the shuttle, said bobbin case accommodating a bobbin with the thread wound thereon;

take-out means for taking said bobbin case out of the shuttle;

thread removal means for removing the thread from said bobbin accommodated in said bobbin case taken out;

winding means for winding a preset amount of thread around said bobbin after the thread is removed therefrom; and bobbin case setting means for setting said bobbin case accommodating said bobbin with the thread wound anew therearound to the shuttle.

2. An under thread supply method for a sewing machine having a shuttle, the method comprising the steps of:

taking a bobbin case out of the shuttle of the sewing machine, the bobbin case accommodating a bobbin with a thread wound therearound and removably set to the shuttle;

removing the thread wound around the bobbin accommodated in said bobbin case taken out;

winding a preset amount of thread around the bobbin after the thread is removed therefrom; and setting the bobbin case accommodating the bobbin with the thread wound anew therearound to the shuttle.

3. An under thread supply apparatus for a sewing machine having a shuttle comprising:

a bobbin case adapted to be removably set to the shuttle of the sewing machine, said bobbin case accommodating a bobbin with the thread wound thereon;

set/take-out means for setting said bobbin case to the shuttle and taking said bobbin case out of the shuttle;

thread removal means for removing the thread from said bobbin accommodated in said bobbin case;

winding means for winding a preset amount of thread around the bobbin in said bobbin case; and moving means for moving the bobbin case to a location among said set/take-out means, the thread removal means, and the winding means, wherein said bobbin case taken out of the shuttle is moved to a thread removal position for the thread removal means, a winding position for the winding means, and finally to a set/take-out position for the set/take-out means.

4. An under thread supply apparatus for a sewing machine having a shuttle comprising:

a bobbin case adapted to be removably set to the shuttle of the sewing machine, the bobbin case accommodating a bobbin with a thread wound thereon;

set/take-out means disposed facing the shuttle for setting the bobbin case to the shuttle and for taking the bobbin out of the shuttle;

thread removal means cooperative with the taken out bobbin case for clamping the end of the thread wound on the bobbin in the bobbin case and for drawing the thread out of the bobbin;

winding means for supplying a new thread to the bobbin so as to wind a preset amount of thread around the bobbin after the thread is removed therefrom; and moving means for grasping and moving the bobbin case taken out of the shuttle to the set/take-out means, the thread removal means, and the winding means.

5. An under thread supply method for a sewing machine having a shuttle, the method comprising the steps of:

taking a bobbin case out of the shuttle of the sewing machine, the bobbin case accommodating a bobbin with a thread wound therearound and removably set to the shuttle;

moving the taken out bobbin case to a thread removal position;

removing the thread wound around the bobbin accommodated in said bobbin case that has been taken out;

moving said bobbin case to a thread winding position after the thread is removed;

winding a preset amount of thread around the bobbin of said bobbin case that has been moved;

moving said bobbin case while holding the bobbin with the thread wound therearound to a setting-to-shuttle position; and setting said bobbin case that has been moved to the shuttle.

6. In an under thread supply apparatus including a bobbin case adapted to be removably set to a shuttle of a sewing machine, the bobbin case accommodating a bobbin with a thread wound thereon, set/take-out means disposed facing the shuttle so as to set the bobbin case to the shuttle and to take the same out of the shuttle, winding means for supplying a new thread to the bobbin of the bobbin case so as to wind a preset amount of thread around the bobbin, and moving means, accommodating at least two bobbin cases including the bobbin case taken out of the shuttle, for moving the bobbin cases to the set/take-out means and the winding means successively or alternatively, the improvement comprising:

signal generating means for generating a signal indicating a stitching mode of a sewing machine when the signal generating means detects the stitching mode, and a signal indicating a stop mode of the sewing machine when the signal generating means detects the stop mode; and control means for controlling the set/take-out means and the winding means such that the winding means winds a thread on the bobbin when the signal generating means generates a stitching mode signal and the set/take-out means performs a set/take-out operation when the signal generating means generates a stop-mode signal.

7. In an under thread supply apparatus including a bobbin case adapted to be removably set to a shuttle of a sewing machine having a needle, the bobbin case accommodating a bobbin with a thread wound thereon, case exchange means for exchanging a first bobbin case set to the shuttle with a second bobbin case, and bobbin case transfer means for transferring the second bobbin case to the case exchange means, wherein after the case exchange means takes the first bobbin case from the shuttle, the second bobbin case transferred to the bobbin case transfer means is set to the shuttle, the improvement comprising:

detecting means for detecting the end of a stitching process by the sewing machine to generate a stitching-process end signal; and control means for operating the case exchange means in connection with the stitching-process end signal;

wherein the detecting means detects a state in which the sewing machine stops when the needle stops at an up position, and generates an up-position stop signal, and wherein the control means operates the case exchange means in response to the up-position stop signal, and inhibits the sewing machine from starting its operation during the operation of the case exchange means.

8. In an under thread supply apparatus including a bobbin case adapted to be removably set to a shuttle of a sewing machine, the bobbin case accommodating a bobbin with a thread wound around the shaft thereof, a thread supply source, set/take-out means disposed facing the shuttle so as to set the bobbin case to the shuttle and to take the same out of the shuttle, moving means, accommodating at least two bobbin cases including the bobbin case taken out of the shuttle, for moving the bobbin cases to the set/take-out means and the winding means successively or alternatively, the improvement comprising:

rotary means having means for connection to and disconnection from the bobbin case held by the moving means so as to allow only the bobbin accommodated in the bobbin case held by the moving means to turn;

thread insertion means for inserting the end of a thread supplied from the thread supply source into the bobbin accommodated in the bobbin case held by said moving means, from the outside of the bobbin case, and holding the end of the thread thereby; and control means for stopping said rotary means after said rotary means is rotated by a preset number of turns, whereby a thread is inserted into the bobbin accommodated in the bobbin case held by said moving means, and a preset amount of the thread is wound around the bobbin.

9. In an under thread supply apparatus including a bobbin case adapted to be removably set to a shuttle of a sewing machine, the bobbin case accommodating a bobbin with a thread wound around the shaft thereof, a thread supply source, set/take-out means disposed facing the shuttle so as to set the bobbin case to the shuttle and to take the same out of the shuttle, moving means, accommodating at least two bobbin cases including the bobbin case taken out of the shuttle, for moving the bobbin cases to the set/take-out means and the winding means successively or alternatively, the improvement comprising:

rotary means having means for connection to and disconnection from the bobbin case held by the moving means so as to allow only the bobbin accommodated in the bobbin case held by the moving means to turn;

thread insertion means for inserting the end of a thread supplied from the thread supply source into the bobbin accommodated in the bobbin case held by said moving means, from the outside of the bobbin case, and holding the end of the thread thereby;

thread cutting means for cutting the thread on a thread path extending between the thread supply source and the bobbin case held by said rotary means when said thread cutting means is located in the proximity of the bobbin case; and control means for operating said thread cutting means after said rotary means is rotated by a preset number of turns.

* * * * *